US012161234B2

(12) United States Patent
Deevers et al.

(10) Patent No.: US 12,161,234 B2
(45) Date of Patent: Dec. 10, 2024

(54) SEATING ARRANGEMENT

(71) Applicant: Steelcase Inc., Grand Rapids, MI (US)

(72) Inventors: Nickolaus William Charles Deevers, Holland, MI (US); Kurt R. Heidmann, Grand Rapids, MI (US); Gordon J. Peterson, Rockford, MI (US); Russell T. Holdredge, Alto, MI (US); Nathan Brock, Alto, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 18/470,873

(22) Filed: Sep. 20, 2023

(65) Prior Publication Data

US 2024/0008651 A1 Jan. 11, 2024

Related U.S. Application Data

(63) Continuation of application No. 17/856,310, filed on Jul. 1, 2022, now Pat. No. 11,800,935, which is a continuation of application No. 17/346,945, filed on Jun. 14, 2021, now Pat. No. 11,375,820, which is a continuation of application No. 16/414,058, filed on May 16, 2019, now Pat. No. 11,083,301.

(60) Provisional application No. 62/679,357, filed on Jun. 1, 2018.

(51) Int. Cl.
*A47C 7/54* (2006.01)
*A47C 7/44* (2006.01)

(52) U.S. Cl.
CPC ..... *A47C 7/541* (2018.08); *A47C 7/44* (2013.01)

(58) Field of Classification Search
CPC .. A47C 7/541; A47C 7/36; A47C 7/40; A47C 4/541; A47C 7/44
See application file for complete search history.

(56) References Cited

U.S. PATENT DOCUMENTS

| | | | |
|---|---|---|---|
| 1,234,567 | A | 7/1917 | Quigley |
| 1,270,350 | A | 6/1918 | Watkins |
| 4,860,987 | A | 8/1989 | Werner |

(Continued)

FOREIGN PATENT DOCUMENTS

| | | | |
|---|---|---|---|
| CN | 1277543 | A | 4/2004 |
| CN | 201119605 | Y | 9/2008 |

(Continued)

OTHER PUBLICATIONS

Chinese Patent Office; Search Report; Feb. 7, 2024; entire document.

*Primary Examiner* — Shin H Kim
(74) *Attorney, Agent, or Firm* — Price Heneveld LLP

(57) ABSTRACT

A seating arrangement including a seat member, a base, and an arm assembly including an arm base having a central portion and a receiver portion and exclusively supported from the base via a central portion at a position located between lateral outermost edges of the seat member, an arm stalk telescopingly received within the receiver portion and movable between retracted and extended positions, an arm support supported by the arm stalk, where the arm support moves in a forward direction with respect to the seat member as the arm stalk is moved from the retracted position to the extended position, and a bearing arrangement positioned between the arm stalk and the receiver portion and including a bearing member located between the receiver portion of the arm base and the arm stalk and a biasing member configured to bias the bearing.

20 Claims, 67 Drawing Sheets

(56) References Cited

U.S. PATENT DOCUMENTS

| | | | |
|---|---|---|---|
| 4,951,995 | A | 8/1990 | Teppo et al. |
| 4,968,094 | A | 11/1990 | Froyland et al. |
| 5,031,869 | A | 7/1991 | Strater et al. |
| 5,324,096 | A | 6/1994 | Schultz |
| 5,439,267 | A | 8/1995 | Peterson et al. |
| 5,620,233 | A | 4/1997 | Corwin |
| 5,647,638 | A | 7/1997 | Ritt et al. |
| 5,664,842 | A | 9/1997 | Tseng |
| 5,749,628 | A | 5/1998 | Synder et al. |
| 5,931,537 | A | 8/1999 | Gollin et al. |
| 5,997,093 | A | 12/1999 | Gollin et al. |
| 6,062,646 | A | 5/2000 | Bock |
| 6,062,647 | A | 5/2000 | Mei |
| 6,394,553 | B1 | 5/2002 | Mcallister et al. |
| 6,460,932 | B1 | 10/2002 | Kopish et al. |
| 6,540,300 | B2 | 4/2003 | Piretti |
| 6,619,746 | B2 | 9/2003 | Roslund et al. |
| 6,773,072 | B2 | 8/2004 | Phillips et al. |
| 6,896,333 | B1 | 5/2005 | Matern et al. |
| 7,097,254 | B2 | 8/2006 | Hobb et al. |
| 7,114,781 | B2 | 10/2006 | Costaglia |
| 7,234,779 | B2 | 6/2007 | Bedford et al. |
| 7,341,313 | B2 | 3/2008 | Bedford et al. |
| 7,472,962 | B2 | 1/2009 | Caruso et al. |
| 7,533,939 | B2 | 5/2009 | Fookes et al. |
| 7,661,763 | B2 | 2/2010 | Tsai |
| 7,770,979 | B2 | 8/2010 | He |
| 7,815,259 | B2 | 10/2010 | Fookes et al. |
| 7,819,482 | B2 | 10/2010 | Liviero et al. |
| 7,828,389 | B2 | 11/2010 | Oda |
| 7,841,665 | B2 | 11/2010 | Geister et al. |
| 7,896,440 | B2 | 3/2011 | Tsai |
| 7,980,632 | B2 | 7/2011 | Pai |
| 8,777,318 | B2 | 7/2014 | Chen |
| 9,004,603 | B1 | 4/2015 | Wang |
| 9,307,839 | B2 | 4/2016 | Cvek |
| 9,345,333 | B2 | 5/2016 | Gorgi |
| 9,565,945 | B2 | 2/2017 | Deskevich et al. |
| 9,661,930 | B2 | 5/2017 | Norman et al. |
| 9,848,707 | B1 | 12/2017 | Cassaday et al. |
| 9,913,540 | B2 | 3/2018 | Norman et al. |
| D852,526 | S | 7/2019 | Peterson et al. |
| D889,152 | S | 7/2020 | Hecht et al. |
| D891,842 | S | 8/2020 | Ludwig et al. |
| 2004/0070251 | A1 | 4/2004 | Roney et al. |
| 2004/0189073 | A1 | 9/2004 | Chadwick et al. |
| 2005/0274857 | A1 | 12/2005 | Gevaert |
| 2006/0226691 | A1 | 10/2006 | Bedford et al. |
| 2007/0164595 | A1 | 7/2007 | Chi |
| 2008/0036264 | A1 | 2/2008 | Pan |
| 2008/0036265 | A1 | 2/2008 | Pan |
| 2009/0278393 | A1 | 11/2009 | He |
| 2011/0062763 | A1 | 3/2011 | Tsai |
| 2011/0084535 | A1 | 4/2011 | Diffrient |
| 2012/0025574 | A1 | 2/2012 | Wilkinson et al. |
| 2012/0098318 | A1 | 4/2012 | Chen |
| 2012/0104823 | A1 | 5/2012 | Lai |
| 2013/0033082 | A1 | 2/2013 | Huang |
| 2013/0264855 | A1 | 10/2013 | Huang |
| 2014/0183922 | A1 | 7/2014 | Cvek |
| 2017/0354256 | A1 | 12/2017 | Peterson et al. |
| 2019/0029427 | A1 | 1/2019 | Eysing |

FOREIGN PATENT DOCUMENTS

| | | | |
|---|---|---|---|
| CN | 102669972 | B | 7/2015 |
| CN | 103445548 | A | 6/2016 |
| CN | 104661567 | A | 7/2018 |
| CN | 106455819 | A | 1/2020 |
| DE | 29511267 | U1 | 11/1995 |
| GB | 247712 | A | 2/1926 |
| GB | 2524766 | B | 7/2017 |
| JP | 2000004982 | A | 1/2000 |
| JP | 2013233165 | A | 11/2013 |
| WO | 2017087418 | A1 | 5/2017 |

SEATING ARRANGEMENT

CROSS-REFERENCE TO RELATED APPLICATION

This application is a continuation of U.S. patent application Ser. No. 17/856,310, filed on Jul. 1, 2022, entitled "SEATING ARRANGEMENT," now U.S. Pat. No. 11,800,935, which is a continuation of U.S. patent application Ser. No. 17/346,945, filed on Jun. 14, 2021, entitled "SEATING ARRANGEMENT," now U.S. Pat. No. 11,375,820, which is a continuation of U.S. patent application Ser. No. 16/414,058, filed on May 15, 2019, entitled "SEATING ARRANGEMENT," now U.S. Pat. No. 11,083,301, which claims the benefit of U.S. Provisional Patent Application No. 62/679,357, filed on Jun. 1, 2018, entitled "SEATING ARRANGEMENT," the entire disclosures of which are incorporated herein by reference.

TECHNICAL FIELD

Various embodiments relate to a seating arrangement, and in particular to a seating arrangement that includes various combinations of a pair of flexibly resilient shell members, a flexibly resilient support member and a rigid support member that cooperate to form a deformable and flexibly resilient four-bar linkage, and an active back arrangement having a movement that may be separated from movement of an associated seat support arrangement.

BRIEF SUMMARY

In one embodiment, an arm assembly includes an arm support configured to support an arm of a seater user, an arm stalk extending downwardly from and supporting the arm support, an arm base telescopingly receiving the arm stalk between a first position and a second position, and a bearing arrangement positioned between the arm stalk and the arm base. The bearing arrangement includes a bearing member configured to abut the arm base, and a biasing member configured to bias the bearing member from the arm stalk and into abutment with the arm base.

In another embodiment, an arm assembly includes an arm support configured to support an arm of a seated user, an arm stalk extending downwardly from and supporting the arm support, an arm base telescopingly receiving the arm stalk between a first position and a second position, and a control arrangement. The control arrangement includes a lead screw rotatable with respect to one of the arm stalk and the arm base, a lead nut fixed with respect to the other of the arm stalk and the arm base, and an actuator moveable between an engaged position where the actuator engages the lead screw thereby preventing rotation of the lead screw and preventing the arm stalk from moving between the first and second positions, and a disengage position where the actuator is disengaged from the lead screw thereby allowing rotation of the lead screw and allowing the arm stalk to move between the first and second positions.

In yet another embodiment, a seating arrangement includes a seat portion configured to support a seated user thereon, a back portion extending upwardly from the seat assembly and movable between an upright position and a reclined position, a support member operably coupled to and supporting the seat portion, the support member caused to move between a first position when the back portion is in the upright position and a second position when the back portion is in the reclined position, and a back recline lock arrangement. The back recline lock arrangement includes an actuator configured to be actuated between a engaged position and a disengaged position, a lock member caused to move between a locked position when the actuator is in the engaged position where the lock member prevents the support member from moving from the first position toward the second position, and an unlocked position when the actuator is in the disengaged position where the support member is free to move from the first position to the second position, and wherein the actuator is configured to move from the disengaged position to the engaged position to the engaged position when the chair back is in the reclined position, and the lock member is prevented from moving from the unlocked position to the locked position until the back assembly is moved from the reclined position to the upright position.

In still another embodiment, a seating arrangement includes a seat portion configured to support a seated user thereon, a back portion extending upwardly from the seat assembly and moveable between an upright position and a reclined position, a support member operably coupled to and supporting the seat portion, the support member caused to move between a first position when the back portion is in the upright position and a second position when the back portion is in the reclined position, and a back recline lock arrangement. The back recline lock arrangement includes an actuator configured to be actuated between an engaged position and a disengaged position, a lock member caused to move between a locked position when the actuator is in the engaged position where the lock member prevents the support member from moving from the first position toward the second position, and an unlocked position when the actuator is in the disengaged position where the support member is free to move from the first position to the second position, and wherein the actuator is configured to move from the engaged position to the disengaged position when the chair back is in the reclined position, and the lock member is prevented from moving from the locked position to the unlocked position until the back portion is moved rearward from the reclined position.

Various embodiments of the seating arrangements described here may provide a platform with the proper fit and function for comfortably supporting a seated user and may reduce or shift costs by reducing associated part counts, manufacturing costs, and labor costs. The seating arrangement includes an uncomplicated, durable, and visually appealing design capable of a long operating life, and particularly well adapted for the proposed use.

These and other features, advantages, and objects of various embodiments will be further understood and appreciated by those skilled in the art by reference to the following specification, claims, and appended drawings.

BRIEF DESCRIPTION OF THE DRAWINGS

FIG. 47;

DETAILED DESCRIPTION OF THE PREFERRED EMBODIMENTS

Figure 1:
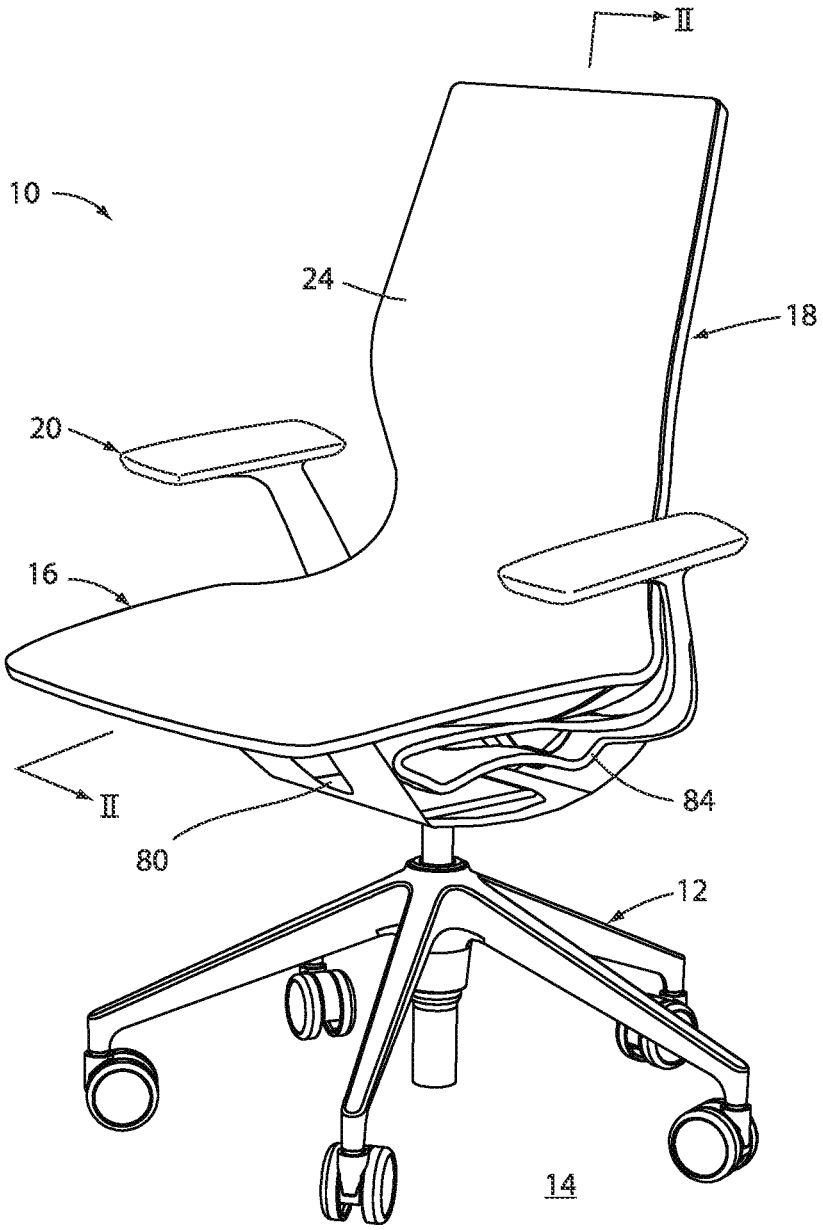
FIG. 1 is a perspective view of an embodiment of a seating arrangement.

For purposes of description herein, the terms "upper," "lower," "rear," "front," "vertical," "horizontal," and derivatives thereof shall relate to the various seating embodiments as oriented in FIGS. 1, 9, 17, 22, 30, 41 and 66. However, it is to be understood that certain embodiments may assume various alternative orientations and step sequences, except where expressly specified to the contrary. It is also to be understood that the specific devices and processes illustrated in the attached drawings, and described in the following specification are exemplary embodiments of the concepts defined in the appended claims. Hence, specific dimensions and other physical characteristics relating to the embodiments disclosed herein are not to be considered as limiting, unless the claims expressly state otherwise. The various embodiments disclosed herein may be utilized within and incorporated into various seating arrangements, including office chares, general office seating, vehicle seating, home seating, aircraft seating, stadium seating, theater seating, and the like, other furniture arrangements, including tables, desks, storage assembly, case goods, partition assemblies, privacy screens, and the like, as well as other articles of utility.

The reference numeral 10 (FIG. 1) generally designates an embodiment of a seating arrangement. In the illustrated example, the seating arrangement 10 is provided in the form of an office chair assembly and includes a castered base or support assembly 12 supported above a ground or floor surface 14, a seat arrangement 16 and a back arrangement 18 each supported above the base assembly 12, and a pair of arm assemblies 20. The seating arrangement 10 (FIGS. 2 and 3) includes a front or first shell member 22 covered by a fabric layer 24 (FIG. 1) and a rear or second shell member 26. The shell members 22, 26 may be formed as a single, integral piece or comprise multiple, individual components. The shell members 22, 26 each comprise a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 22, 26 to conform and move in response to forces exerted by a user. Other suitable materials may be also be utilized, such as metals, including, for example, steel or titanium; plywoods; or composite material including plastics, resin-based composites, metals and/or plywood. A variety of other suitable energy-storing materials may also be utilized. In some embodiments, shell members 22, 26 may comprise the same material or materials, while in certain embodiments, shell members 22, 26 may each comprise a different material or materials.

The front shell member 24 includes a horizontally-extending bottom or first portion or first link member 28, a vertically-extending upper or second portion 30 extending upwardly from the first portion 28, and an arcuately-shaped transition portion 32 extending between the first portion 28 and the second portion 30. The first portion 28 includes a forward portion 34, a rearward portion 36 and a central portion 38 located therebetween and extending laterally across the first portion 28. A pair of laterally-extending reliefs or apertures 40 are located within the central portion 38 and divide the forward portion 34 from the rearward portion 36 as further described below. The second portion 30 includes a lower portion 44, an upper portion 46 and a mid-portion 48 located therebetween that may be arcuately-shaped and forwardly convex so as to support the lumbar region of a user's back. It is noted that the front shell member 24 may alternatively be referred to herein as the forward shell member, the first shell member, the support member or support shell member, and the top shell or shell member.

The rear shell member 26 includes a horizontally-extending bottom or first portion or second link member 50 supported by a height adjustable pneumatic cylinder 12*a* at a connection point 12*b*, a vertically-extending upper or second portion 52 extending upwardly from the first portion 50, and an arcuately-shaped transition portion 54 extending between the first portion 50 and the second portion 52. Preferably, the rear shell member 26 comprises carbon fiber, however, other materials may also be utilized as described above. The second portion 52 of the rear shell member 26 includes a lower portion 56, an upper portion 58 and a mid-portion 60 located therebetween that may be arcuately-shaped and forwardly convex. The upper portion 58 of the second portion 52 of the rear shell member 26 is connected to the upper portion 46 of the second portion 30 of the front shell member 22 at a location 62, such as by sonic welding, an adhesive, integral molding, mechanical fasteners, and the like. It is noted that the rear shell member 26 may alternatively be referred to herein as the rearward shell member, the second shell member, the bottom shell or shell member, or the control arrangement. The front shell member 22 and the rear shell member 26 are configured so as to define a gap 64 between at least a portion of the upper portion 30 and upper portion 52, between the mid-portion 48 and the mid-portion 60, between the lower portion 44 and the lower portion 56, between the transition portion 32 and the transition portion 54, and/or between the first portion 28 and first portion 50. In certain embodiments, the front shell member 22 and the rear shell member 26 may be connected at the lower portions or mid-portions of their respective second portions 30 and 52 or at their respective transition portions 21 and 54. For example, the front shell member 22 and the rear shell member 26 may be connected at their respective lower portions 44 and 56 such that seating arrangement 10 essentially has a single shell second portion with a gap 64 between the first portions 28 and 50.

The seating arrangement 10 further includes a laterally-extending, flexibly resilient forward support member 66, and a laterally-extending, rigid rearward support member 68, each extending between the first portion 28 of the front shell member 22 and the first portion 50 of the rear shell member 26. In the illustrated example, the forward support member 66 is integral and forms a single-piece with the first portion 50 of the rear shell member 26, while the rearward support member 68 is formed as and is a separate piece from the front shell member 22 and the rear shell member 26. However, either or both the forward support member 66 and the rearward support member 68 may be formed integrally with or as a separate piece from the front shell member 22 and/or the rear shell member 26. In the present example, the rearward support member 68 preferably comprises a rigid, relatively lightweight carbon fiber, however, other material or materials may also be utilized depending on the application, including those listed above with respect to the front and rear shell members 24. The rearward support member 68 includes a body portion 70, an upper flange 72 secured to a bottom surface 74 of the first portion 28 at a location 74*a*, and a lower flange 76 secured to an upper surface 78 of the first portion 50 at a location 78*a*. The upper flange 72 and the lower flange 76 are secured to the first portion 28 and the first portion 50 by sonic welding, an adhesive, mechanical fasteners, friction fit and the like. Both the forward support member 66 and the rearward support member 68 angle forwardly from bottom to top, while the forward support member 66 includes a V-shaped notch or aperture 80 extending therethrough. In certain embodiments, the forward support member 66 may include one or more apertures, notches, or slots of varying shapes in order to promote a desired flexibility of the support member. Similarly, in some embodiments, the forward support member 66 may be a solid member shaped to promote a desired flexibility. The various configurations of the rear shell member as described herein, whether provided as a single, integral, one-piece unit or as a multiple-piece assembly allows the rear shell member to act as a control member to control various recline movements and support characteristics of the front shell member.

Figure 4A:
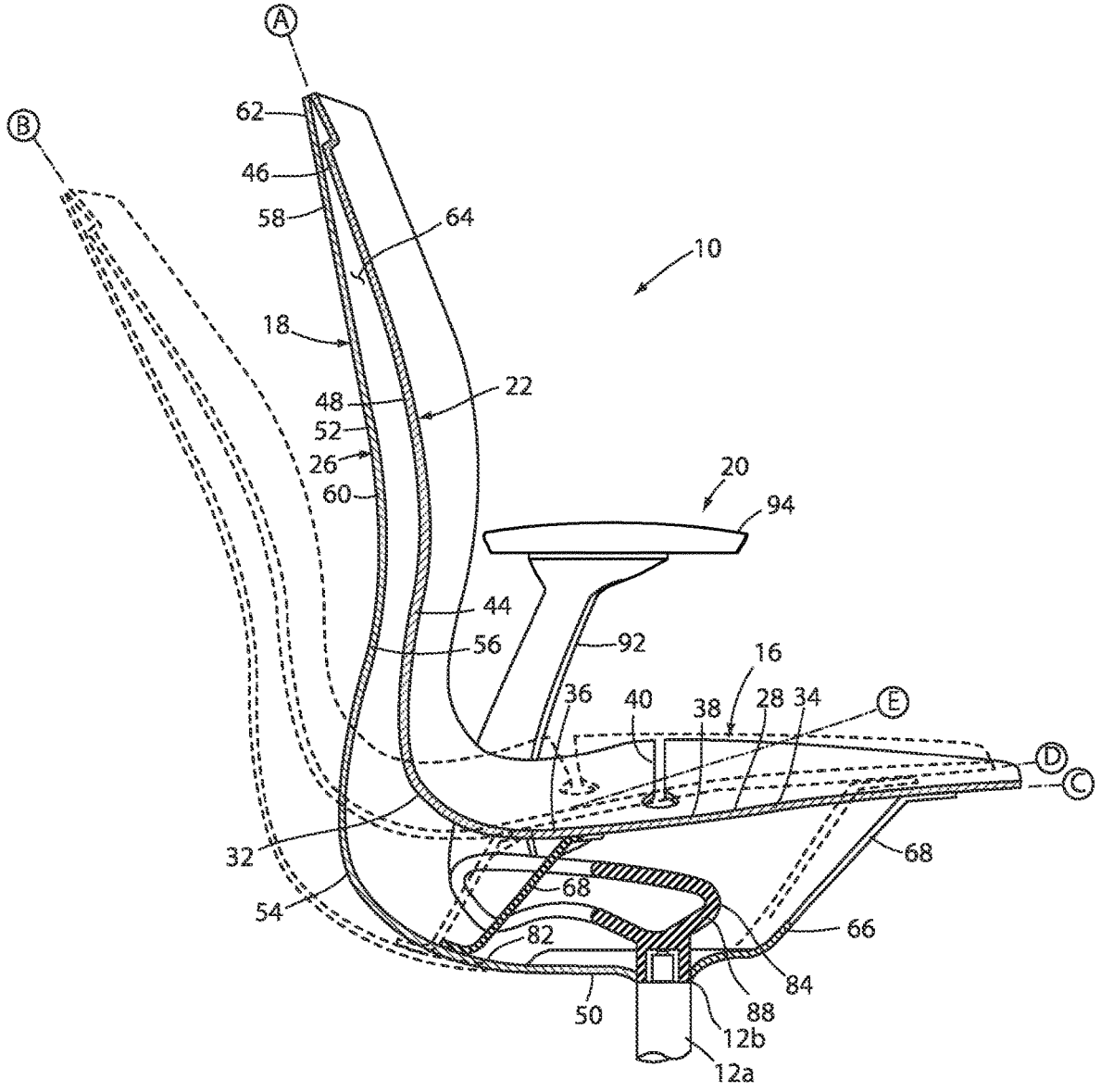
FIG. 4*a* is a cross-sectional side elevational view of the embodiment of the seating arrangement shown in FIG. 1 shown in an upright position in solid line and in a reclined position in dashed line.
Figure 4B:
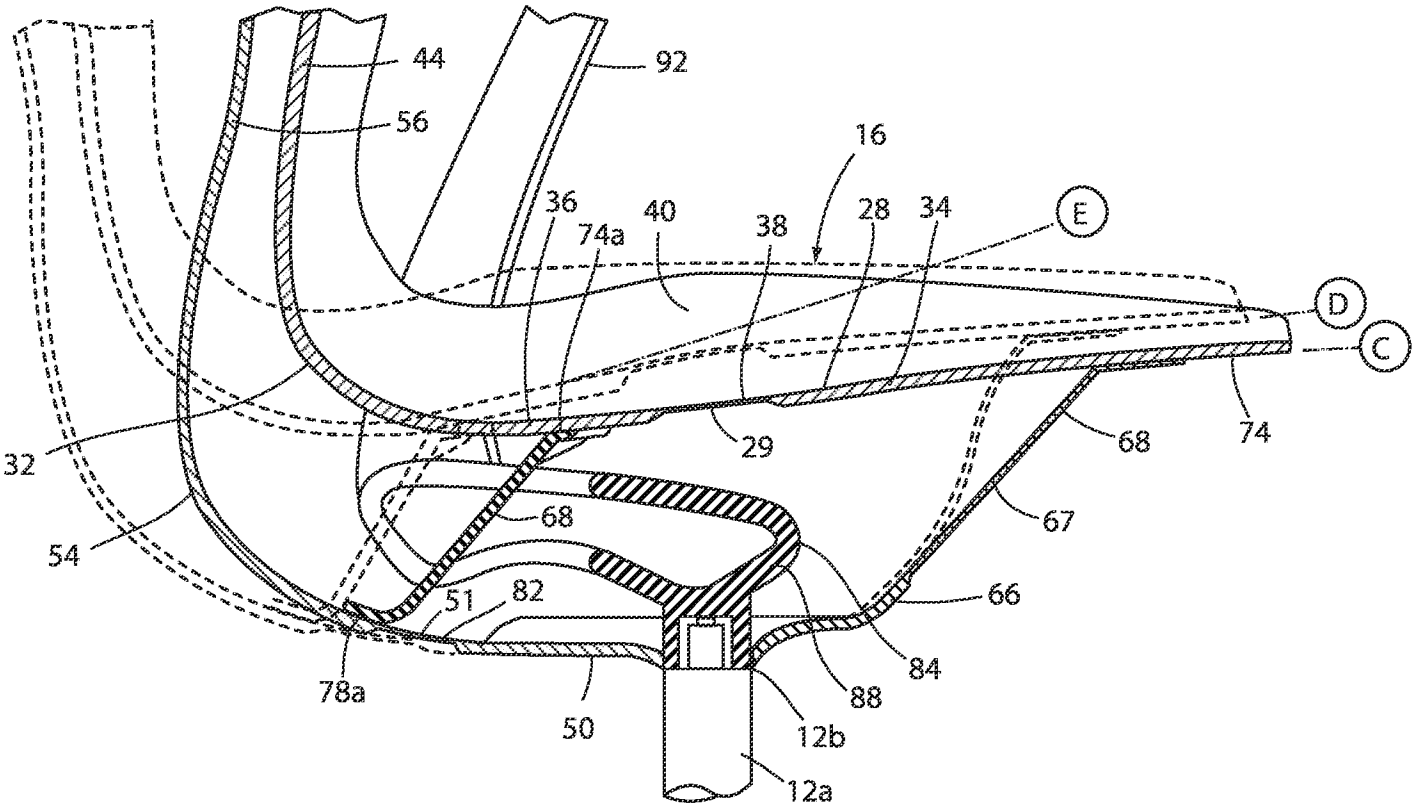
FIG. 4*b* is an enlarged cross-sectional side elevational view of another embodiment of a seating arrangement.

In operation, a user can move or recline the back arrangement 18 (FIG. 4*a*), including the second portion 30 of the front shell member 22 and the second portion 52 of the rear shell member 26, from an upright position A to a reclined position B by flexing the front shell member 22 and the rear shell member 26. The first portion or first link member 28, the first portion or second link member 50, the forward support member or third link member 66 and the rearward support member or fourth link member 68 cooperate to form a four-bar linkage arrangement such that movement of the second portion 30 of the first shell member 22 and the second portion 52 of the rear shell member 26 from the upright position A to the reclined position B causes the first portion 28 of the front shell member 22 to move rearward and to a reclined position. It is contemplated that the four-bar linkage arrangement as used and described herein is inclusive of linkage arrangements comprising additional linkage members, such as five-bar linkage arrangements, six-bar linkage arrangements, and the like. FIG. 4 illustrates in solid line the first portion 28 of the front shell member 22 in a substantially horizontal orientation C when not acted upon by external forces, such as a force exerted by a seated user. The apertures or reliefs 40 allow the rearward portion 36 to rotate more rapidly and to a greater recline angle than the forward portion 34 during recline of the back arrangement 18. Specifically, the forward portion 34 is moved from the position C to a rearward and reclined position D, while the rearward portion 36 of the first portion 28 is moved from the position C to a rearward and more reclined position E. In certain embodiments, apertures 40 may be positioned in first portion 28, either in the central portion 38, forward portion 34, or rearward portion 36, so as to achieve a desired rotation and recline angle during the recline of back arrangement 18. It is further noted that the rearward support member 68 remains rigid or substantially rigid during the entire recline movement of the seating arrangement 10, while most deformation of the front shell member 22 and the rear shell member 26 occur in a portion 82 of the rear shell member 26 just forward of the location at which the rearward support member 68 is connected to the rear shell member 26, in the central portion 38 of the first portion 28 of the first shell member 22, and in the forward support member 26. Further, in some instances, the fourth link 68 may include at least a portion of the back arrangement 18. In various embodiments, the thickness of one or more links may be determined to achieve a desired performance characteristic, including for example, the flexibility of the link. Further, in certain embodiments, the thickness of a link may vary along the length of the link to achieve a desired flexibility or rigidity across the link or in a localized portion of the link. For example, the first link member 28, the second link member 50 and the forward link member 66 may all be more flexible than the rear link member 68 to achieve the desired flexibility of the four-bar linkage. In some embodiments, the various links may be more flexible in a particular portion or localized area of the link such that the links are generally flexible in the localized area and are generally not flexible or less flexible in any other area of the link. An example of this embodiment is illustrated in FIG. 4*b* where certain portions of the first link member 28, the second link member 50, and the third link member 66 include certain portions with a reduced relative thickness. Specifically, in the illustrated example, the first link member 28 includes an area of reduced thickness or flexing region or flexing zone 29 located in the central portion thereof, the second link member 50 includes an area of reduced thickness or flexing region or flexing zone 51 positioned rearward of the location at which the fourth link member attaches to the second link member 50, and the third link member 66 includes an area of reduced thickness or flexing region or flexing zone 67. It is noted that the relative areas of reduced thickness may extend along a short distance or the majority of the length of the associated link depending upon the support and bending characteristics desired.

Figure 2:
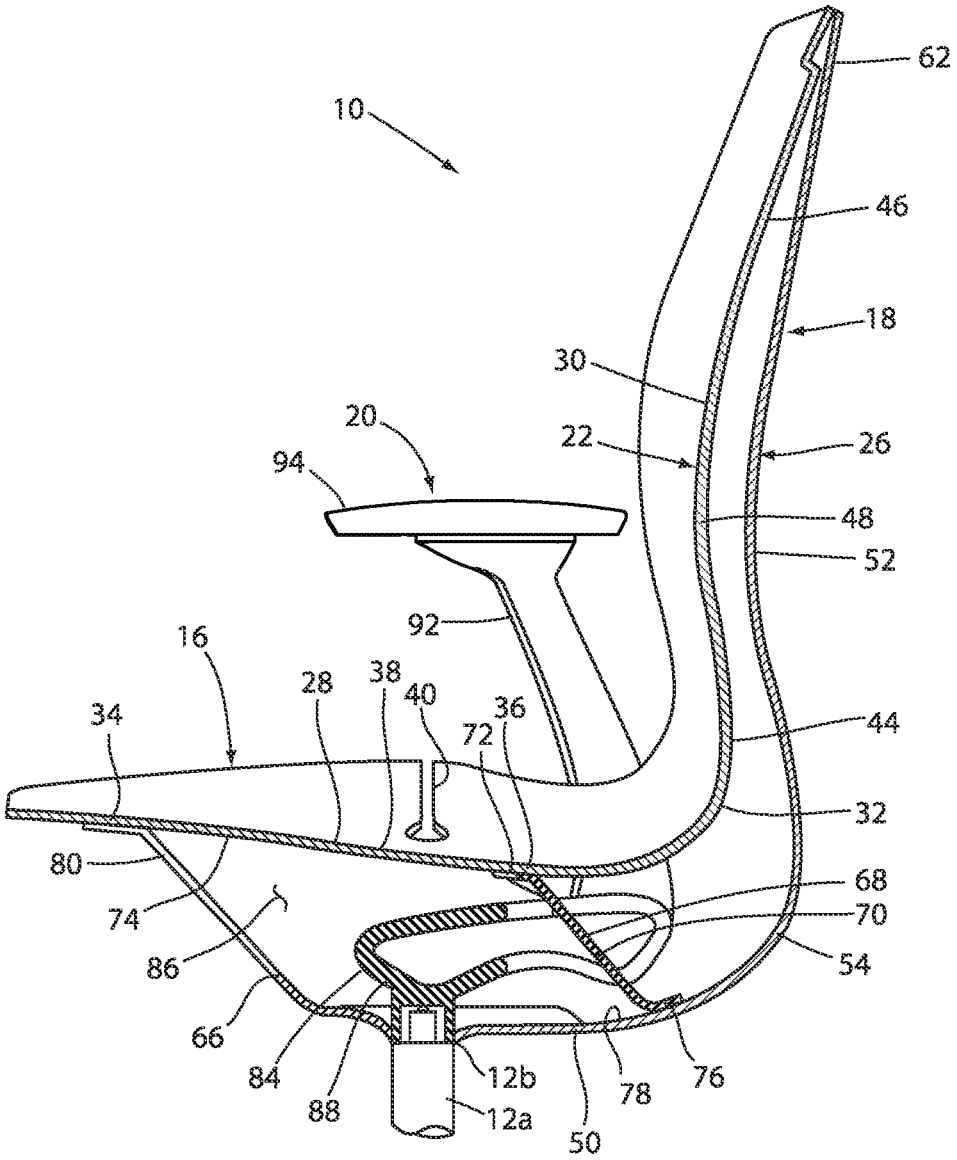
FIG. 2 is a cross-sectional side elevational view of the embodiment of the seating arrangement shown in FIG. 1 taken along the line II-II, FIG. 1.
Figure 3:
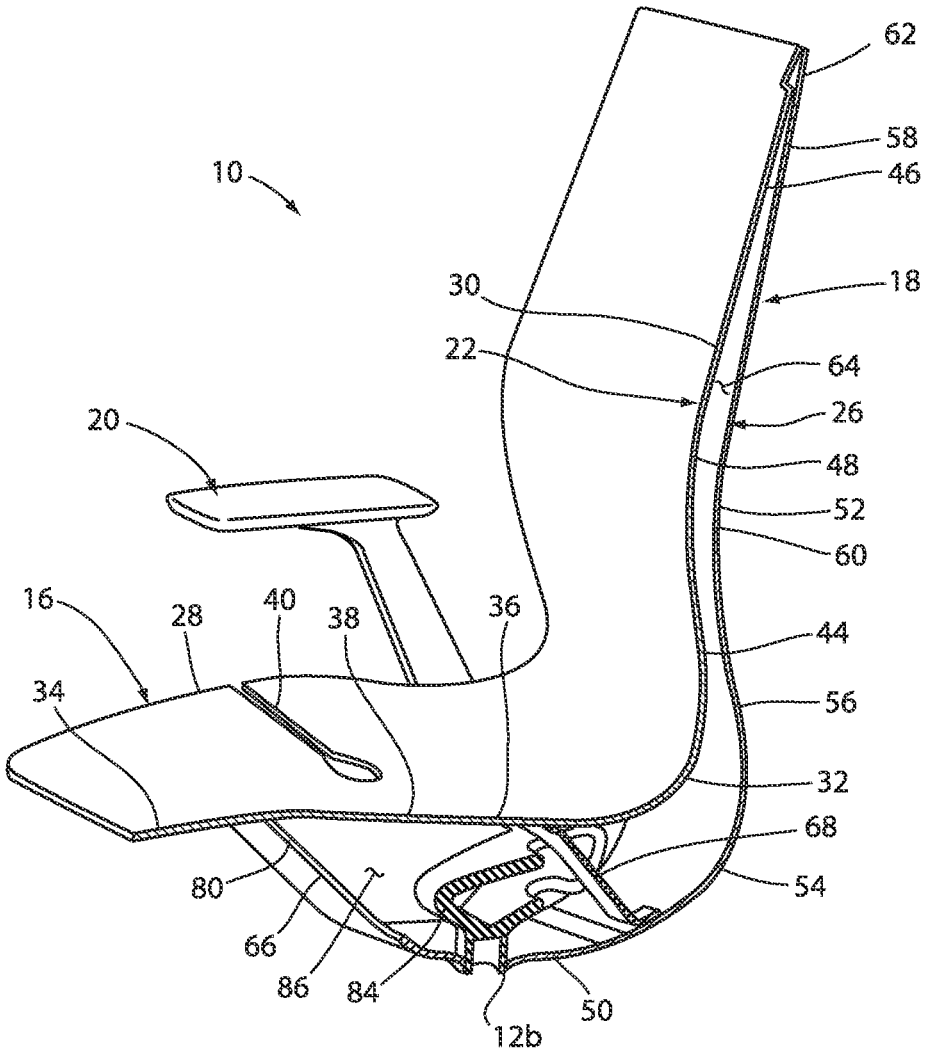
FIG. 3 is a cross-sectional perspective view of the embodiment of the seating arrangement shown in FIG. 1 taken along the line II-II, FIG. 1.

The seating arrangement 10 further includes a support member 84 (FIGS. 1-3) at least partially located within an interior space 86 defined by the four-bar linkage arrangement, namely, the first link member 28, the second link member 50, the third link member 66 and the fourth link member 68. In the illustrated example, the support member 84 includes an open, loop-shaped body portion 86, the forward portion of which extends into the interior space 86, and the rearward portion of which is configured to support the arm assemblies 20. As best illustrated in FIG. 2, each arm assembly 20 includes an arm support member 92 integrally formed with and extending upwardly from the rear portion of the body portion 88 of the support member 84. An arm cap 94 is secured to an upper end of the arm support member 92 and may be moveable adjustable with respect thereto. As best illustrated in FIG. 4, it is noted that the support member 84 and the arm assemblies 20 are grounded and remain substantially stationary as the back arrangement 18 is moved from the upright position A to the reclined position B.

Figure 5:
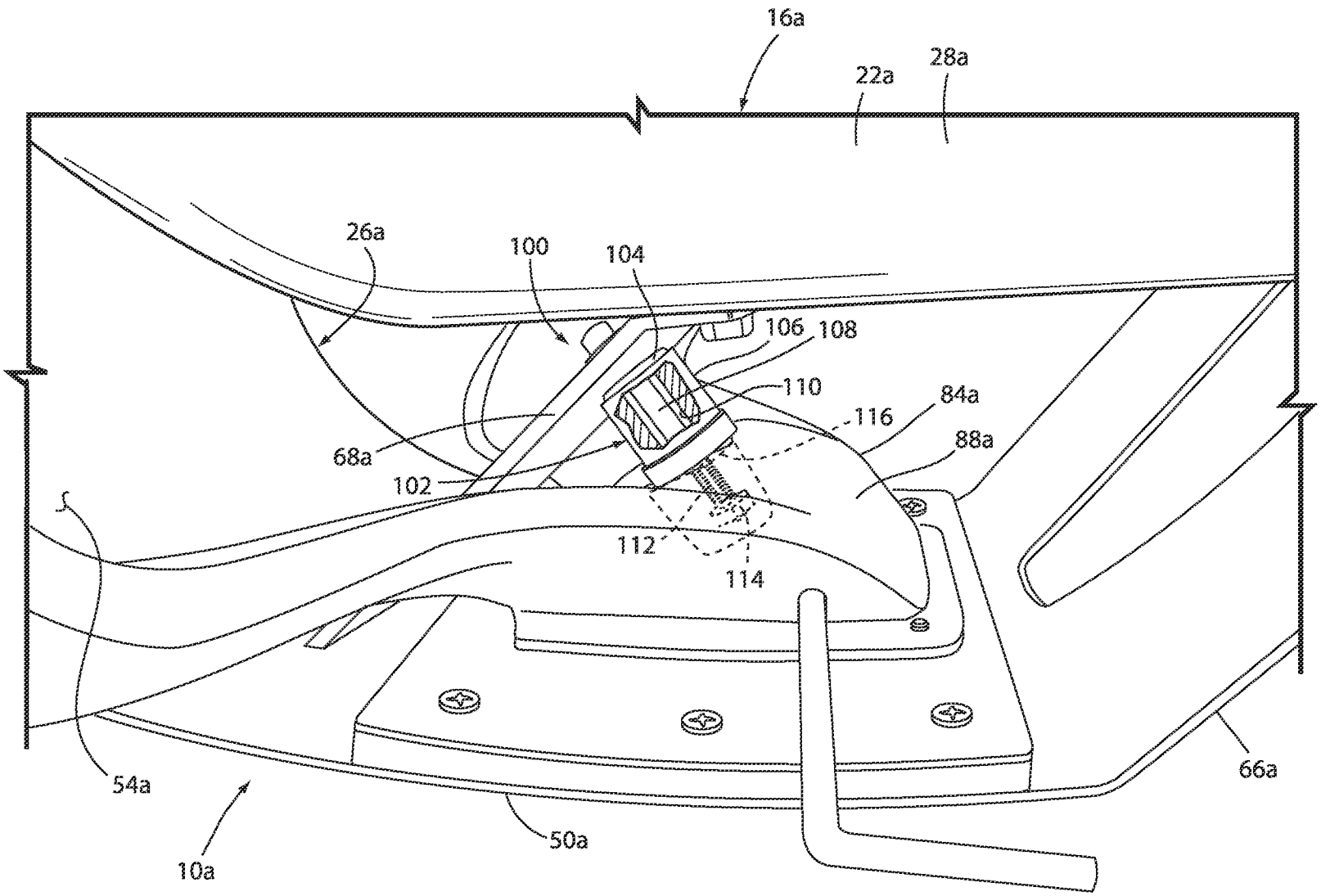
FIG. 5 is an enlarged perspective view of a first embodiment of a stop arrangement, wherein the associated seating arrangement is in a fully forward position.
Figure 6:
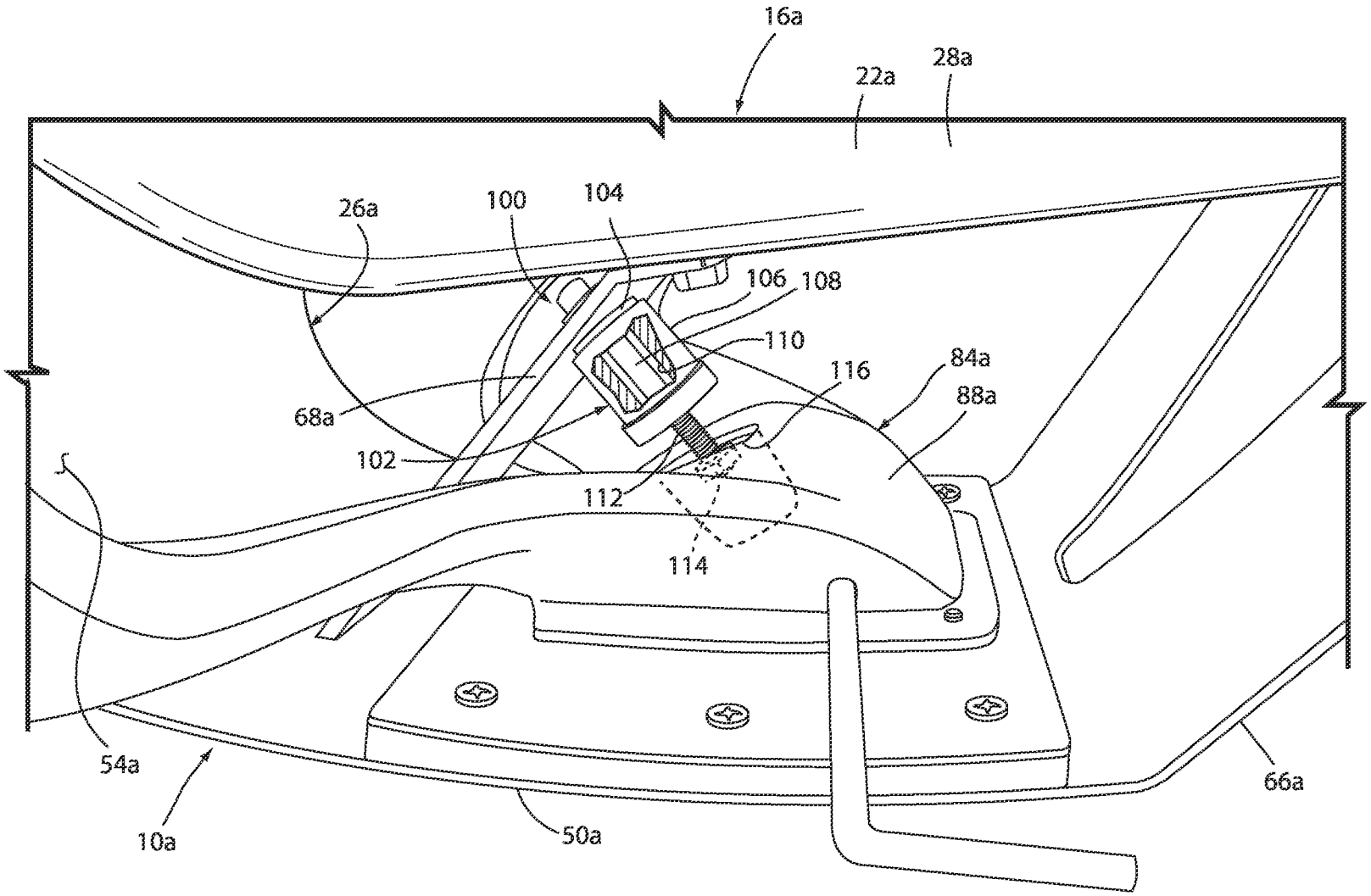
FIG. 6 is an enlarged perspective view of the first embodiment of a stop arrangement, wherein the associated seating arrangement is in a fully reclined position.

The reference numeral 10*a* (FIG. 5) generally designates another embodiment of a seating arrangement, having a stop arrangement 100. Since the seating arrangement 10*a* is similar to the previously described seating arrangement 10, similar parts appearing in FIGS. 1-4 and FIGS. 5 and 6 respectively are represented by the same, corresponding reference numeral, except for the suffix "a" in the numerals of the latter. In the illustrated example, the stop arrangement 100 includes a bushing assembly 102 positioned between the body portion 88*a* and the rearward support member 68*a*. The bushing assembly 102 includes an elastically deformable bushing member 104, a sleeve member 106 extending about the bushing member 104, and a stop link 108 slidably extending through a centrally disposed aperture 110 of the bushing member 104 and having a first end fixably coupled to the rearward support member 68*a* and a second end 112 slidably received within an interior of the body portion 88*a* of the support member 84*a*. A stop plate 114 is affixed to the second end 112 of the stop link 108.

In operation, the bushing member 104 is compressed between the body portion 88*a* of the support member 84*a* and the rearward support member 68*a* as the back arrangement is moved in a forward direction from the reclined position to a fully forward upright position, thereby limiting the forward movement of the back arrangement. As the back arrangement is moved from the upright position to the reclined position, the stop link 108 is drawn from within an interior of the body portion 88*a* until the stop plate 114 abuts an inner surface 116 of the body portion 88*a*, thereby limiting movement of the rearward support member 68*a* and thus the rearward movement of the back assembly from the upright position toward the reclined position.

Figure 7:
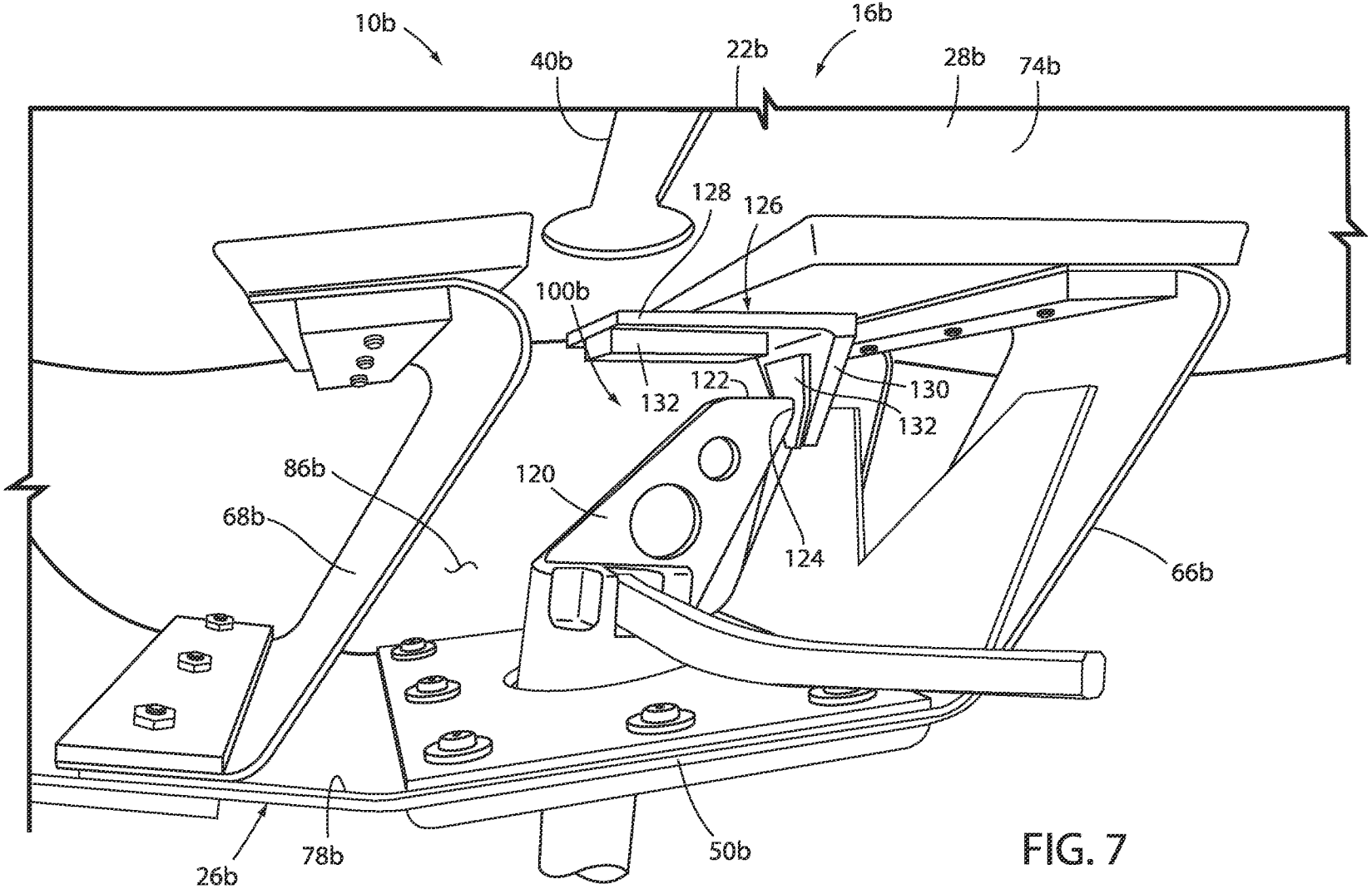
FIG. 7 is an enlarged perspective view of an alternative embodiment of the stop arrangement, wherein the associated seating arrangement is shown in a fully reclined position.
Figure 8:
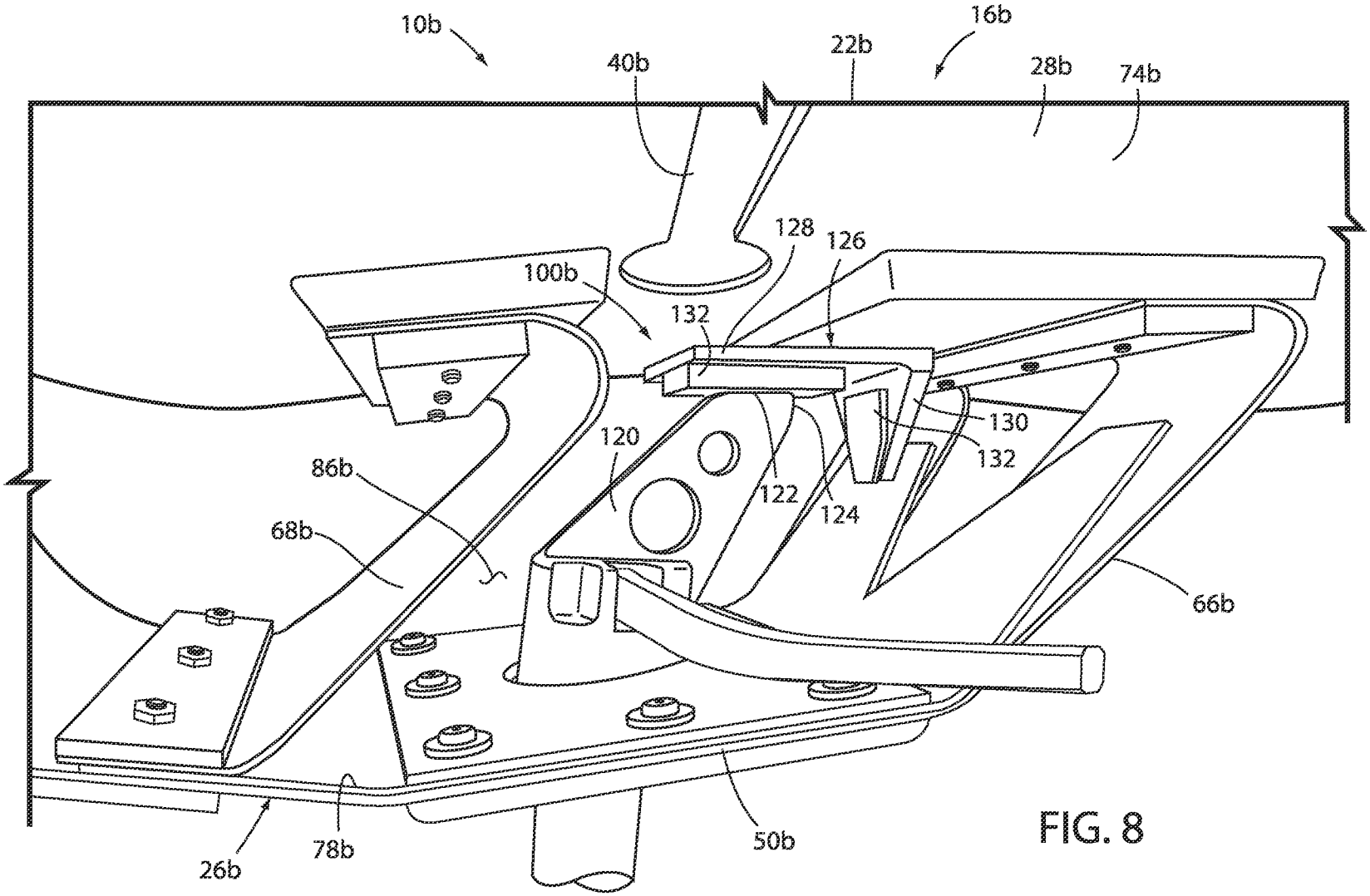
FIG. 8 is an enlarged perspective view of the alternative embodiment of the stop arrangement, wherein the associated seating arrangement is shown in a fully forward position.
Figure 9:
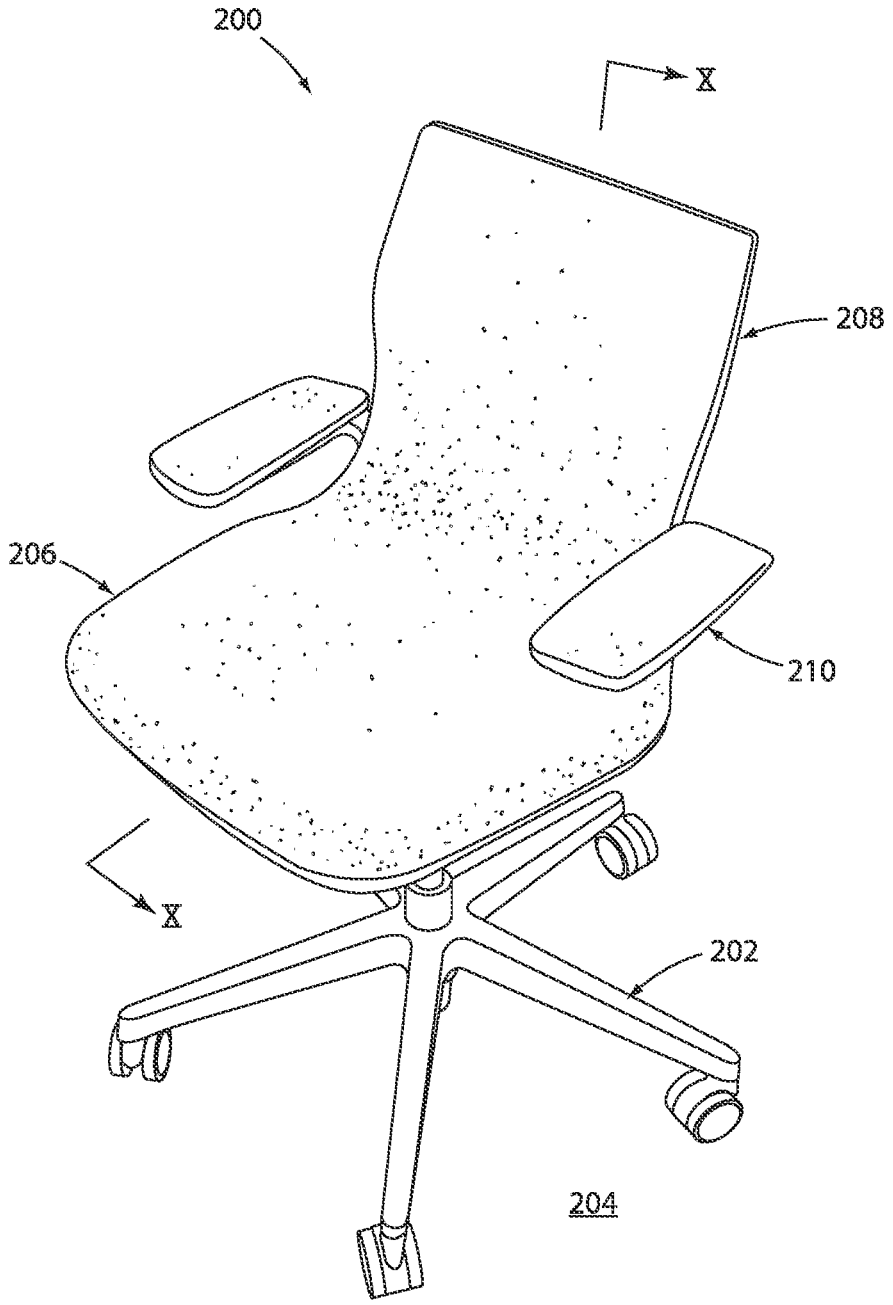
FIG. 9 is a perspective view of another embodiment of a seating arrangement.

The reference numeral 10*b* (FIGS. 7 and 8) generally designates another embodiment of a seating arrangement, having a stop arrangement 100*b*. Since the seating arrangement 10*b* is similar to the previously described seating arrangement 10*a*, similar parts appearing in FIGS. 5 and 6 and FIGS. 6 and 7 respectively are represented by the same, corresponding reference numeral, except for the suffix "b" in the numerals of the latter. In the illustrated example, the stop arrangement 100*b* includes a stop member 120 located within the interior space 86*b*. The stop member 120 is secured to an upper surface 78*b* of the first portion 50*b* of the rear shell member 26*b* and extends upwardly therefrom into the interior space 86*b* positioned between the first link member 28*b*, the second link member 50*b*, the third link member 66*b* and the fourth link member 68*b*. The stop member 120 includes an upper or first stop surface 122 and a forward or second stop surface 124. A stop bracket 126 is secured to the bottom surface 74*b* of the first portion or first link member 28*b*, and includes a first portion 128 extending substantially parallel with the first portion or first link member 28*b*, and a second portion 130 extending orthogonally downward from the first portion 128. Elastically deformable abutment pads 132 are attached to the first portion 128 and the second portion 130.

In operation, the stop member 120 is configured to abut the pad 132 attached to the first portion 128 as the back assembly is moved from the reclined position toward a fully forward position, thereby limiting the amount of forward travel of the first portion or first link member 28*b* and the back assembly 12 in the forward direction. The stop member 120 is further configured such that the forward stop surface 124 contacts the pad 132 attached to the second portion 130 when the back arrangement is moved from the upright position to the reclined position, thereby limiting the amount of rearward travel of the first portion or first link member 28*b* and the back arrangement in the rearward direction.

Figure 10:
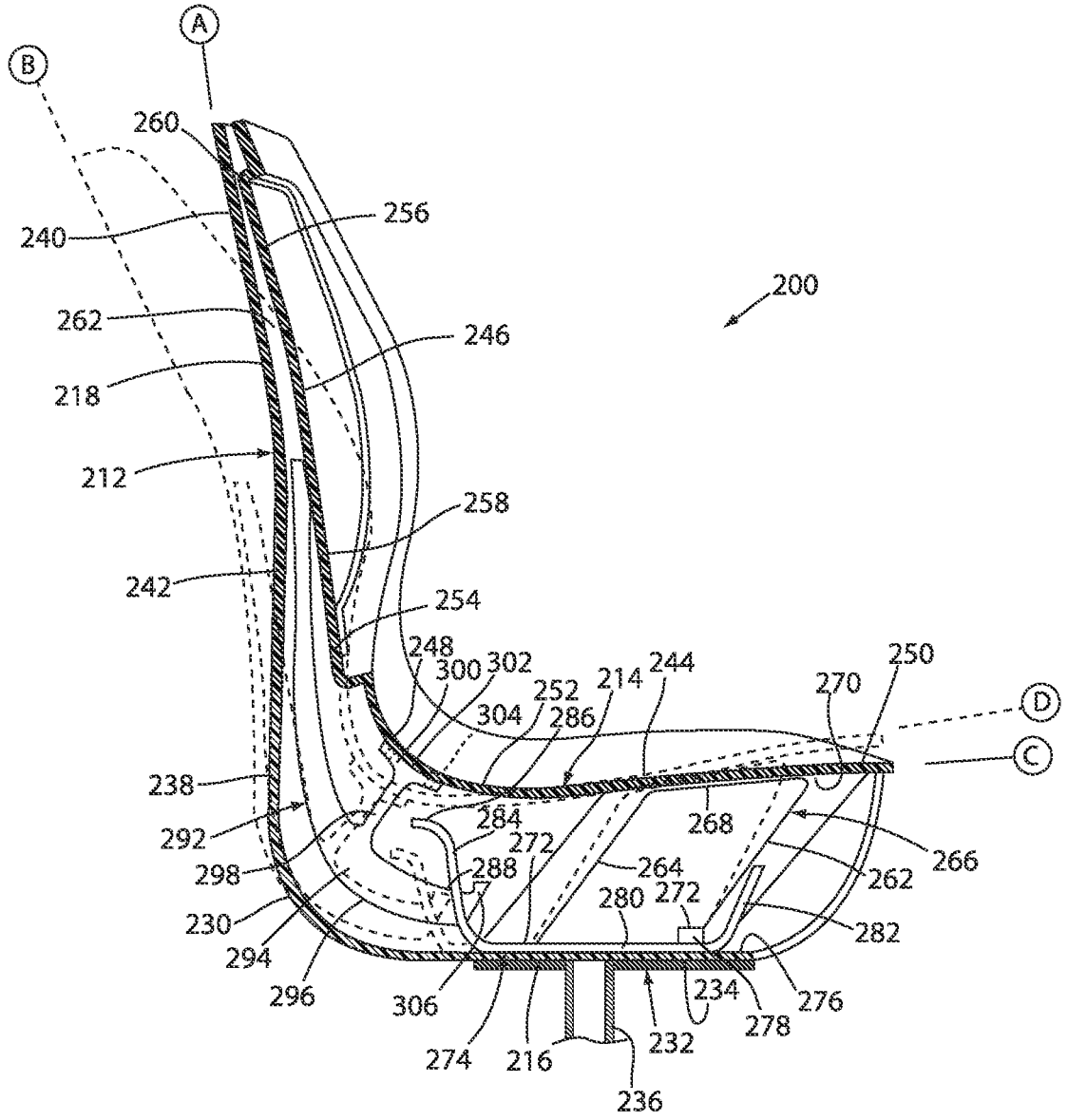
FIG. 10 is a cross-sectional side elevational view of the embodiment of the seating arrangement shown in FIG. 9 taken along the line X-X, FIG. 9.
Figure 11:
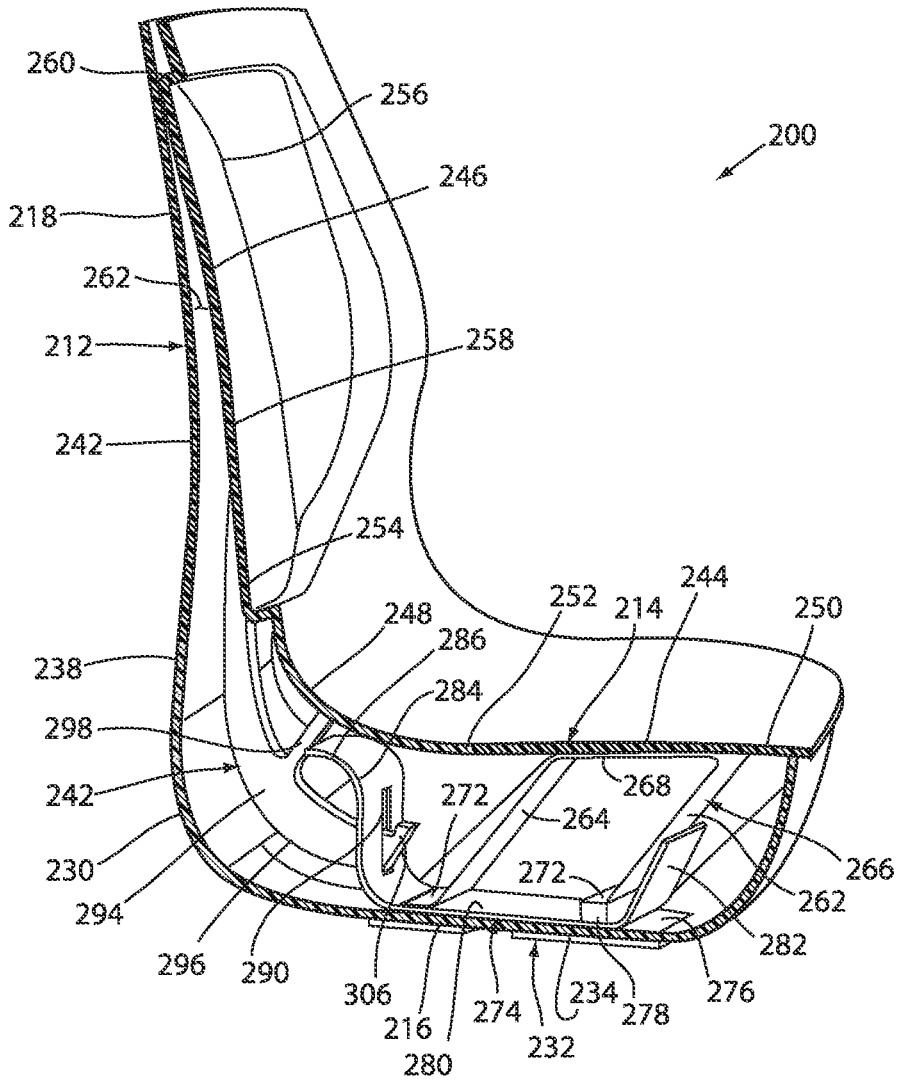
FIG. 11 is a cross-sectional perspective view of the embodiment of the seating arrangement shown in FIG. 9 taken along the line X-X, FIG. 9.

The reference numeral 200 (FIG. 9) generally designates another embodiment of a seating arrangement. In the illustrated example, the seating arrangement or chair assembly 200 includes a castered base assembly 202 abutting a floor surface 204, a seat assembly 206 and a back assembly 208 each supported above the base assembly 202, and a pair of arm assemblies 210. In the illustrated example, the chair assembly 200 (FIGS. 10 and 11) includes a front or a first shell member 214 and a rear or second shell member 212. The shell members 212, 214 may be formed as a single, integral piece or comprise multiple, individual components. The shell members 212, 214 each comprise a flexibly resilient polymer material such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 212, 214 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

The rear shell member 212 includes a horizontally-extending bottom or first portion 216, a vertically-extending upper or second portion 218 extending upwardly from the first portion 216, and an arcuately-shaped transition portion 230 extending between the first portion 216 and the second portion 218. In the illustrated example, the first portion 216 is supported by a support plate 232 that abuts a bottom surface 234 of the first portion 216, and which is in turn supported by a column 236 of the pedestal assembly 202. In the illustrated example, the column 236 comprises a pneumatic height adjustment cylinder. The second portion 218 of the rear shell member 212 includes a lower portion 238, an upper portion 240 and an arcuately-shaped, forwardly convex mid-portion 242 located therebetween.

The front shell member 214 includes a horizontally-extending bottom or first portion 244, a vertically-extending upper or second portion 246 extending upwardly from the first portion 244, and an arcuately-shaped transition portion 248 extending between the first portion 244 and the second portion 246. The first portion 244 includes a forward portion 250 and a rearward portion 252, while the second portion 246 includes a lower portion 254, an upper portion 256 and an arcuately-shaped, forwardly convex mid-portion 258 located therebetween and configured to support the lumbar region of a user's back. The upper portion 256 of the second portion 246 of the front shell member 214 is connected to the upper portion 240 of the second portion 218 of the rear shell member 212 at a location 260, such as by sonic welding, an adhesive, integral molding, mechanical fasteners, and the like. The second shell member 212 and the first shell member 214 are configured so as to define a gap 262 between at least a portion of the upper portion 256 and the upper portion 240, between the mid-portion 258 and the mid-portion 242, between the lower portion 254 and the lower portion 238, between the transition portion 248 and the transition portion 230, and between the second portion 246 and the second portion 218.

The chair assembly 200 further includes a pair of laterally-extending, flexibly resilient support members, including a forward support member 262 and a rearward support member 264, each extending between the second portion 246 of the first shell member 214 and the second portion 218 of the second shell member 212. In the illustrated example, the forward support member 262 and the rearward support member 264 are integrally formed within a single spring member 266, however, the forward support member 262 and the rearward support member 264 may be formed as separate pieces, or as integral portions of the second shell member 212 and/or the first shell member 214. In the present example, the spring member 266 comprises a single sheet of metal material shaped to include the forward support member 262, the rearward support member 264, a support portion 268 attached to an underside or bottom surface 270 of the second portion 246 of the first shell member 214, and a pair of connection portions 272 extending rearwardly from the associated forward support member 262 and rearward support member 264. The connection portions 272 are secured to a spring stop member 274 which is described below. Alternatively, the connection portions 272 of the spring member 266 may be attached directly to an upper surface 276 of the second portion 218 of the second shell member 212. In the illustrated example, the connection portion 272 associated with the rearward support member 264 is attached to an upper surface of the spring stop member 274, while the connection portion 272 of the forward support member 262 is attached to and spaced from the upper surface of the spring stop member 274 by a spacer member 278 that is in turn attached to the upper surface of the spring stop member 274.

In operation, a user can move or recline the second portion 218 of the second shell member 212 and the second portion 246 of the first shell member 214 from an upright position A to a reclined position B by flexing the second shell member 212 and the first shell member 214. Movement of the second portion 218 of the second shell member 212 and the second portion 246 of the first shell member 214 from the upright position A to the reclined position B causes the first portion 244 of the first shell member 214 to move from a first position C to a rearward and reclined position D. Specifically, the first portion 216 of the second shell member 212, the first portion 244 of the first shell member 214, the forward support member 262 and the rearward support member 264 cooperate to form a flexible or deformable four-bar linkage allowing movement of the second portion 246 of the first shell member 214 to the first position C to the reclined position D. In some embodiments, the forward support member 262 and the rearward support member 264 are each more flexible than the second portion 246 of the first shell member 214, and the second portion 246 of the first shell member 214 is more flexible than the second portion 218 of the second shell member 212. In other embodiments, the various thicknesses of the links or members comprising the deformable four-bar linkage may vary so as to provide specific support and bending characteristics as previously described. It is noted that the deformable four-bar linkage does not include specific pivot assemblies and the components typically associated therewith, thereby reducing the complexity of the overall system. The spring member 266 is configured to return the four-bar linkage to the original position once the external force is removed. In the illustrated example, the forward support member 262 and the rearward support member 264 are substantially the same length, however as noted above, the connection portion 272 of the forward support member 262 is spaced from the spring stop member 274 or the upper surface 276 of the second portion 218 of the second shell member 212 by the spacer member 278, thereby effectively changing the moment arm length of the forward support member 262. As a result, the forward portion 250 of the second portion 246 of the first shell member 214 rises at a greater rate than the rearward portion 258 of the second portion 246 as the second portion 246 of the first shell member 214 is moved from the first position C to the reclined position D.

The spring stop member 274 includes a body portion 280 attached to the upper surface 276 of the second portion 218 of the second shell member 212, a forward stop portion 282 extending angularly forward and upward from the body portion 280, and a rearward stop portion 284 extending angularly rearward and upward from the body portion 280. The forward stop portion 282 is configured such that the forward support member 262 contacts the forward stop portion 282 thereby limiting the forward movement of the forward support member 262. In the illustrated example, the forward stop portion 282 is substantially flexible, thereby providing a spring effect or cushioning to the forward movement of the forward support member 262. However, the forward stop portion 282 may also comprise a substantially rigid material. The rearward stop portion 284 includes an arcuately-shaped upper end 286, and a mid-portion 288 that includes a vertically-extending slot 290. In operation, the upper end 286 is configured to abut the transition portion 248 of the first shell member 214, thereby limiting the rearward travel of the transition portion 248 with respect to the transition portion 230. In the illustrated example, the upper end 286 and the mid-portion 288 of the spring stop member 274 are flexibly resilient, so as to provide a soft-stop or cushioning to the rearward motion of the transition portion 248 to the transition portion 230.

A spacer 292 is positioned between the transition portion 230 of the second shell member 212 and the transition portion 248 of the first shell member 214. In the illustrated example, the spacer 292 includes an arcuately-shaped body portion 294 having a rearwardly-facing arcuately-shaped abutment surface 296, wherein the abutment surface 296 is complementary to the shape of the transition portion 230 of the second shell member 212. The spacer 292 further includes an arm portion 298 and a forward abutment portion 300 located at a distal end of the arm portion 298. The forward abutment portion 300 includes a forwardly-facing arcuately-shaped forward abutment surface 302 that abuts and is complementary to the shape of the transition portion 248 of the first shell member 214. The forward abutment portion 300 is secured to the transition portion 248 of the first shell member 214 by a plurality of mechanical fasteners such as bolts 304. In operation, the abutment surface 296 is spaced from the transition portion 230 of the second shell member 212 when the second shell member 212 and the first shell member 214 are in the upright position A. The abutment surface 296 moves rearwardly toward the transition portion 230 of the second shell member 212 as the second shell member 212 and the first shell member 214 are moved from the upright position A toward the reclined position B, until the abutment surface 296 abuts the transition portion 230, thereby reducing the total amount of flexure possible of the second shell member 212 and the first shell member 214 and maintaining a structural shape to the transition portion 230 and the transition portion 248. The spacer 292 further includes a stop member 306 extending upwardly from a forward end of the body portion 294 and received within the slot 290 of the mid-portion 288 of the spring stop member 274. The stop member 306 abuts an upper end of the slot 290, thereby providing a limit to the rearward recline of the second shell member 212 and the first shell member 214.

Figure 12:
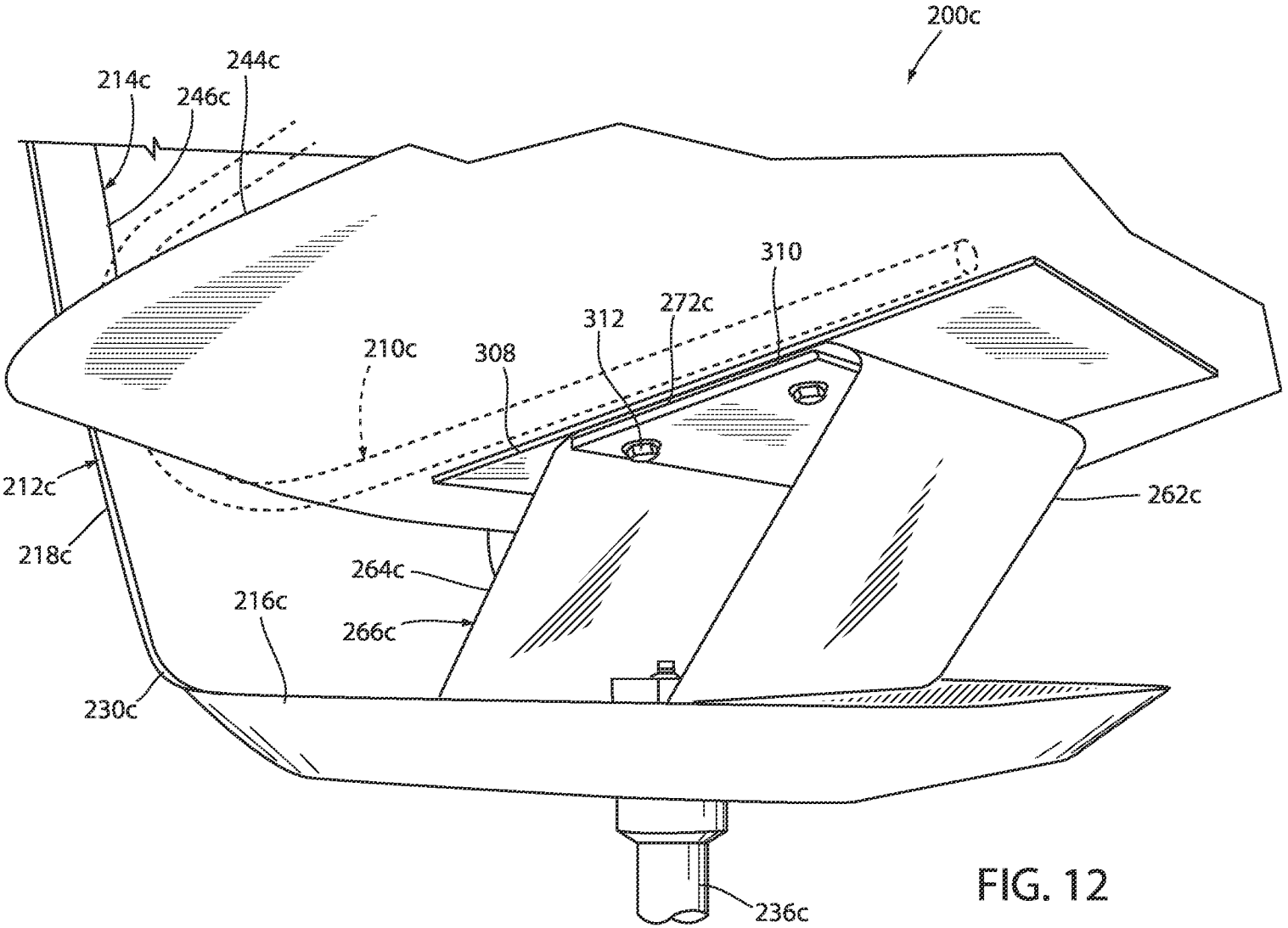
FIG. 12 is a bottom perspective view of yet another embodiment of the seating arrangement.

Alternatively, a chair assembly 200*c* (FIG. 12) may be provided with a pair of reinforcement plates that structurally support and secure the connection portion 272*c* of the spring member 266*c* to the second portion 246*c* of the first shell member 214*a*. Since the chair assembly 200*c* is similar to the previously described chair assembly 200, similar parts appearing in FIGS. 9-11 and in FIG. 12 respectively are represented by the same, corresponding reference numeral, except for the suffix "c" in the numerals of the latter. As illustrated, the chair assembly 200*c* includes an upper reinforcement or support plate 308 positioned above the connection portion 272*c* of the spring member 266*c*, and a lower or second support plate 310 positioned below the connection portion 272*c* of the spring stop member 274*c*, thereby sandwiching the connection portion 272*c* therebetween. The plates 308, 310 and the second portion 272*c* of the spring member 266*c* are coupled to the first portion 244*c* of the second shell member 214*a* by a plurality of mechanical fasteners such as bolts 312. The plate 308 may also be configured to support the arm assemblies 210*c*.

Figure 13:
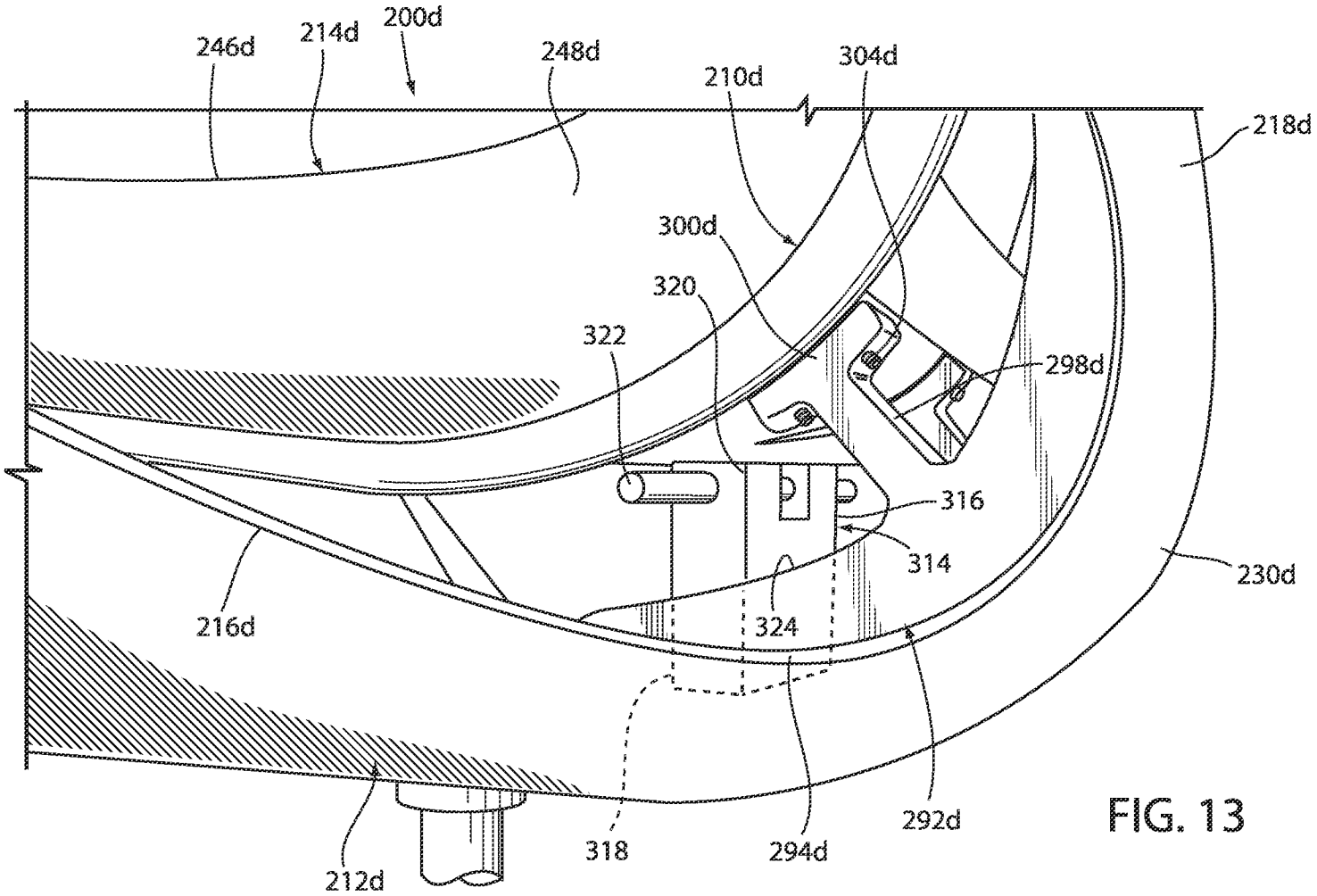
FIG. 13 is a bottom perspective view of still yet another embodiment of the seating arrangement, wherein the seating arrangement is in an upright position.
Figure 14:
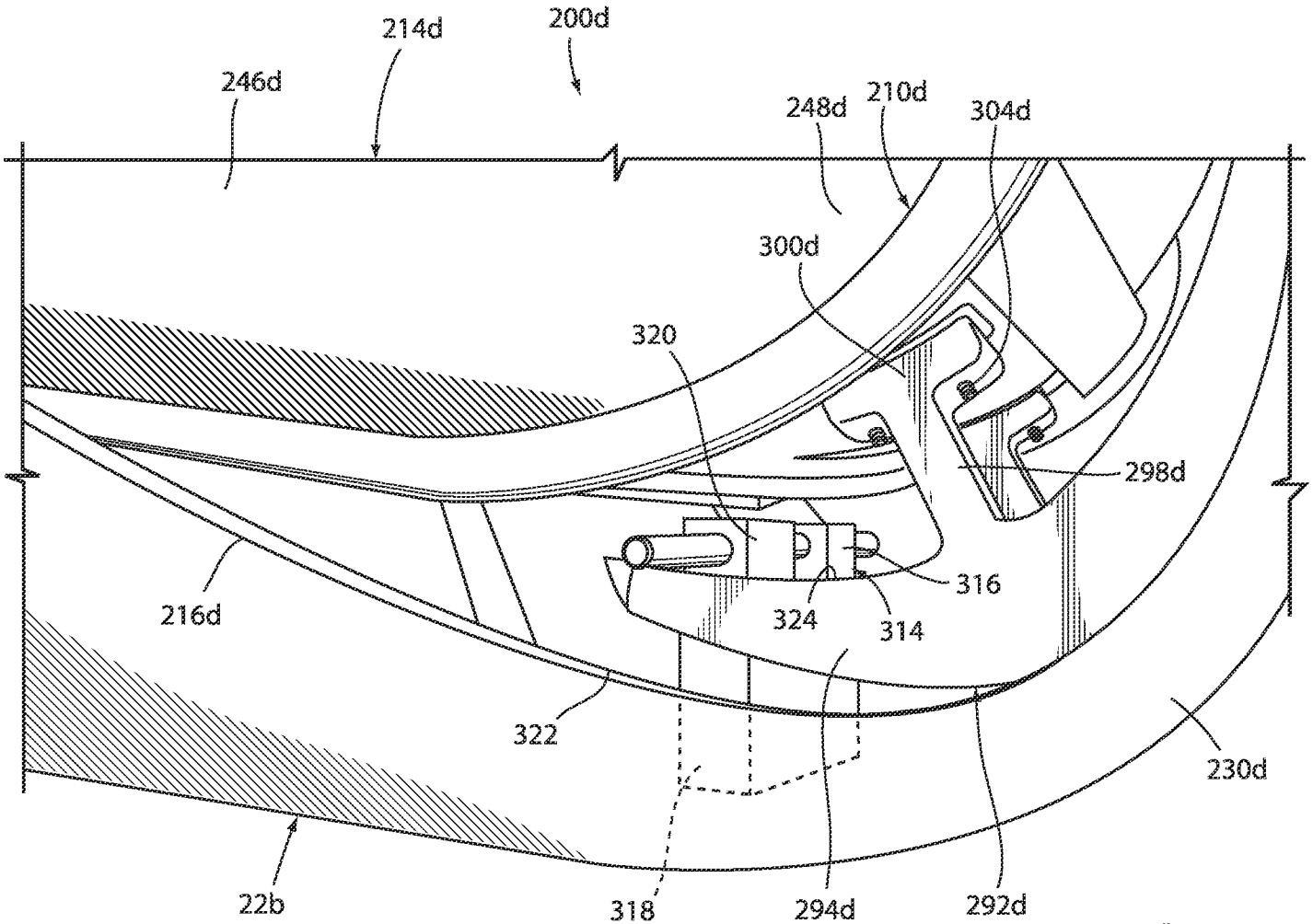
FIG. 14 is a bottom perspective view of the embodiment of the seating arrangement of FIG. 13, wherein the seating arrangement is in a reclined position.

Another alternative embodiment is illustrated in FIG. 13, wherein the chair assembly 200*d* includes an upright stop member 314. Since the chair assembly 200*d* is similar to the previously described chair assembly 200, similar parts appearing in FIGS. 9-11 and FIG. 13 are respectively represented by the same, corresponding reference numeral, except for the suffix "d" in the numerals of the latter. The upright stop member 314 includes a substantially rectangular block-shaped body portion 316 having a proximal end 318 secured to the first portion 216*d* of the second shell member 212*d*, and a distal portion 320. The upright stop member 314 further includes a pair of stop members such as pins 322 extending laterally outward from the distal portion 320. As best illustrated in FIG. 13, the body portion 294*d* of each of the spacers 292*d* are spaced from the associated pins 322 when the second shell member 212*d* and the first shell member 214*d* are in the upright position. As best illustrated in FIG. 14, the spacers 292*d* rotate rearwardly with the transition portion 248*d* of the first shell member 214*d* until an upper surface 324 of the body portion 294*d* of each of the spacers 292*d* contact or abut the pins 320, thereby preventing the second shell member 212*d* and the first shell member 214*d* from further reclining.

Figure 15:
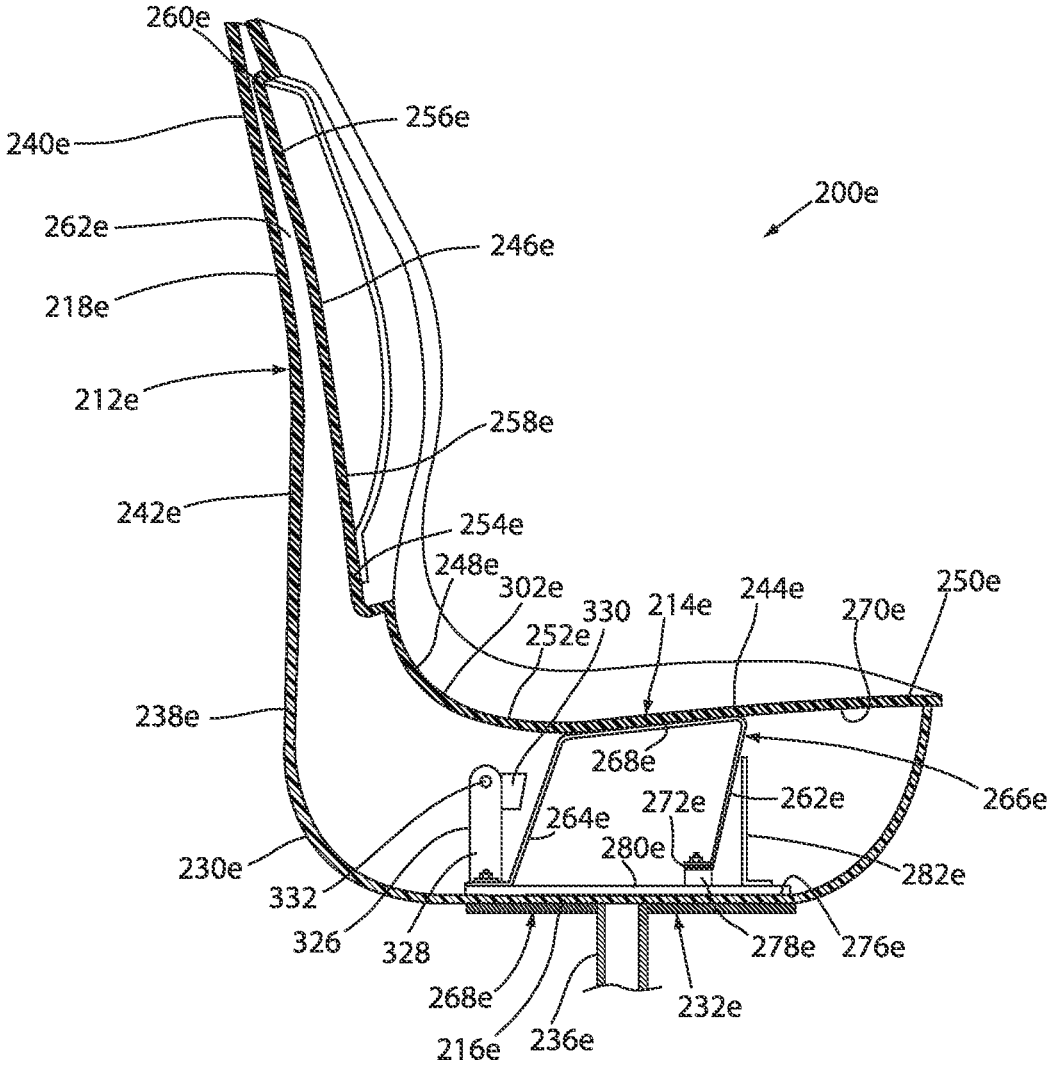
FIG. 15 is a cross-sectional view of another embodiment of a seating arrangement.

In another alternative embodiment, a chair assembly 200*e* (FIG. 15) includes an alternative stop arrangement 326. In the illustrated example, the chair assembly 200*e* is similar to the chair assembly 200, with the most notable exception being an alteration to the rearward stop arrangement. Since the chair assembly 200*e* is similar to the chair arrangements 200, 200*c*, similar elements appearing in FIGS. 1-4 and FIG. 7 are represented by the same corresponding reference numeral, except for the suffix "e" in the numerals of the latter. The stop arrangement 326 includes a mounting member 328 fixedly secured to the first portion 216*e* and a stop member 330 secured to a distal end 332 of the mounting member 328. In operation, the rearward support member 264*e* abuts the stop member 330, thereby limiting rearward "recline" of the chair back.

Figure 16:
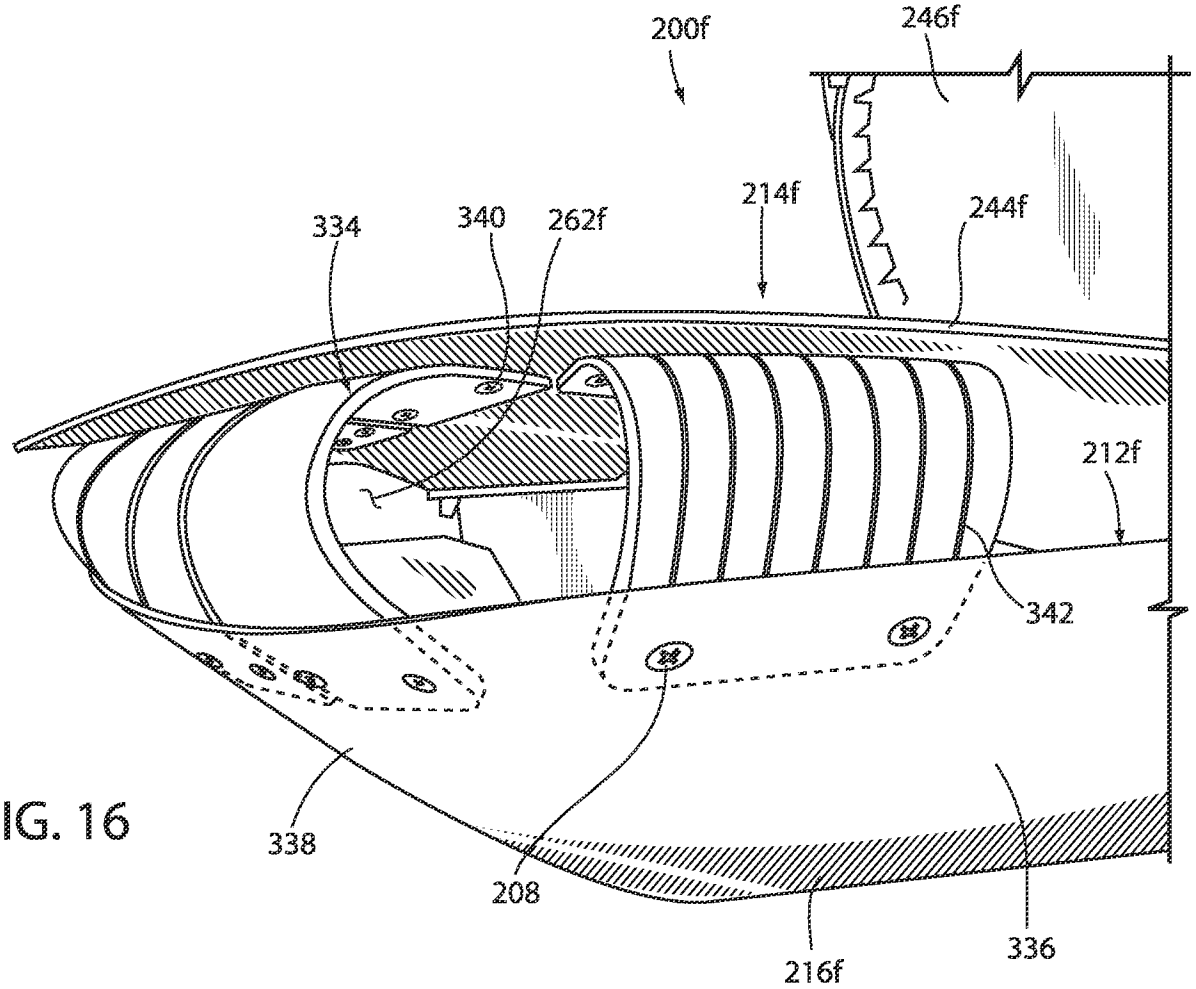
FIG. 16 is a perspective view of yet another embodiment of a seating arrangement including a plurality of edge members.
Figure 17:
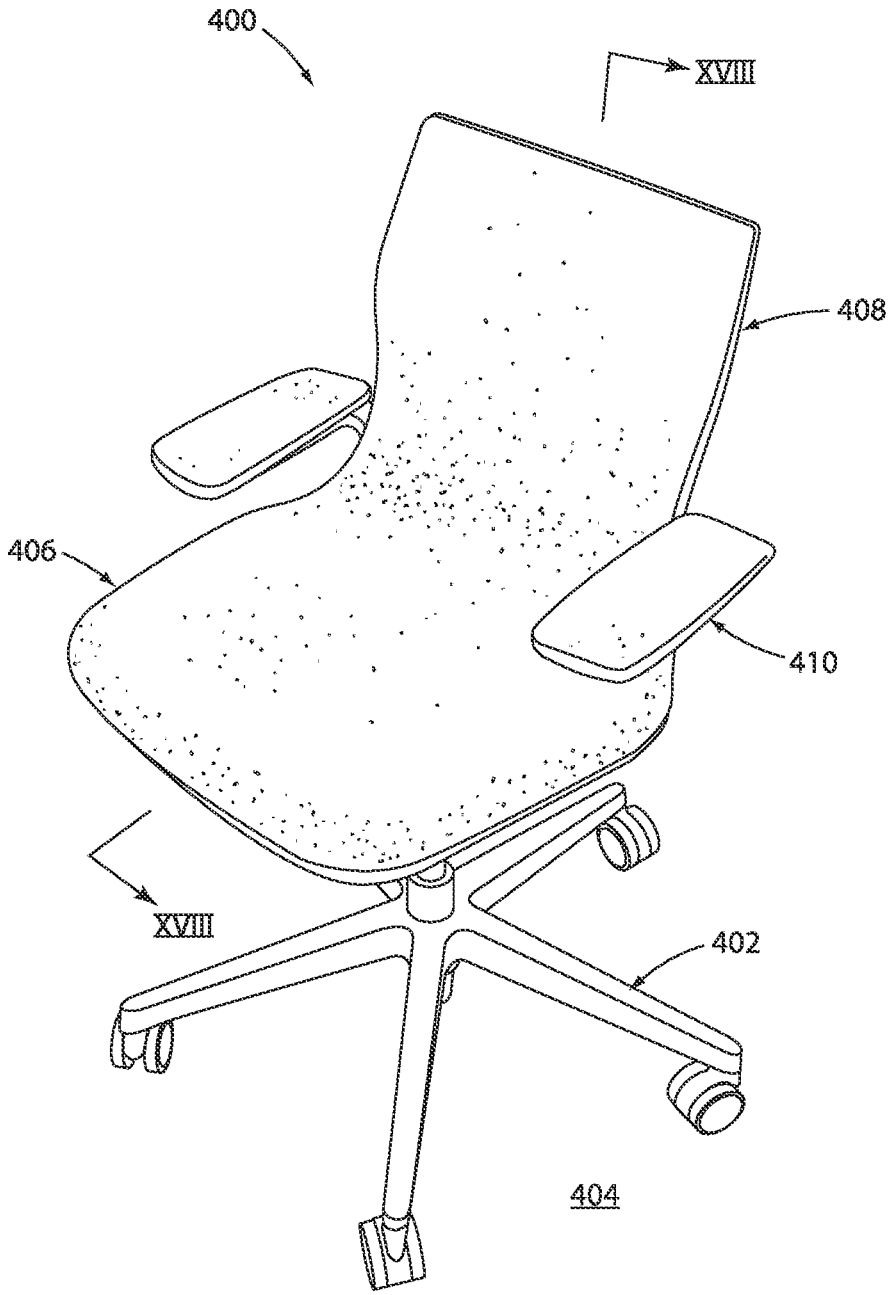
FIG. 17 is a perspective view of another embodiment of a seating arrangement.

In still another alternative embodiment, a chair assembly 200*f* (FIG. 16) includes a plurality of flexibly resilient edge members 334. Since the chair assembly 200*f* is similar to the previously described chair assembly 200, similar parts appearing in FIGS. 9-11 and FIG. 16, respectively are represented by the same, corresponding reference numeral, except for the suffix "f" in the numerals of the latter. In the illustrated example, the bottom or first portion 216*f* of the second shell member 212*f* provides a trough-like shape and includes sidewalls 336 and a front wall 338. The plurality of edge members 334 extend between the sidewalls 336 and/or the front wall 338 and the first portion 244*f* of the first shell member 214*f*. Each edge member 334 comprises a flexibly resilient polymer material and is positioned so as to contact an inside surface of the sidewalls 336 and/or the front wall 338 and the bottom surface of the second portion 244*f* of the second shell member 214*f*, and are secured thereto by a plurality of mechanical fasteners such as screws 340. In some embodiments, edge members 334 may be formed integrally with second shell member 212*f* and/or first shell member 214*f*. The edge members 334 may or may not be provided with a plurality of longitudinally-extending slots 342, which may alter the performance of the members. For example, increasing the number and/or size of the slots 342 may increase the flexibility of the members 334. The edge members 334 may additionally provide a surface between the second shell member 212*f* and the first shell member 214*f* to support an associated cover member (not shown), as well as to prevent access to the gap 262*f* between the second shell member 212*f* and the first shell member 214*f*.

The reference numeral 400 (FIG. 17) generally designates another embodiment of a seating arrangement. In the illustrated example, the seating arrangement 400 includes a castered base assembly 402 abutting a floor surface 404, a seat assembly 406 and a back assembly 408 supported above the base assembly 402, and a pair of arm assemblies 410.

The chair assembly 10 includes a rear or second shell member 422 (FIGS. 18 and 19) and a front or first shell member 424. The shell members 422, 424 may be formed as a single integral piece or comprise multiple, individual components. In the illustrated example, the shell members 422, 424 each comprise one or more flexibly resilient polymer materials such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 422, 424 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

The rear shell member 422 includes a horizontally-extending bottom or first portion 426, a vertically-extending upper or second portion 428 extending upwardly from the first portion 426, and a transition portion 429 extending between the first portion 426 and the second portion 428. In the illustrated example, the first portion 426 is supported by a support plate 430 that abuts a bottom surface 432 of the first portion 426, and which is in turn supported by a column 434 of the pedestal assembly 402. The second portion 428 of the rear shell member 422 includes a lower portion 436, an upper portion 438 and a mid-portion 440 located therebetween. The upper portion 438 of the rear shell member 422 is separated from the mid-portion 440 by a gap 442, thereby allowing the upper portion 438 to move independently from the mid-portion 440, as described below.

The front shell member 424 includes a first portion or seat shell member 444 and a second portion or back support member 446. The seat shell member 444 includes a forward portion 448, a rearward portion 450, an upper surface 452 configured to support a seated user, and a lower surface 454 opposite the upper surface 452. The back support member 446 includes a lower portion 456, an upper portion 458 and a mid-portion 460 located therebetween. The mid-portion 440 of the rear shell member 422 and the mid-portion 460 of the back support member 446 are coupled together by a laterally-extending rib 462 that extends forwardly from a forward surface 464 of the rear shell member 422 and rearwardly from a rearward surface 466 of the back support member 446. The rearward portion 450 of the seat shell member 444 is coupled to the second portion 428 of the rear shell member 422 by a link member 468. In the illustrated example, the link member 468 is integrally formed with both the rear shell member 422 and the seat shell member 444, however, each of these components may be formed as individual, single pieces. A lower end of the lower portion 456 of the back support member 446 extends through an aperture or slot 470 formed within the link member 468 and couples to an underside 472 of the link member 468 after passing through the aperture 470.

The seating arrangement 400 further includes a pair of laterally-extending, flexibly resilient support members including a forward support member 474 and a rearward support member 476 each extending between the seat shell member 444 and the second portion of the rear shell member 422. In the illustrated example, the support members 474, 476 are integrally formed with the seat shell member 444 and the rear shell member 422, and extend from the lower surface 454 of the seat shell member 444 to an upper surface 478 of the first portion 426 of the rear shell member 422, however each of these components may comprise individual pieces. The first portion 426 of the rear shell member 422, the seat shell member 444 and the pair of support members 474, 476 cooperate to define a deformable four-bar linkage allowing movement of the seating arrangement 400 as described below. In the illustrated example, the front support member 474 is slightly longer than the rear support member 476, the relevance of which is also described below.

In operation, a user can move or recline the second portion 428 of the rear shell member 422 from an upright position A to a reclined position B by flexing the rear shell member 422 and the front shell member 424. Movement of the second portion 428 of the rear shell member 422 from the upright position A to the reclined position B causes the seat shell member 444 to move from a first position C to a rearward and reclined position D. Specifically, the link member 468 draws the seat shell member 444 rearwardly with the second portion 428 of the rear shell member 422 as the second portion 428 of the rear shell member 422 is moved from the upright position A to the reclined position B. As noted above, the front support member 474 is slightly longer than the rear support member 476, thereby causing the forward portion 448 of the seat shell member 444 to vertically raise at a rate slightly faster than the rearward portion 450 of the seat shell member 440 as the seat shell member 444 is moved from the first position C to the reclined position D. It is also noted that the upper portion 438 of the rear shell member 422 and the upper portion 458 of the back support member 446 tend to recline about a pivot point located forwardly of the gap 442 at a slightly greater rate than the rate of recline of the mid-portion 440 of the rear shell member 422 and the mid-portion 460 of the back support member 446 as the rear shell member 422 and the back support member 446 are moved between the upright position A and the reclined position B.

Figure 18:
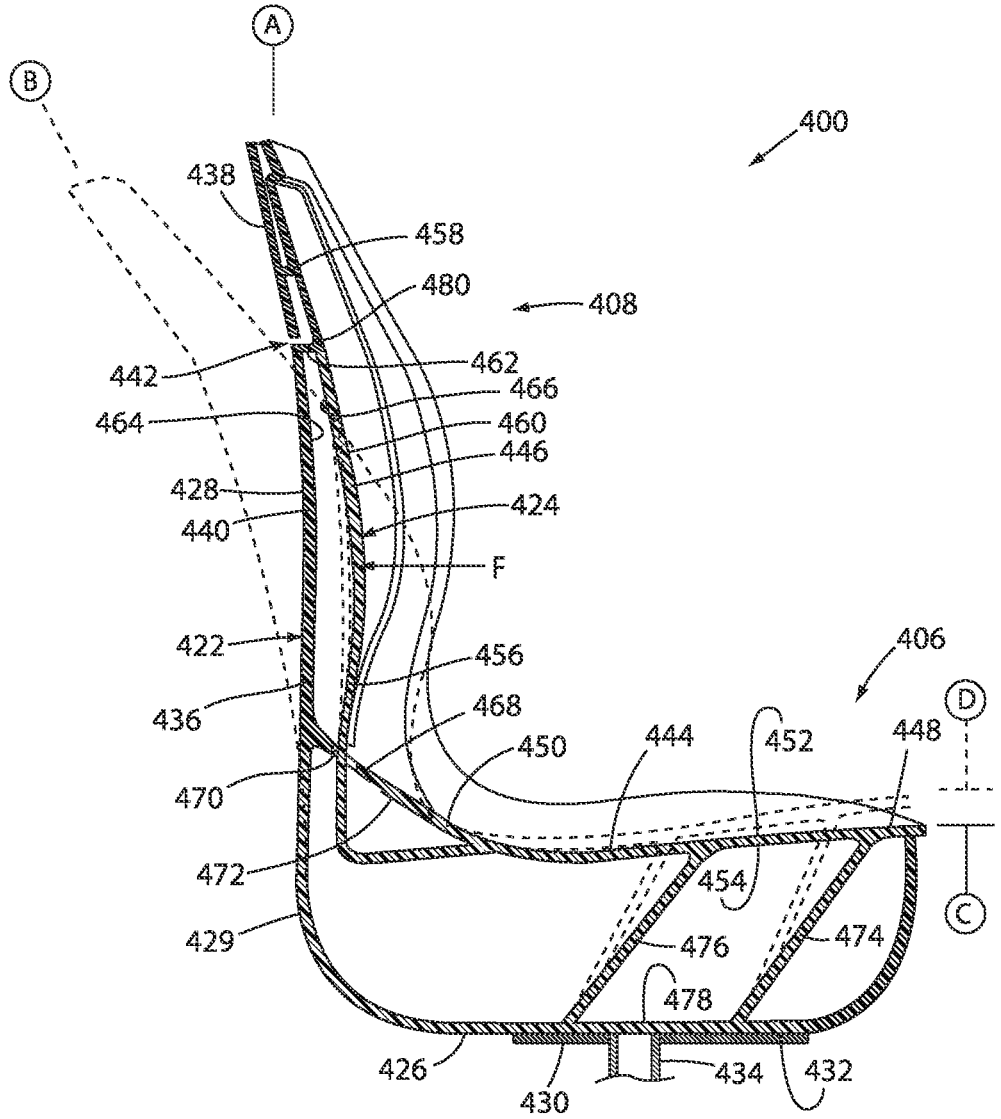
FIG. 18 is a cross-sectional view of the embodiment of the seating arrangement shown in FIG. 17 taken along the line XVIII-XVIII, FIG. 17.
Figure 19:
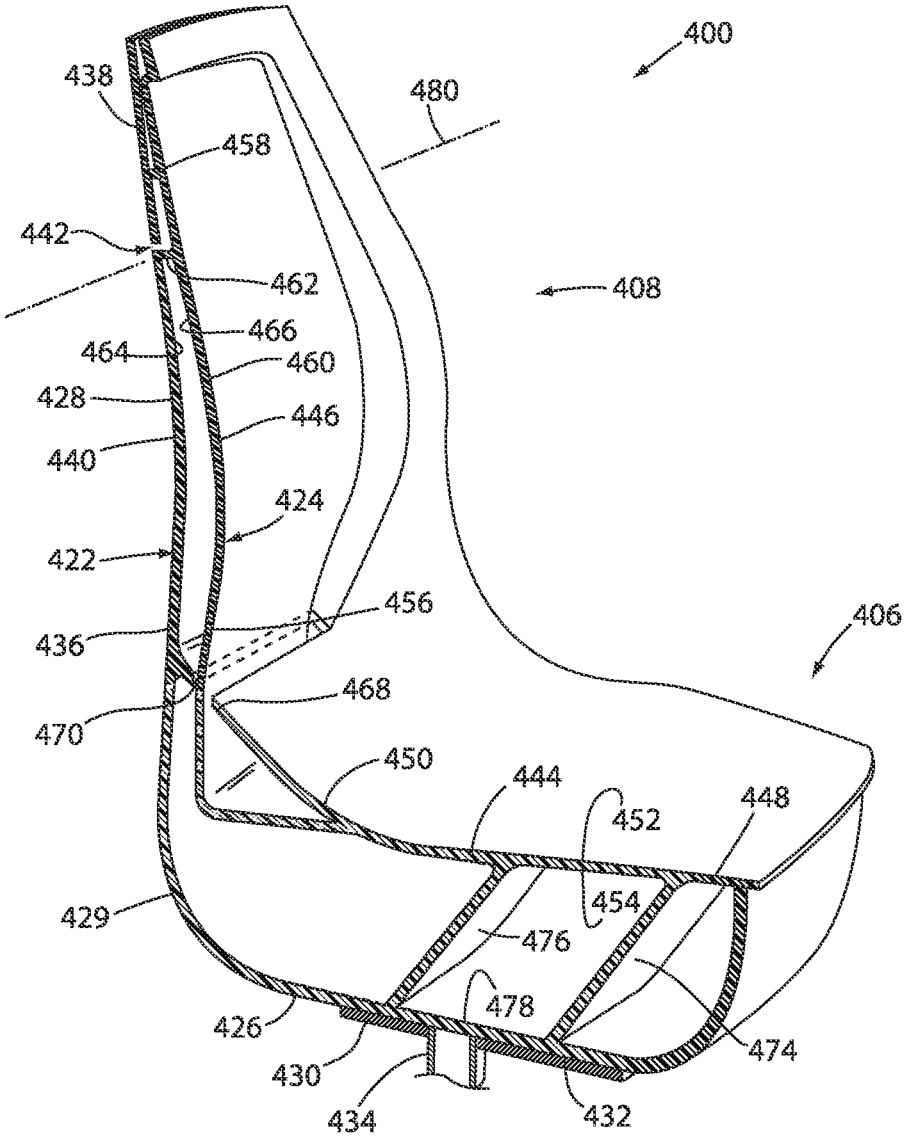
FIG. 19 is a cross-sectional perspective view of the embodiment of the chair assembly shown in FIG. 17 taken along the line XVIII-XVIII, FIG. 17.

As best illustrated in FIG. 18, the mid-portion 460 of the back support member 446 may be compressed or moved separately from movement of the seat shell member 444. As noted above, a lowermost end of the lower portion 456 of the back support member 446 extends through the aperture or slot 470 of the link member 468. This configuration effectively decouples certain movements of the back support member 446 from movements of the seat shell member 444. For example, a force F may be exerted to the mid-portion 460 of the back support member 446 thereby flexing the back support member 446 rearwardly. In this instance, the position of the seat shell member 444 remains relatively constant as the back support member 446 is allowed to move within the aperture or slot 470.

Figure 20:
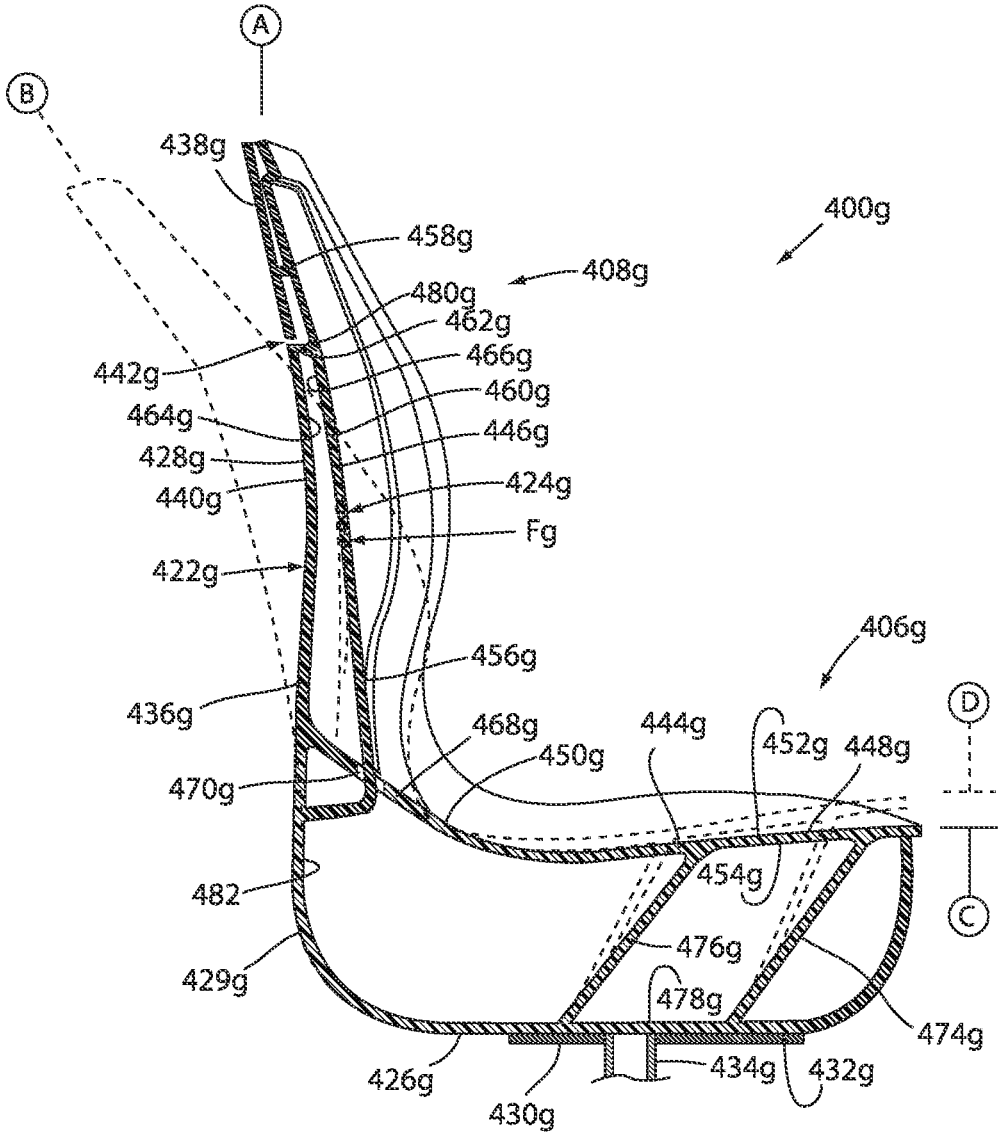
FIG. 20 is a cross-sectional side elevational view of yet another embodiment of the chair assembly.
Figure 21:
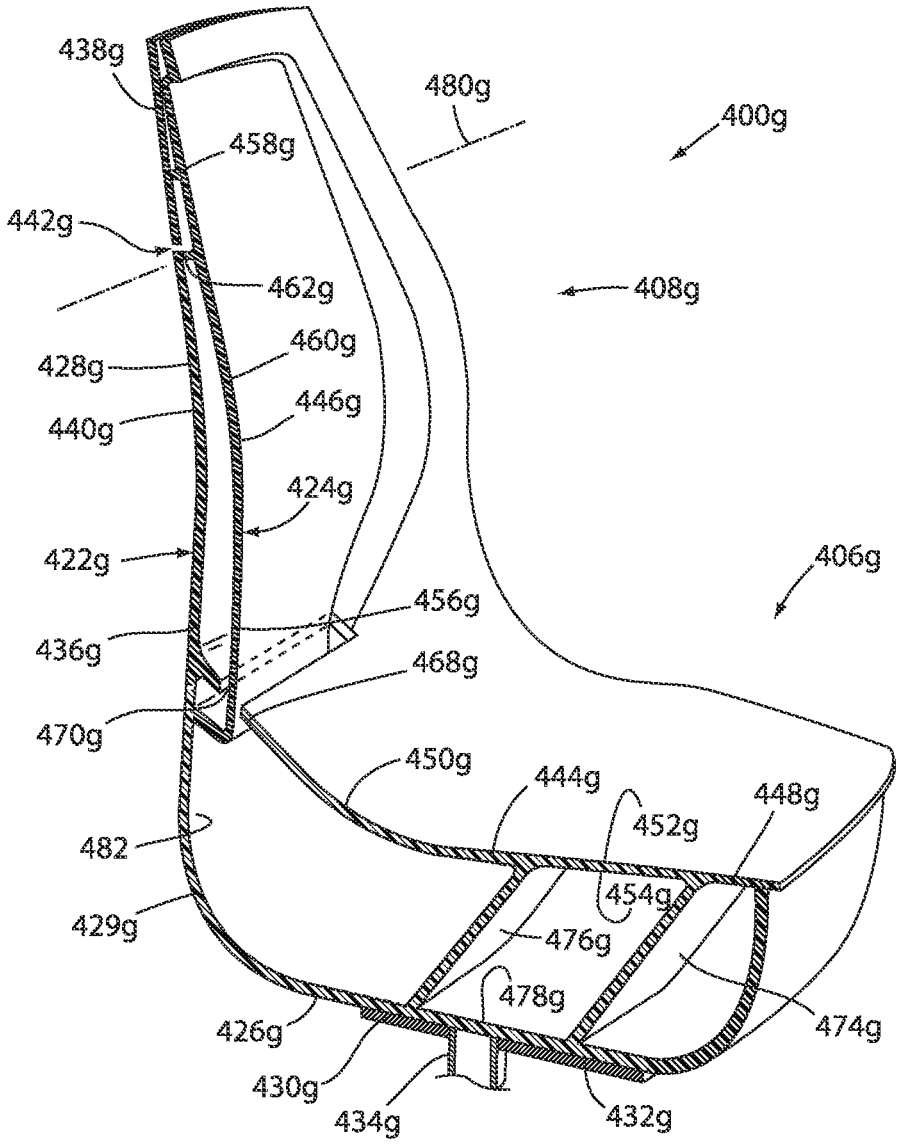
FIG. 21 is a cross-sectional perspective view of the embodiment of the chair assembly shown in FIG. 20.
Figure 22:
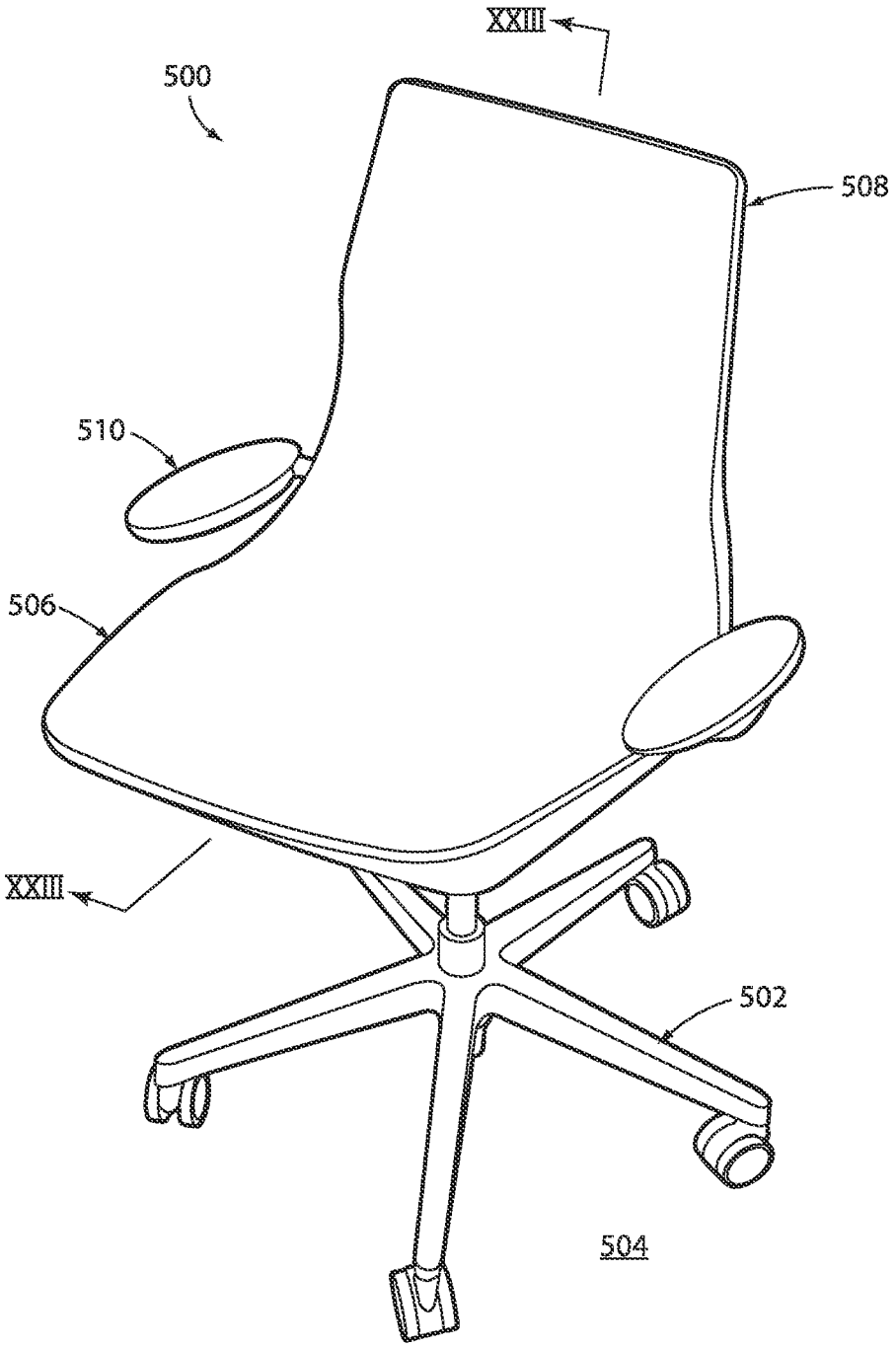
FIG. 22 is a perspective view of another embodiment of a seating arrangement.

In yet another embodiment, a seating arrangement 400*g* (FIGS. 20 and 21) includes a lowermost end of the lower portion 456*g* of the back support member 446*g* extending through the slot 470*g* of the link member 468*g* and attached to a forward surface 482 of the rear shell member 422*g*. Similar to the embodiment as described above, this arrangement effectively decouples movement or compression of the mid-portion 460*g* of the back support member 446*g* from movement of the seat shell member 444*g*, such that the back support member 446*g* can be compressed without moving the seat shell member 444*g*.

Figure 23:
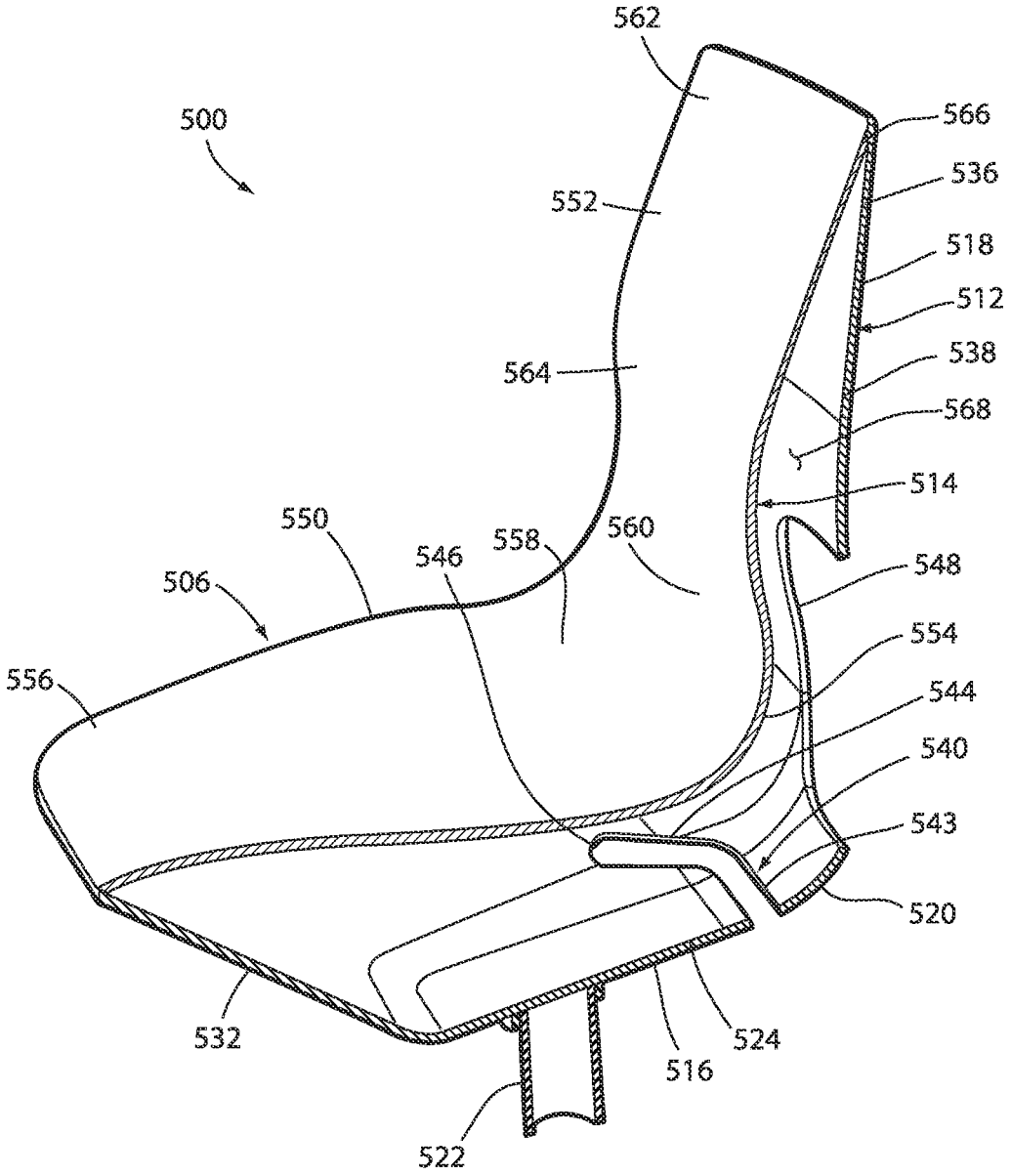
FIG. 23 is a cross-sectional front perspective view of the embodiment of the seating arrangement shown in FIG. 22 taken along the lines XXIII-XXIII, FIG. 22.
Figure 24:
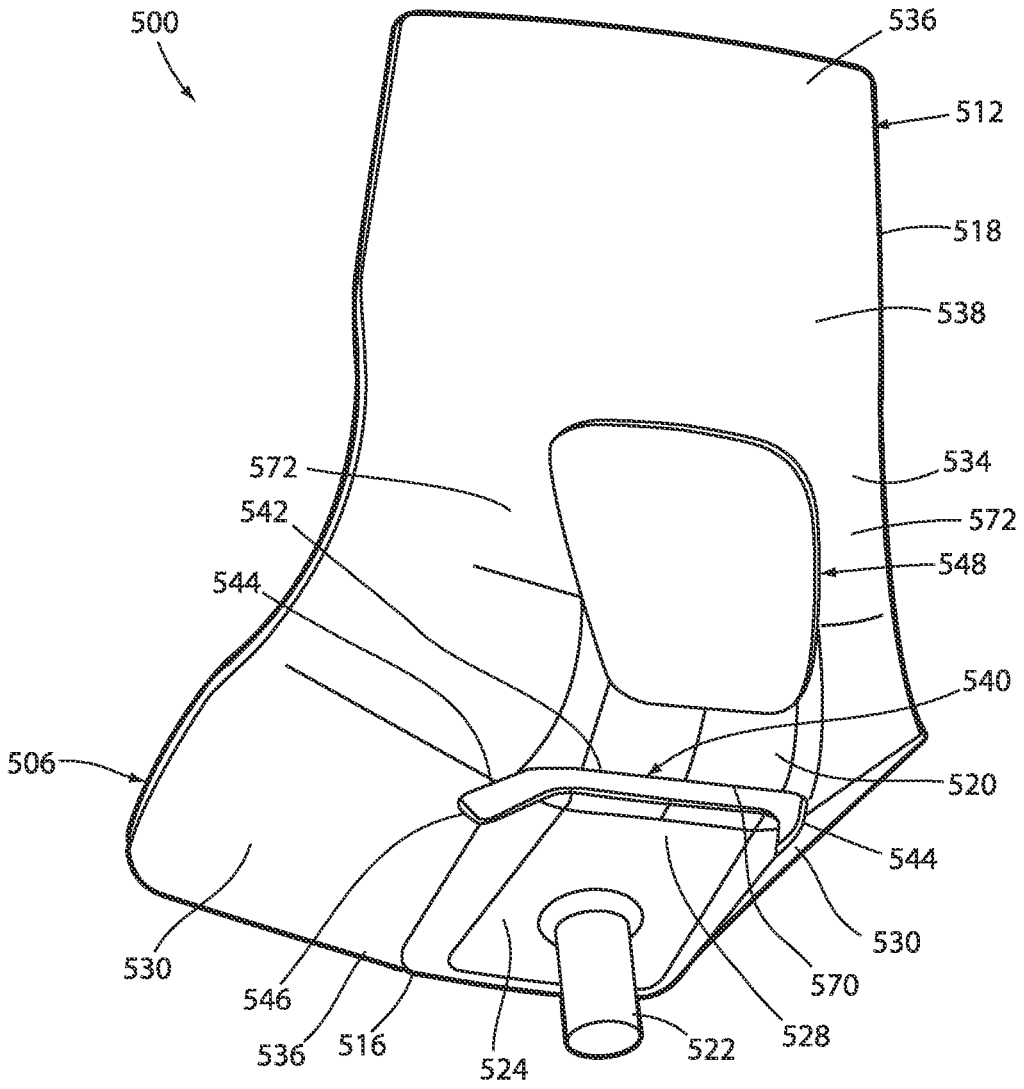
FIG. 24 is a rear perspective view of the embodiment of the seating arrangement shown in FIG. 22.

The reference numeral 500 (FIG. 22) generally designates another embodiment of a seating arrangement. In the illustrated example, the seating arrangement or chair assembly 500 includes a castered base assembly 502 abutting a floor surface 504, a seat arrangement 506 and a back arrangement 508 each supported above the base assembly 502, and a pair of arm assemblies 510. In the illustrated example, the chair assembly 500 (FIG. 23) includes a rear or second shell member 512 and a front or first shell member 514. The shell members 512, 514 may be formed as a single, integral piece or comprise multiple, individual components. The shell members 512, 514 each comprise one or more flexibly resilient polymer materials such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 512, 514 to conform and move in response to forces exerted by a user. Although a polymer material may be preferred, other suitable materials may also be utilized, such as metals, including, for example, steel ortitanium; plywood; or a composite material including plastics, resin-based composites, metals and/or plywood. A variety of other suitable energy-storing materials may also be utilized.

The second shell member 512 includes a horizontally-extending bottom or first portion 516, a vertically-extending upper or second portion 518 extending upwardly from the first portion 516, and an arcuately-shaped transition portion 520 extending between the first portion 516 and the second portion 518. In the illustrated example, the first portion 516 is supported by a column 522 of the pedestal assembly 502.

The first portion 516 of the second shell member 512 includes a bottom wall 524 having a forward portion 526 and a rearward portion 528, a pair of sidewalls 530 extending angularly upward and laterally from the bottom wall 524, and a front wall 532 extending angularly upward and forwardly from the bottom wall 524. The upper or second portion 518 of the second shell member 512 includes a lower portion 534, an upper portion 536 and a mid-portion 538 located therebetween.

The rear or second shell member 512 further includes a U-shaped aperture 540 that includes a laterally-extending base portion 542 and a pair of forwardly-extending arm portions 544. In the illustrated example, the base portion 542 of the aperture 540 is positioned proximate the rearward portion 528 of the bottom wall 524 of the first portion 516 and proximate the transition portion 540, while the arm portions 544 extend forwardly from the base portion 542 and are located proximate the bottom wall 524 and proximate the sidewalls 530. The arm portions 544 angle or flair outwardly from one another from the base portion 542 to a distal end 546 of each of the arm portions 544. The second shell member 512 further includes an aperture 548 that extends from the transition portion 520 into the lower portion 534 of the second portion 518.

The front shell member 514 includes a horizontally-extending bottom or first portion 550, a vertically-extending upper or second portion 552 extending upwardly from the first portion 550, and an arcuately-shaped transition portion 554 extending between the first portion 550 and the second portion 552. The first portion 550 includes a forward portion 556 and a rearward portion 558, while the second portion 552 includes a lower portion 560, an upper portion 562, and an arcuately-shaped, forwardly convex mid-portion 564 located therebetween and configured to support the lower area of a user's back. The upper portion 562 of the second portion 552 of the first shell member 514 is connected to the upper portion 536 of the second portion 518 of the second shell member 512 at a location 566, such as by sonic welding, an adhesive, integral molding, mechanical fasteners, and the like. The second shell member 512 and the first shell member 514 are configured so as to define a gap 568 between at least a portion of the upper portion 562 and the upper portion 536, between the mid-portion 564 and the mid-portion 538, between the lower portion 560 and the lower portion 534, between the transition portion 554 and the transition portion 520, and between the second portion 552 and the second portion 518.

Figure 25:
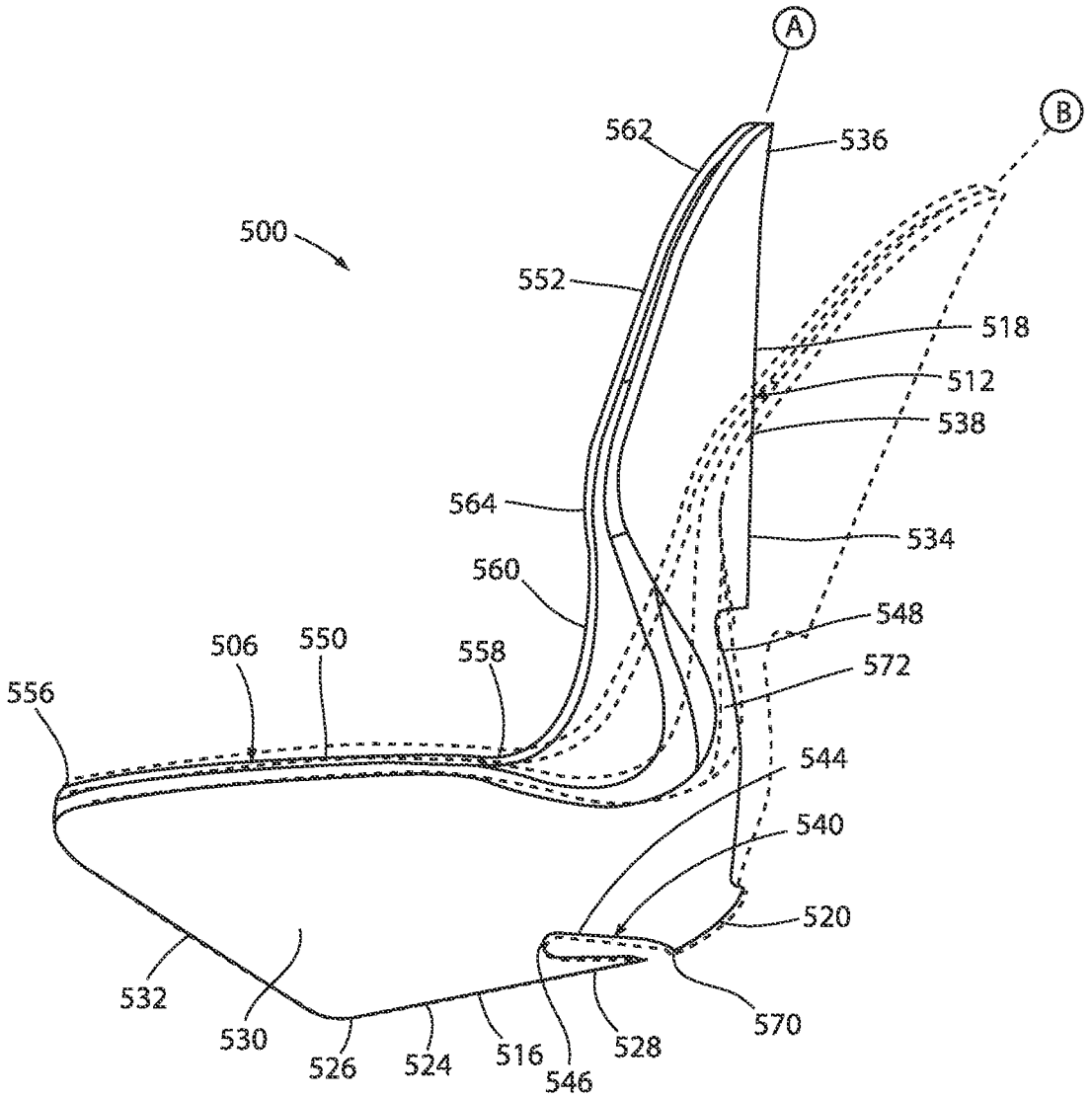
FIG. 25 is a side elevation view of the embodiment of the seating arrangement shown in FIG. 22 with a back arrangement in an upright position in solid line and in a reclined position in dashed line.

In operation, the second portion 518 (FIG. 25) of the second shell member 512 and the second portion 552 of the first shell member 214 are movable or reclinable from an upright position A to a reclined position B. The configuration of the U-shaped aperture 540 allows the first shell member 212 to deflect as the second shell member 212 is moved from the upright position A to the reclined position B. In the illustrated example, a portion 570 of the second shell member 512 located immediately rearwardly of the aperture adjacent to the base portion 542 of the aperture 540 travels downwardly as the second portion 518 of the second shell member 512 moves from the upright position A to the reclined position B. It is further noted that the location and configuration of the aperture 548 within the transition portion 520 and the second portion 518 of the second shell member 512 allows portions of the second shell member 512 located laterally outward of the aperture 548 to more easily flex as the second portion 218 of the second shell member 512 is moved from the upright position A to the reclined position B.

Figure 26:
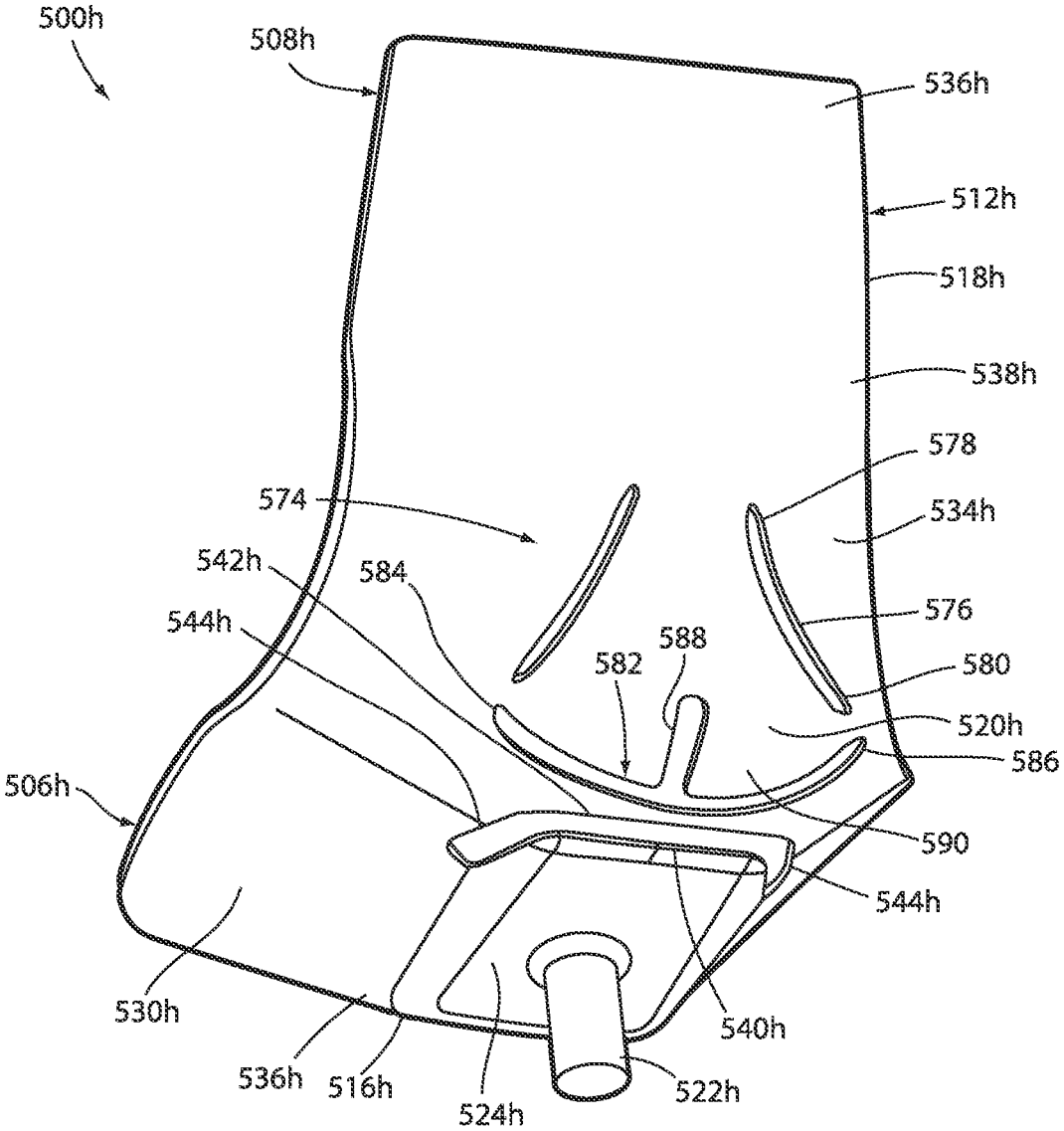
FIG. 26 is a rear perspective view of another embodiment of the seating arrangement.

The reference numeral **500*h* (FIG. 26) generally designates another embodiment of a seating arrangement. Since the chair assembly 500*h* is similar to the previously described chair assembly 500, similar parts appearing in FIGS. 22-25 and FIG. 26 respectively are represented by the same, corresponding reference numeral, except for the suffix "h" in the numerals of the latter. In the illustrated example, the chair assembly 500*h* is similar to the chair assembly 500 with the most notable exception being the replacement of the aperture 548 of the chair assembly 500 with a plurality of apertures 574. The plurality of apertures 574 includes a pair of arcuately-shaped apertures 576 that extend both vertically and laterally from a first end 578 located within the lower portion 534*h* of the second portion 518*h* of the second shell member 512*h*, and a second end 580 located within the transition portion 520*h* of the second shell member 512*h*. As illustrated, the apertures 574 sweep downwardly and outwardly from the first ends 578 to the second ends 580. An upwardly-concave, arcuately-shaped second aperture 582 extends laterally across the transition portion 520*h* and includes a first end 584 and a second end 586 respectively located proximate the second ends 580 of the corresponding apertures 576. The second aperture 582 also includes a center portion 588 extending vertically upward from the arcuate portion of the second aperture 582 and along a centroidal axis of the first shell member 212*h*. The plurality of apertures 574 cooperate to define a pair of downwardly-extending tabs 590. The plurality of apertures 574 serve to increase the flexibility of the lower portion 534*h* of the second portion 518*h* of the second shell member 514*h* and the transition portion 520*h* as the second shell member 512*h* is moved between an upright and reclined position, similar to the upright position A and the reclined position B illustrated in FIG. 25**.

Figure 27:
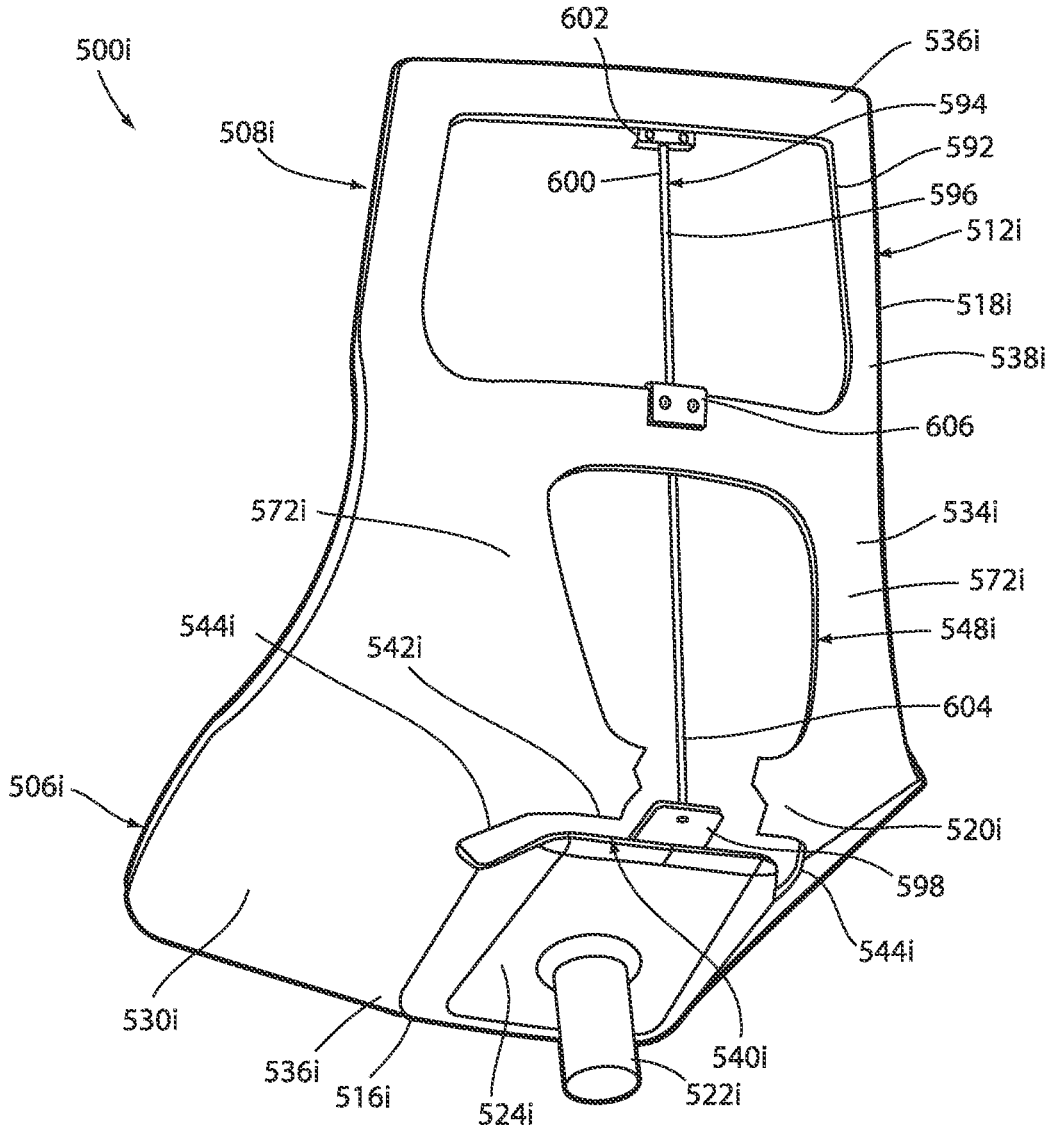
FIG. 27 is a rear perspective view of yet another embodiment of the seating arrangement.

The reference numeral **500*i* (FIG. 27) generally designates another embodiment of a seating arrangement 500. Since the chair assembly 500*i* is similar to the previously described chair assembly 500, similar parts appearing in FIGS. 22-24 and FIG. 27 respectively are represented by the same, corresponding reference numeral, except for the suffix "i" in the numerals of the latter. The chair assembly 500***i* is similar to the chair assembly 500 with the most notable exception being the inclusion of an upper aperture 592 and a structural reinforcement and biasing assembly 594. In the illustrated example, the upper aperture 592 extends across and comprises the majority of the upper portion 536*i* of the second portion 518*i* of the second shell member 512*i* and extends downwardly into the mid-portion 538*i* of the second portion 518*i* of the second shell member 512*i*. The structural reinforcement and biasing assembly 592 includes a flexibly resilient rod 596 extending vertically between the upper portion 536*i* and a mounting plate 598. In the illustrated example, an upper end 600 of the rod 596 is attached to the upper portion 536*i* of the second portion 518*i* of the second shell member 512*i* by a mechanical fastener 602, while a second end 604 of the rod 596 is attached to the mounting plate 598 positioned either above or below the bottom wall 524*i* of the first portion 516*i* of the second shell member 512*i*. The rod 596 may also be attached along the length thereof to the mid-portion 538*i* of the second portion 518*i* of the second shell member 512*i* by a mechanical fastener 606. In operation, the rod 596 serves to structurally reinforce the second portion 518*i* of the second shell member 512*i* as well as to bias the second portion 518*i* of the second shell member 512*i* from a reclined position to an upright position, similar to the reclined position B and upright position A illustrated in FIG. 25.

Figure 28:
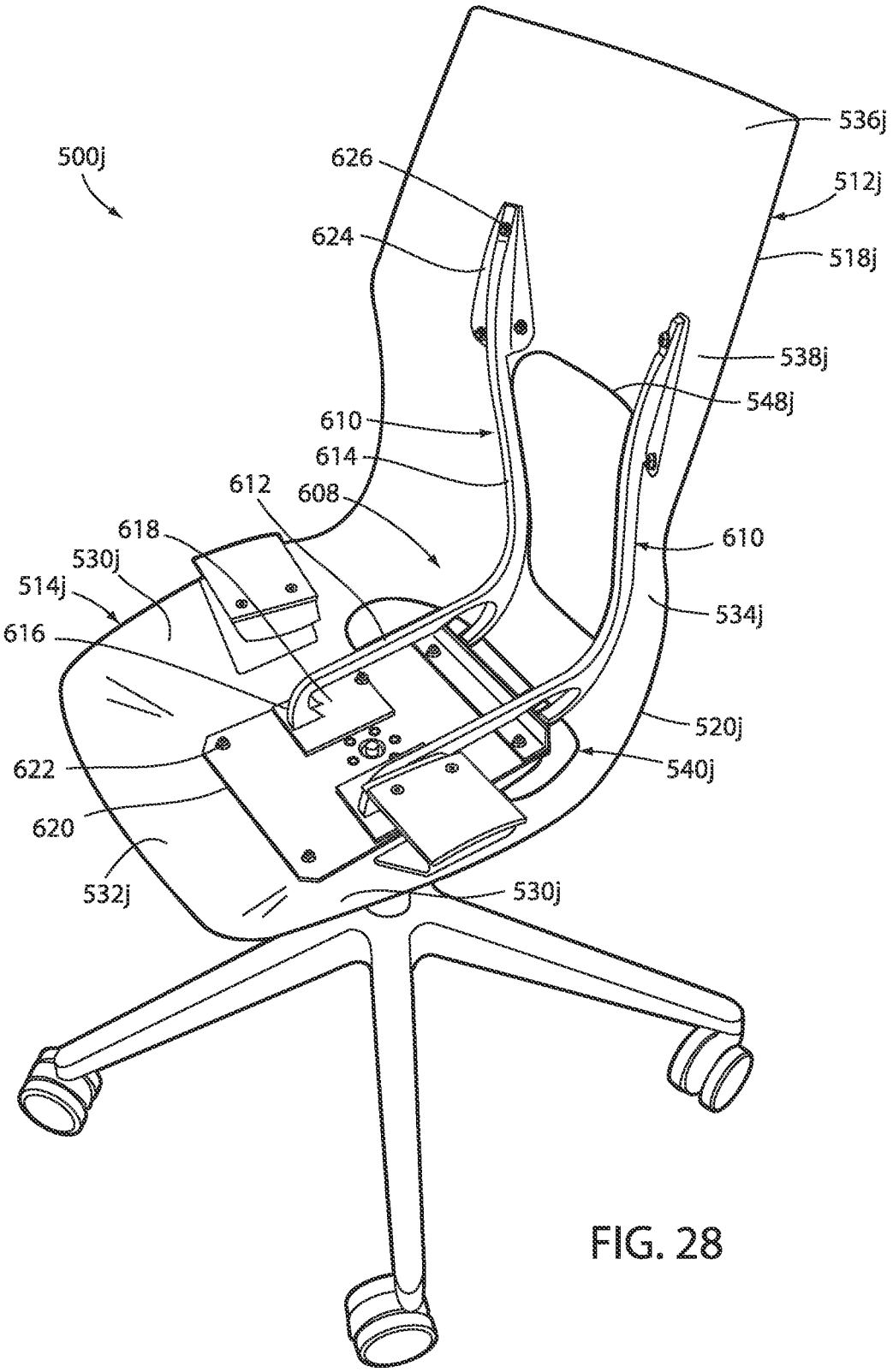
FIG. 28 is a front perspective view of still another embodiment of the seating arrangement.

The reference numeral 500*j* (FIG. 28) generally designates yet another embodiment of a seating arrangement 500. Since the chair assembly 500*j* is similar to the previously described chair assembly 500, similar parts appearing in FIGS. 22-24 and FIG. 28 respectively are represented by the same, corresponding reference numeral, except for the suffix "j" in the numerals of the latter. The chair assembly 500*j* is similar to the chair assembly 500 with the most notable exception being the inclusion of a structural reinforcement and biasing assembly 608. The structural reinforcement and biasing assembly 608 includes a pair of generally L-shaped, flexibly resilient biasing members 610 each having a generally horizontally-extending first portion 612 and generally vertically-extending second portion 614. Each first portion 612 includes a downwardly-turned distal end 616 welded to an attachment plate 618 that is secured to a support plate 620 that is in turn secured to the first portion 516*j* of the second shell member 512*j* by a plurality of mechanical fasteners such as bolts 622. A distal end 624 of the second portion 614 of each of the biasing members 610 is attached to the mid-portion 538*j* of the second portion 518*j* of the second shell member 512*j* by a plurality of mechanical fasteners such as bolts 626. In operation, the biasing members 610 serve to structurally reinforce the second portion 518*j* of the second shell member 512*j* as well as to bias the second portion 518*j* of the second shell member 512*j* from a reclined position to an upright position, similar to the reclined position B and the upright position A illustrated in FIG. 25.

Figure 29:
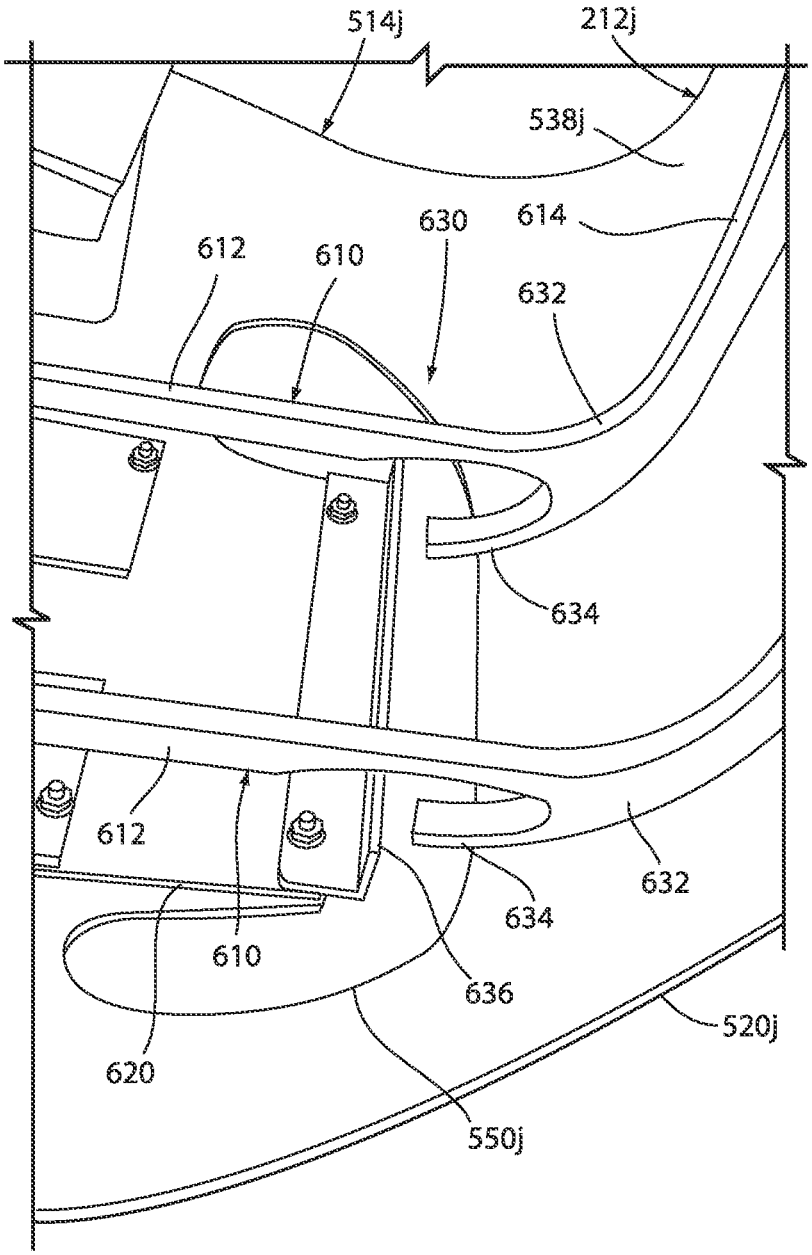
FIG. 29 is an enlarged perspective view of a recline limiting arrangement of the seating arrangement of FIG. 28.

The structural reinforcement and biasing assembly 608 further includes a tilt limiting arrangement 630 (FIG. 29) that limits the rearward recline range of the second portion 518*j* of the second shell member 512*j*. Each biasing member 610 further includes an arcuately-shaped transition portion 632 positioned between the first portion 612 and the second portion 614. Each transition portion 632 includes an arcuately-shaped, downwardly and forwardly extending abutment or stop member 634. In operation, the ends of the stop members 634 are spaced from a stop plate 636, attached to the support plate 620, when the second portion 518*j* of the second shell member 512*j* is in the upright position. During recline, the ends of the stop members 634 contact or abut the stop plate 636 thereby limiting the rearward recline of the second portion 518*j* of the second shell member 512*j*.

The reference numeral 700 (FIG. 30) generally designates another embodiment of a seating arrangement. In the illustrated example, the seating arrangement or chair assembly 700 includes a castered base assembly 702 abutting a floor surface 704, a seat assembly 706 and a back assembly 708 each supported above the base assembly 702, and a pair of arm assemblies 710. In the illustrated example, the chair assembly 700 (FIG. 31) includes a front or a first shell member 714 and a rear or second shell member 712. The shell members 712, 714 may be formed as a single, integral piece or comprise multiple, individual components. In the illustrated example, the first shell member 712 includes a single, integral piece, while the second shell member 714 includes a two-piece construction as described below. The shell members 712, 714 each comprise a flexibly resilient polymer material such as any thermal plastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 712, 714 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

Figure 31:
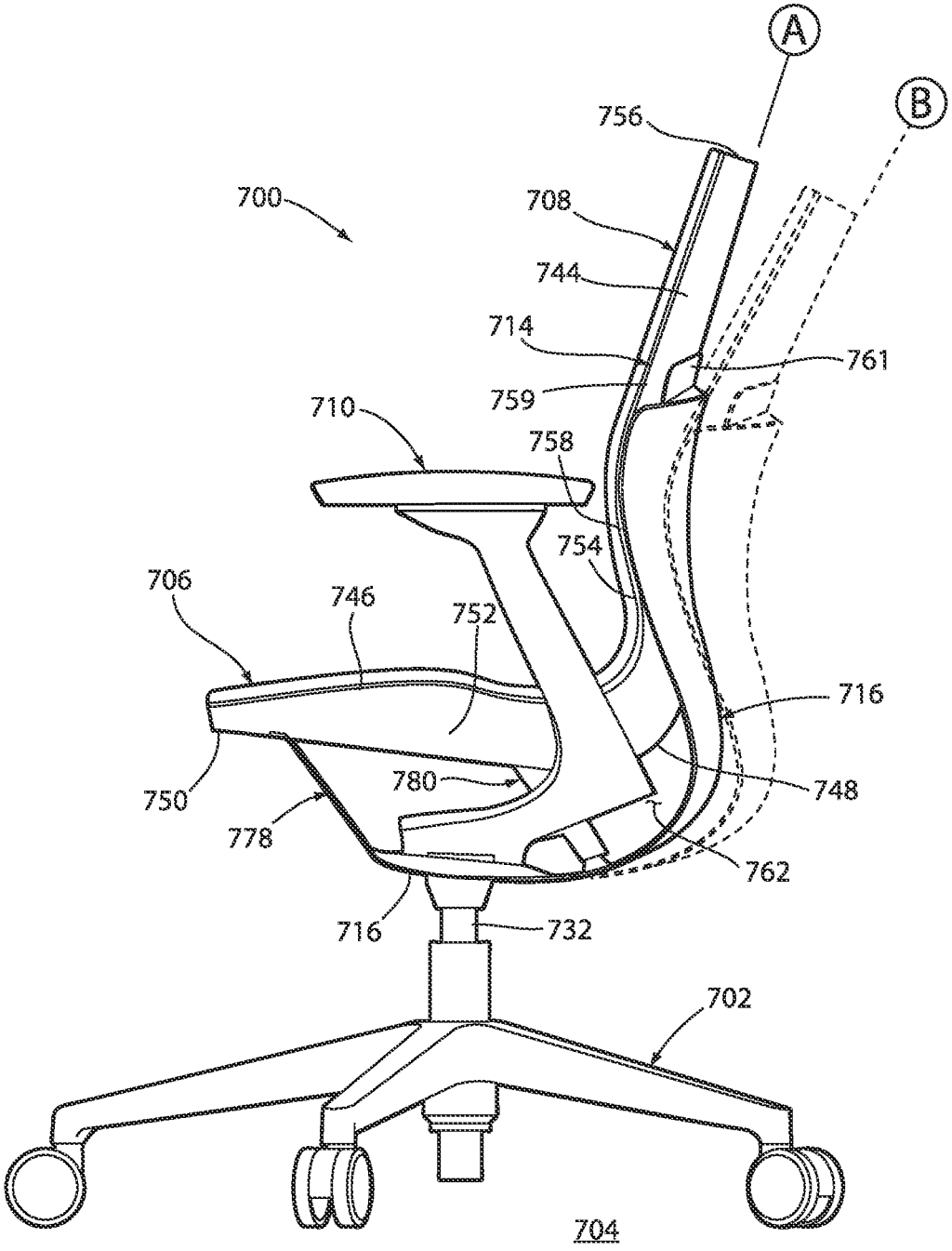
FIG. 31 is a side elevational view of the embodiment of the seating arrangement shown in FIG. 30 with a back assembly shown in an upright position in solid line and a reclined position in dashed line.
Figure 33:
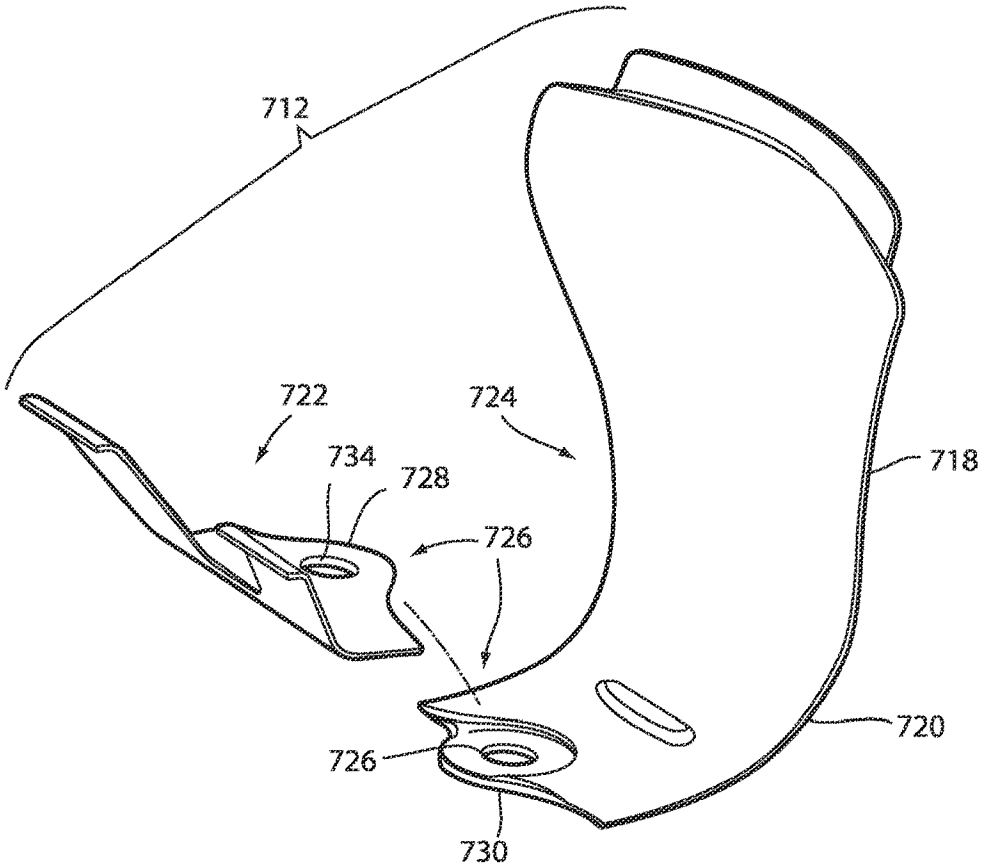
FIG. 33 is a perspective view of the back shell member.
Figure 32:
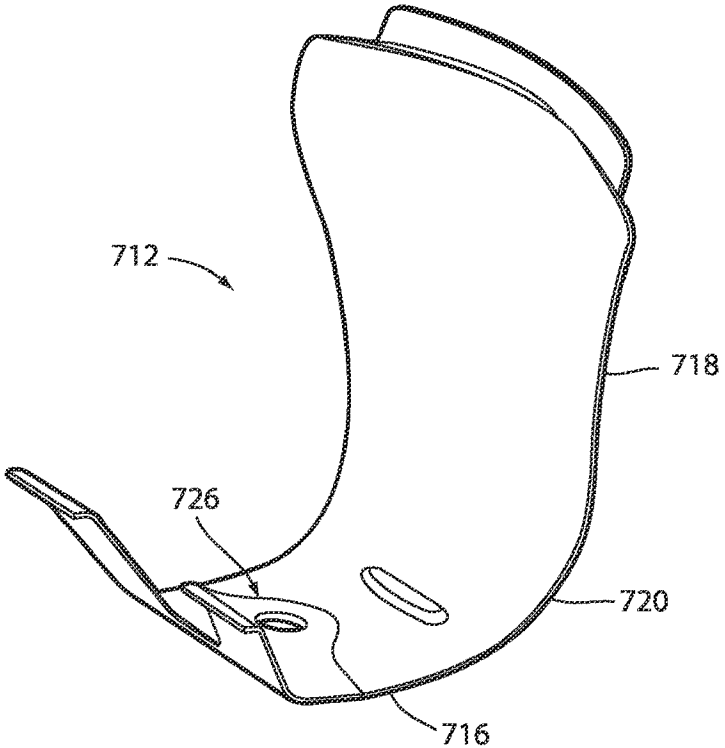
FIG. 32 is a perspective view of a back shell member.

The rear shell member 712 includes a horizontally-extending bottom or first portion 716, a vertically-extending upper or second portion 718 extending upwardly from the first portion 716, and an arcuately-shaped transition portion 720 extending between the first portion 716 and the second portion 718. In the illustrated example, the rear shell member 712 comprises a two-part construction having a first portion 722 and a second portion 724 each having one portion of a lap joint 726. Specifically, the lap joint 726 includes a first portion 728 integral with the first portion 722 of the rear shell member 712 and a second portion 730 integral with the second portion 724 of the rear shell member 712, where the first portion 722 and the second portion 724 each cantilever and overlap with one another to form the lap joint 726. In assembly, a column 732 (FIGS. 31 and 34) of the pedestal assembly 702 is received through an aperture 734 of the first portion 722 and an aperture 736 of the second portion, and the first portion 728 and the second portion 730 of the lap joint 726 are held in connection by a lower coupler 738 and an upper coupler 740 as described below. It is noted that while the embodiment illustrated in FIG. 32 shows a two-piece rear shell member 712, alternate embodiments may include more than two pieces, or an integral, single-piece construction.

Figure 35:
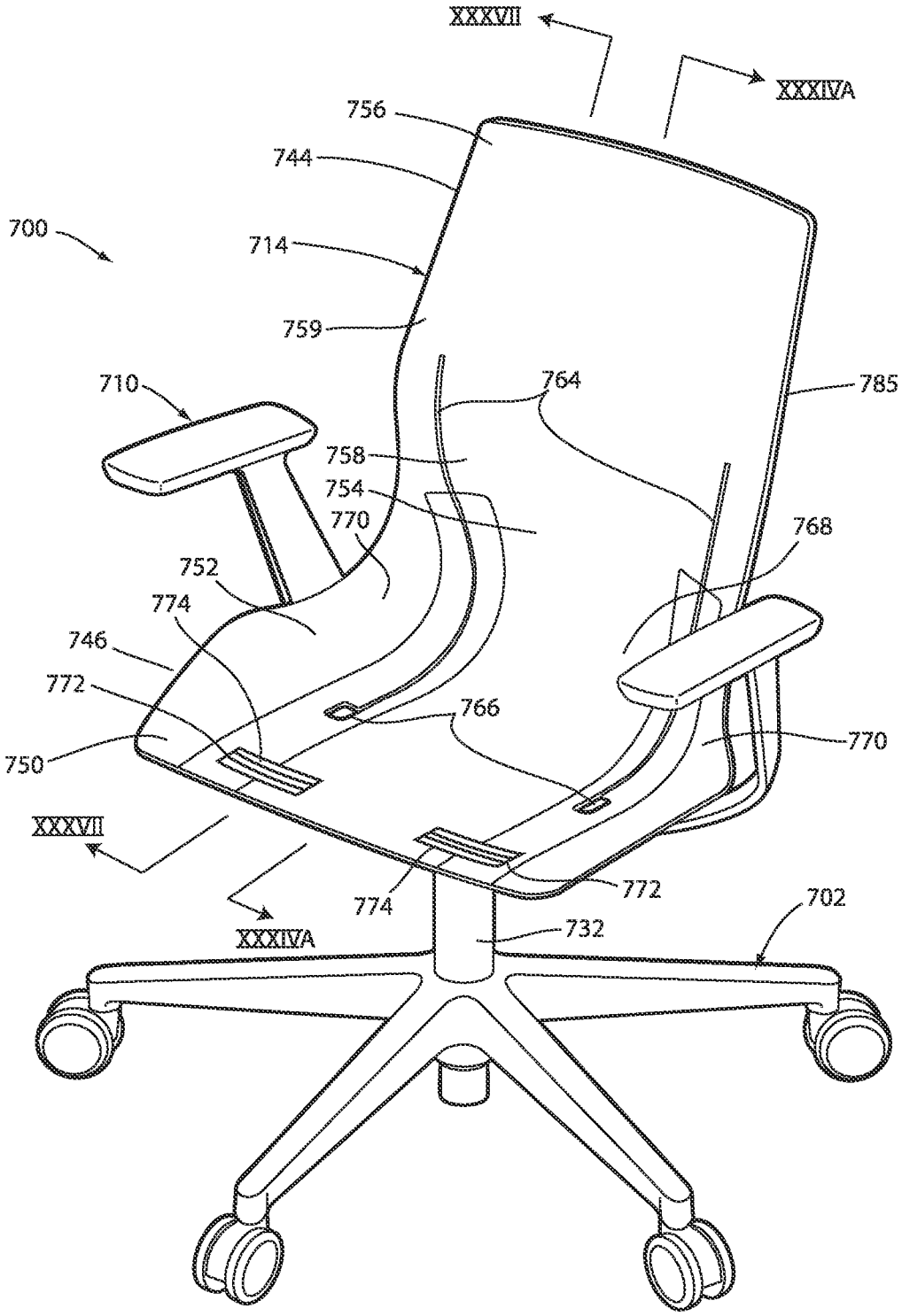
FIG. 35 is a perspective view of the embodiment of the chair shown in FIG. 30 with a fabric cover removed.

The front shell member 714 (FIGS. 31 and 35) includes a horizontally-extending bottom or first portion 744, a vertically-extending upper or second portion 746 extending upwardly from the first portion 744, and an arcuately-shaped transition portion 748 extending between the first portion 744 and the second portion 746. The first portion 744 includes a forward portion 750 and a rearward portion 752, while the second portion 746 includes a lower portion 754, an upper portion 756 and an arcuately-shaped, forwardly convex mid-portion 758 located therebetween and configured to support the lumbar region of a user's back. An intermediate portion 759 of the second portion 746 of the front shell member 714 located between the upper portion 756 and the mid-portion 758 is connected to an upper portion 761 of the second portion 718 of the rear shell member 712, such as by sonic welding, an adhesive, integral molding, mechanical fasteners, and the like. The rear shell member 712 and the front shell member 714 are configured so as to define a gap 762 therebetween.

The front shell member 714 further includes a pair of laterally-spaced slots 764 extending in a fore-to-aft direction from a mid-portion of the second portion 746 to the intermediate portion 759 of the second portion 746, with the fore end of each slot 764 ending in an aperture 766, thereby dividing the front shell member 714 into an inner portion 768 and outer portion 770. The division of the inner portion 768 from the outer portions 770 allows the inner portion 768 to flex separately from the outer portions 770 during recline of the back assembly 708 from an upright position A to a recline position B. As best illustrated in the FIGS. 36Aa and 36B, the flexing of the front shell member 714 during recline is such that the inner portion 768 flexes less than the outer portion 770 such that the outer portion 770 descends relative to the inner portion 768, thereby allowing additional flexibility in the front shell member 714 while providing adequate support for the seated user via the inner portion 768. The differentiation of flexure of the inner portion 768 and the outer portions 770 causes the second portion 746 of the front shell member 714 to move from the reclined position toward the upright position and exert an increased pressure to the back of a seated user as the force exerted on the inner portion 768 is increased, such as the force exerted by the weight of a seated user.

Figure 37:
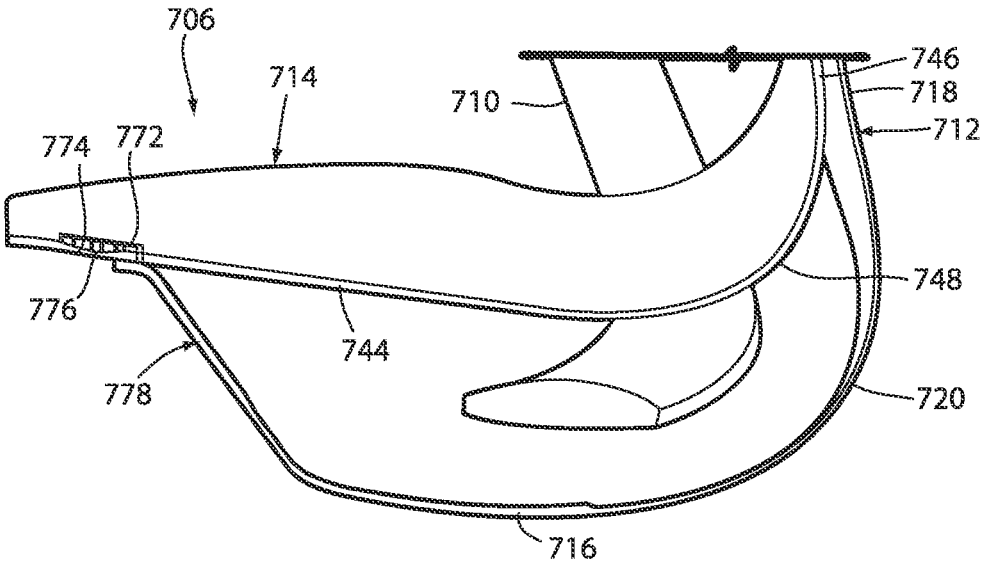
FIG. 37 is a cross-sectional side elevational view of the embodiment of the chair shown in FIG. 30, taken along the line XXXVIII-XXXVIII, FIG. 35.

The front shell member 714 (FIGS. 35 and 37) further includes a pair of C-shaped reliefs or apertures 772 each defining a tab 774. Each tab 744 has a laterally-extending flexing region 776 of relative reduce thickness thereby promoting flexure of each tab 744 in this region as described below.

The chair assembly 700 (FIGS. 30 and 31) further includes a pair of laterally-extending support members or linkage members, including a forward support or linkage member 778 and a rearward support or linkage member 780, each extending between the second portion 746 of the forward shell member 714 and the second portion 716 of the rear shell member 712. In the illustrated example, the forward support member 778 is flexibly resilient along the length thereof, while the rearward support member 780 is relatively rigid. The forward support member 778 is integrally formed within the back shell member 716 and rigidly attached to the front shell member 714, while the rearward support member 780 is rigidly attached to the rear shell member 716, however, the forward support member 778 and the rearward support member 780 may be formed as separate pieces, or as integral portions of the rear shell member 712 and/or the front shell member 714. Further, in the illustrated example, the inner portion 768 cooperates with the forward support member 778 and the rearward support member 780 to form a control mechanism that synchronizes the rearward movement of the first portion 744 of the front shell member 714 with reclining movement of the second portion 746 of the front shell member 714 as further described below.

Figure 36A:
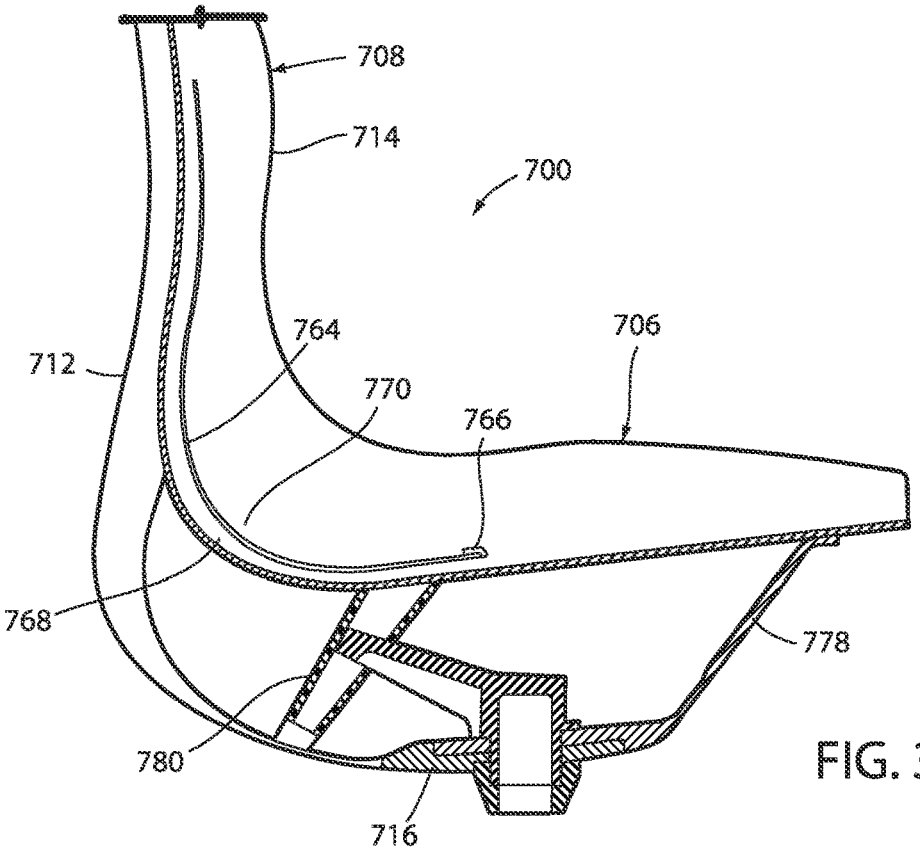
FIG. 36A is a cross-sectional side elevational view of the embodiment of the chair shown in FIG. 30, taken along the line XXXVIA-XXXVIA, FIG. 35, with the back assembly shown in the upright position.
Figure 36B:
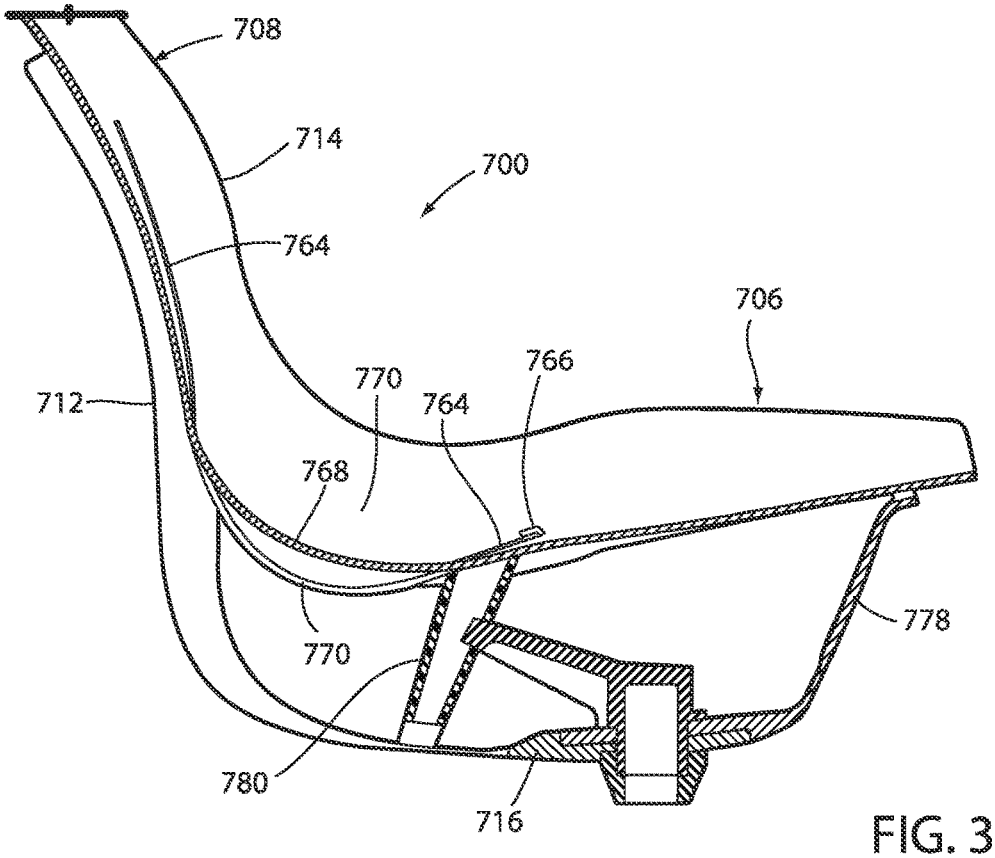
FIG. 36B is a cross-sectional side elevational view of the embodiment of the chair shown in FIG. 30, taken along the line XXXVIA-XXXVIA, FIG. 35, with the back assembly shown in the recline position.

In the present example, the first portion 716 (FIGS. 34, 37) of the rear shell member 712 includes a laterally-extending flexing region 782 of relative reduced thickness located fore of the attachment location of the rearward support member 780 with the rear shell member 712. The forward support member 778 includes a laterally-extending flexing region 784 of relative reduced thickness located at a lower end of the forward support member 778 such that flexure of the forward support member 778 is concentrated in the flexing region 782 while the remainder of the forward support member may be relatively rigid and may remain relatively straight. The forward support member 778 connects to each of the tabs 774 aft of the flexing region 776. Referring to FIGS. 36A and 36B, it is noted that the rearward support member 780 remains rigid during recline, while the second portion 746, the second portion 716 and the forward support member 778 flex, with the flexing regions or flexing zones 776, 782, 784 flexing a greater amount than the remainder of each of the associated components. As previously noted, the various thicknesses of the linkages or members comprising the overall supporting four-bar linkage may be varied so as to provide specific support and bending characteristics previously described. It is further noted that this configuration provides adequate flexure to the front shell member 714 while allowing an outer perimeter edge 785 of the front shell member to remain continuous and without breaks or reliefs, thereby providing a continuous edge aesthetic edge, while simultaneously reducing or eliminating wear of a supported cover assembly 787 (FIGS. 30 and 34) typically caused by repeated flexing of a supporting chair surface. In the illustrated example, the cover assembly 787 includes a flexible resilient substrate layer 791 supported by the front shell member 714 and comprising a thermal plastic, a foam layer 793 molded to the substrate layer 791, and a fabric cover 795 thermally set to the foam layer 793. Alternatively, the fabric cover may be wrapped about the foam layer 793 and secured to an underside of the substrate layer 791 by separate mechanical fasteners such as staples (not shown) or to integral fasteners (not shown) integrally molded with the substrate layer 791, and/or secured about the foam layer 793 and the substrate layer 791 by a drawstring arrangement (not shown). In the illustrated example, the foam layer 793 and the fabric cover 795 are both continuous and free from irregularities along the edges thereof, such as apertures, reliefs, cut-outs, stitching, pleats, and the like. In an alternative embodiment, the continuous outer perimeter edge 785 of the front shell member 714 may provide an uninterrupted edge about which to wrap the fabric cover 795. In another alternative arrangement, a separate outermost shell (not shown) comprising a molded thermal plastic may replace the cover assembly 787 and provide an outer, user supporting surface eliminating the need for a fabric-type cover.

Figure 30:
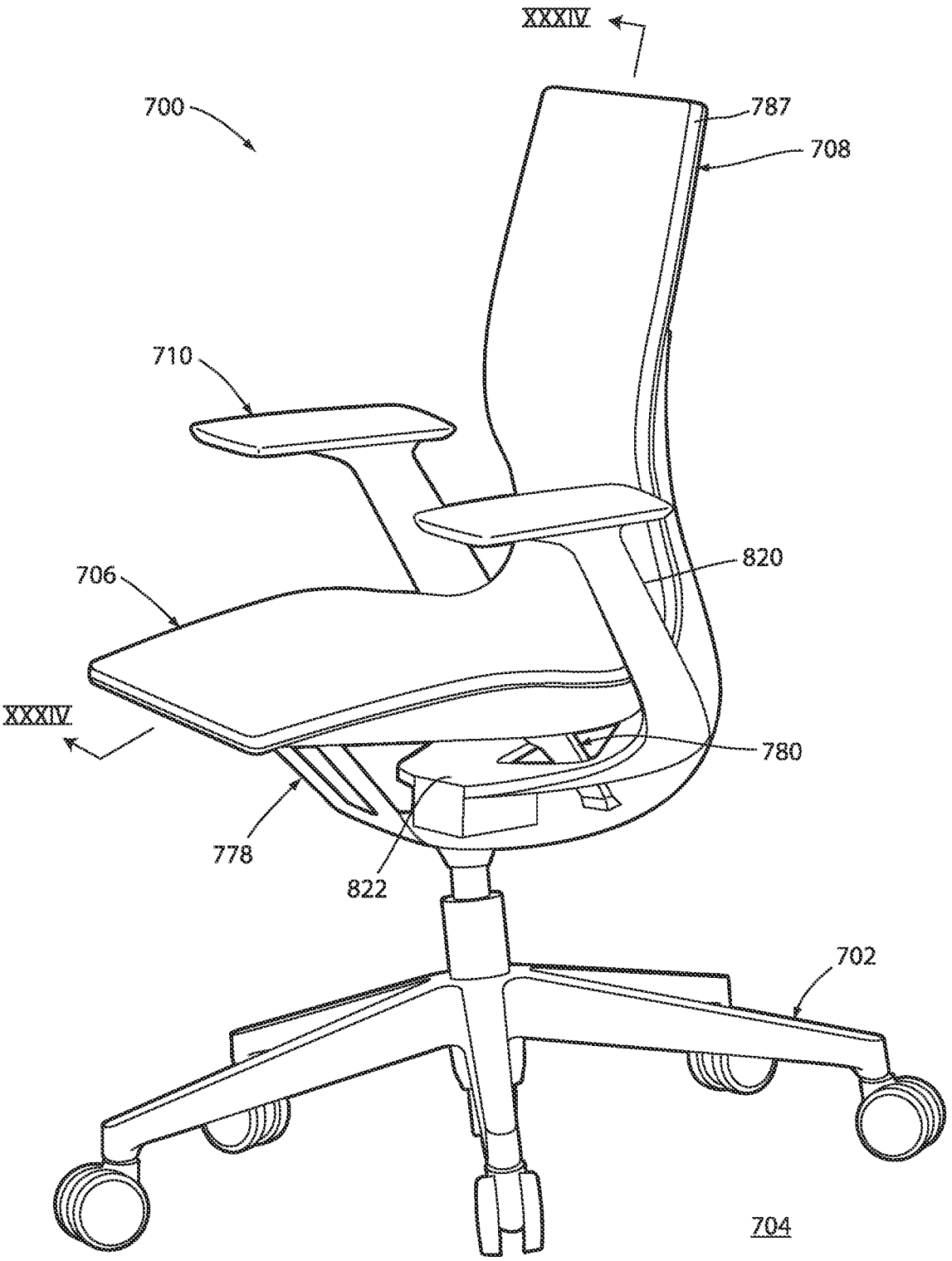
FIG. 30 is a perspective view of another embodiment of a seating arrangement.
Figure 34:
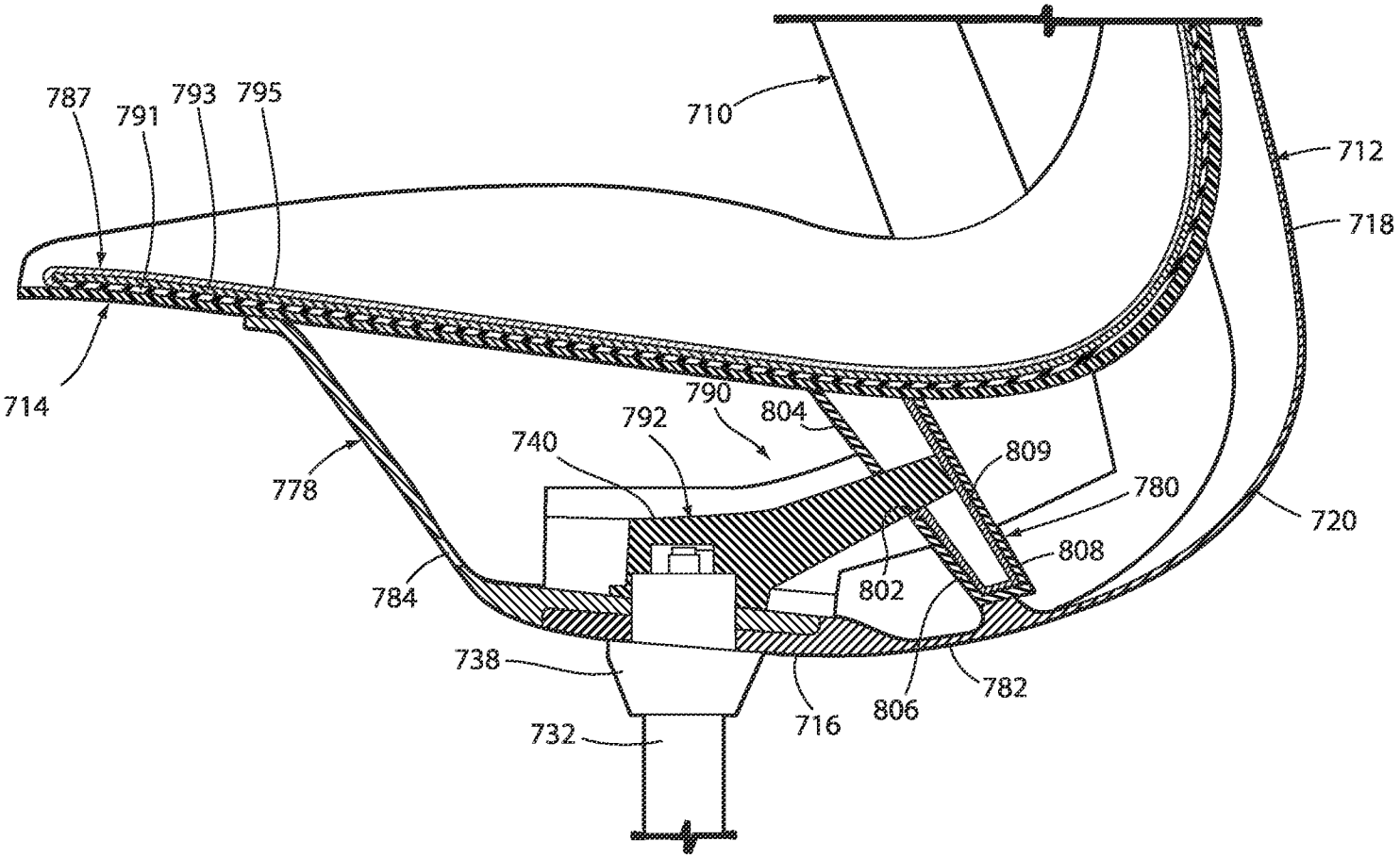
FIG. 34 is a cross-sectional side elevational view of the embodiment of the chair shown in FIG. 30, taken along the line XXXIV-XXXIV, FIG. 30.
Figure 38:
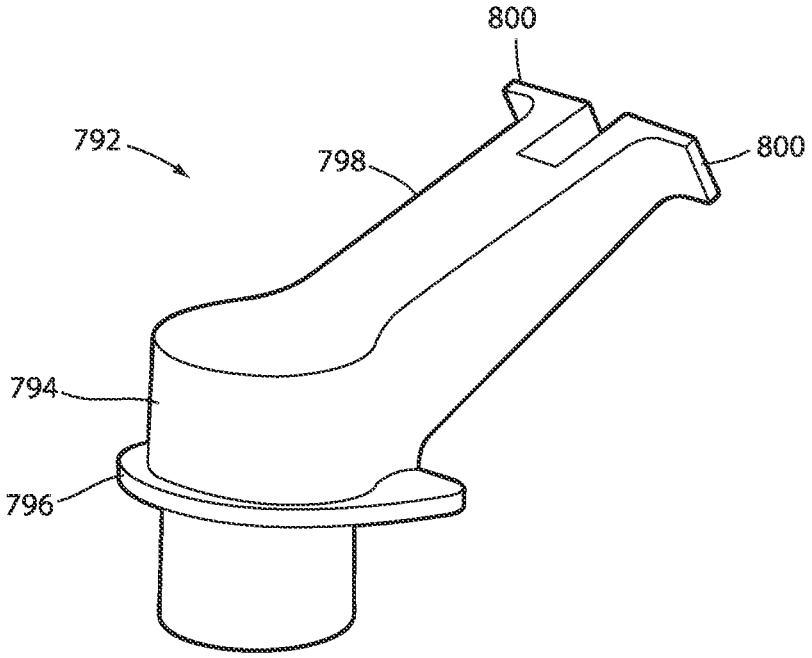
FIG. 38 is a perspective view of a stop member.
Figure 39:
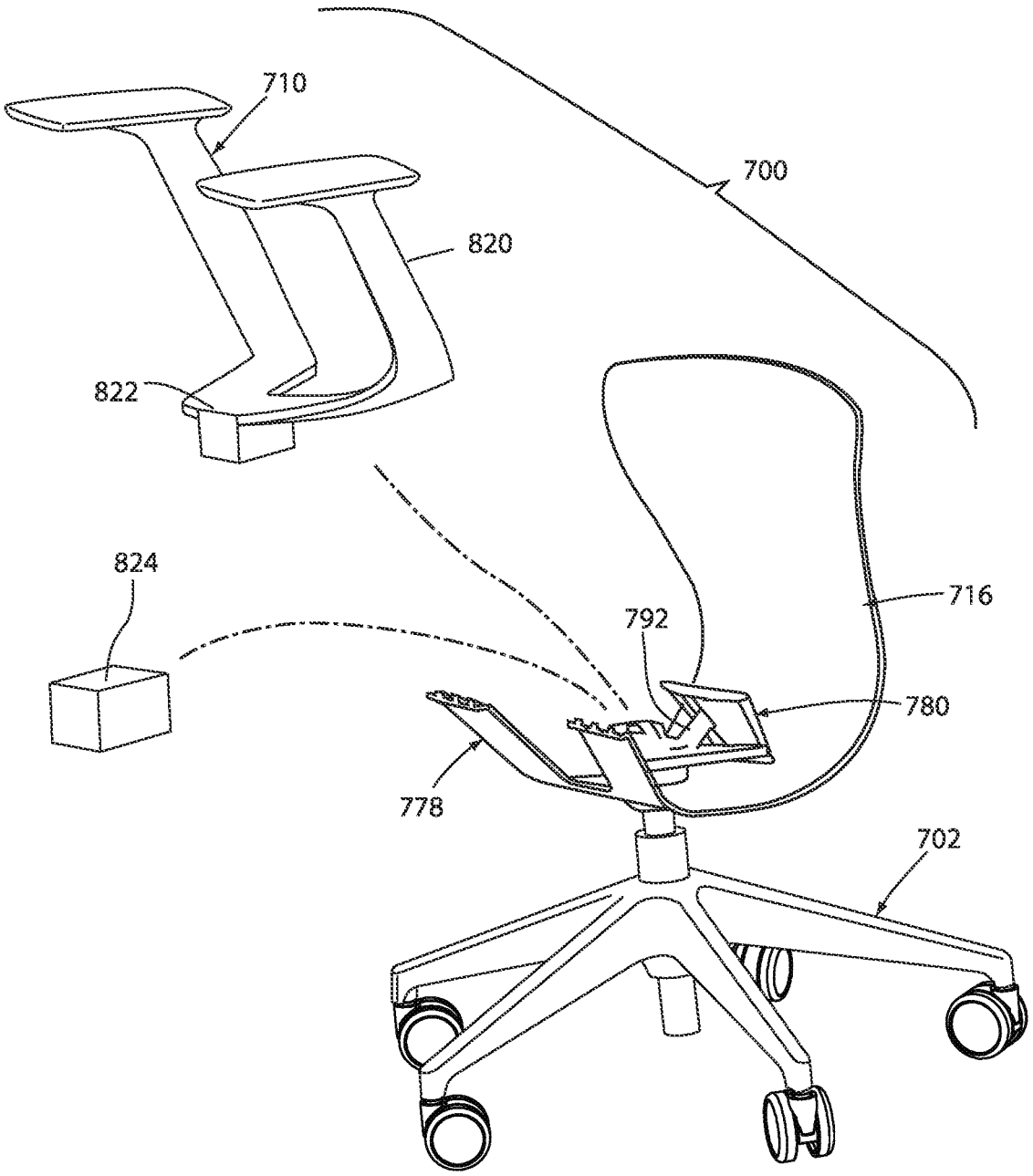
FIG. 39 is an exploded perspective view of another alternative embodiment of a seating arrangement.

The chair assembly 700 further includes a recline stop arrangement 790 (FIG. 34). In the illustrated example, the stop arrangement 790 includes a stop member 792 (FIG. 38) having a cylindrical body portion 794 that receives an upper end of the column 732 therein, a flange 796 that extends about the body portion 794 and that cooperates with the lower coupler 738 to couple the first portion 722 and the second portion 724 of the rear shell member 712 together such that the stop member 792 functions as the upper coupler 740 as previously described, and a stop arm 798 extending rearwardly from the body portion 794. The stop arm 798 extends through an aperture 802 in a front wall 804 of the rearward support member 780 such that a pair of stops 800 located at a distal end of the stop arm 798 are located within an interior space or cavity 806 of the rearward support member 780 defined between the front wall 804 and a rear wall 808. Alternatively, the aperture 802 and the interior space may be lined with a plastic bushing member 809. The stop arm 798 and stops 800 cooperate to form a control rod. In operation, the rearward recline of the back assembly 708 from the upright position A toward the recline position B is limited by the stops 800 abutting the rear wall 808, while a forward tilting of the chair back 708 from the reclined position B toward the upright position A is limited by the stops 800 abutting the front wall 804. It is noted that the present configuration provides a relatively open chair structure such that the components comprising the four-bar linkage, the arm support structure and portions of the recline limiting arrangement are viewable, while the abutting stop components are concealed from view and within the existing supporting structures and specifically a component of the four-bar linkage. As best illustrated in FIGS. 30 and 39, the arm support members 820 are integral with and supported by a cover portion 822 configured to aesthetically cover the stop arrangement 792. The arm support members 820 and cover portion 822 may be removed from the chair assembly 700 and alternatively replaced with a cover member 824, thereby providing an armless embodiment of the chair assembly on the same underlying platform.

Figure 40:
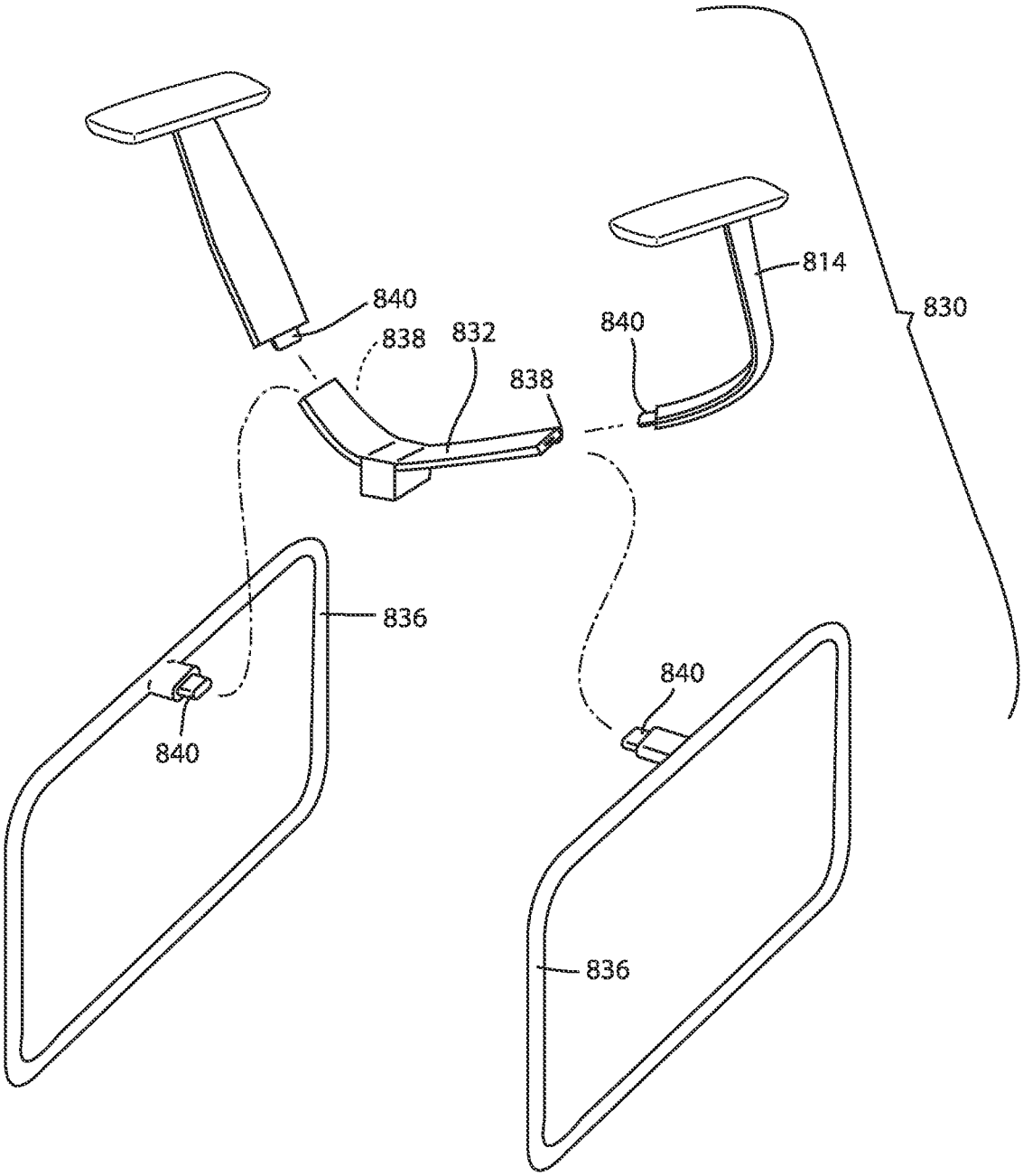
FIG. 40 is an exploded perspective view of an accessory supporting arrangement.
Figure 41:
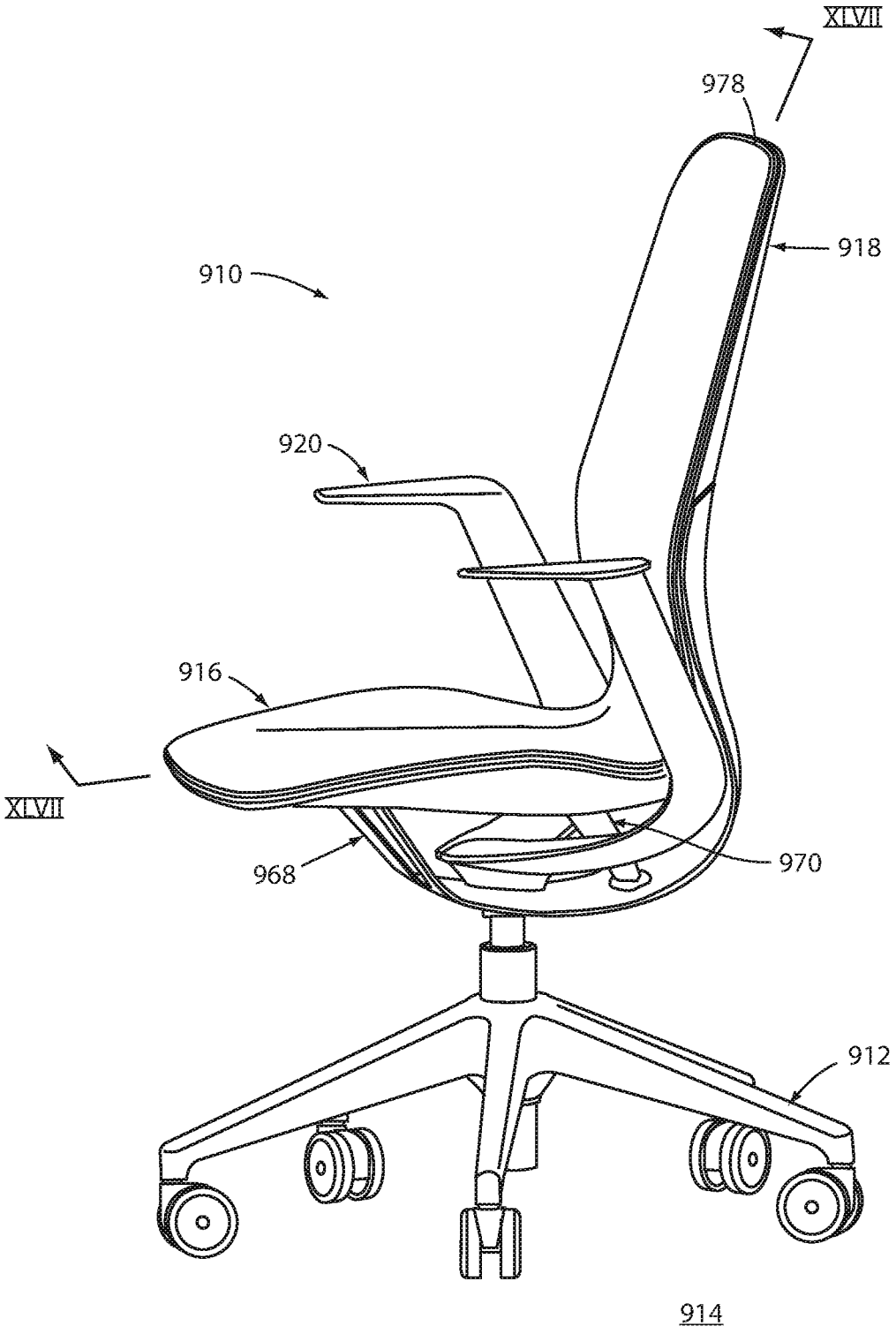
FIG. 41 is a perspective view of an embodiment of a seating arrangement.

Alternatively, the arm assemblies 710, the arm support members 820 and the cover portion 822 may be replaced by an accessory supporting arrangement 830 (FIG. 40) that includes a support portion 832 configured as a housing to aesthetically cover the stop arrangement 792, and a chair accessory such as an arm assembly 834, or a leg assembly 836 configured to support the chair assembly 700 above a floor surfaces in place of the support assembly 702. While an arm assembly 834 and a leg assembly 936 are provided as examples, other chair accessories are also contemplated, such as tablet supports, work surfaces, beverage holders, and the like. In the illustrated example, the support portion 832 includes the first portion 838 of a releasable coupling arrangement, while the accessory includes the second portion 840 of the coupling arrangement, thereby allowing multiple accessories to be interchangeably supported from the same underlying support structure.

Figure 42:
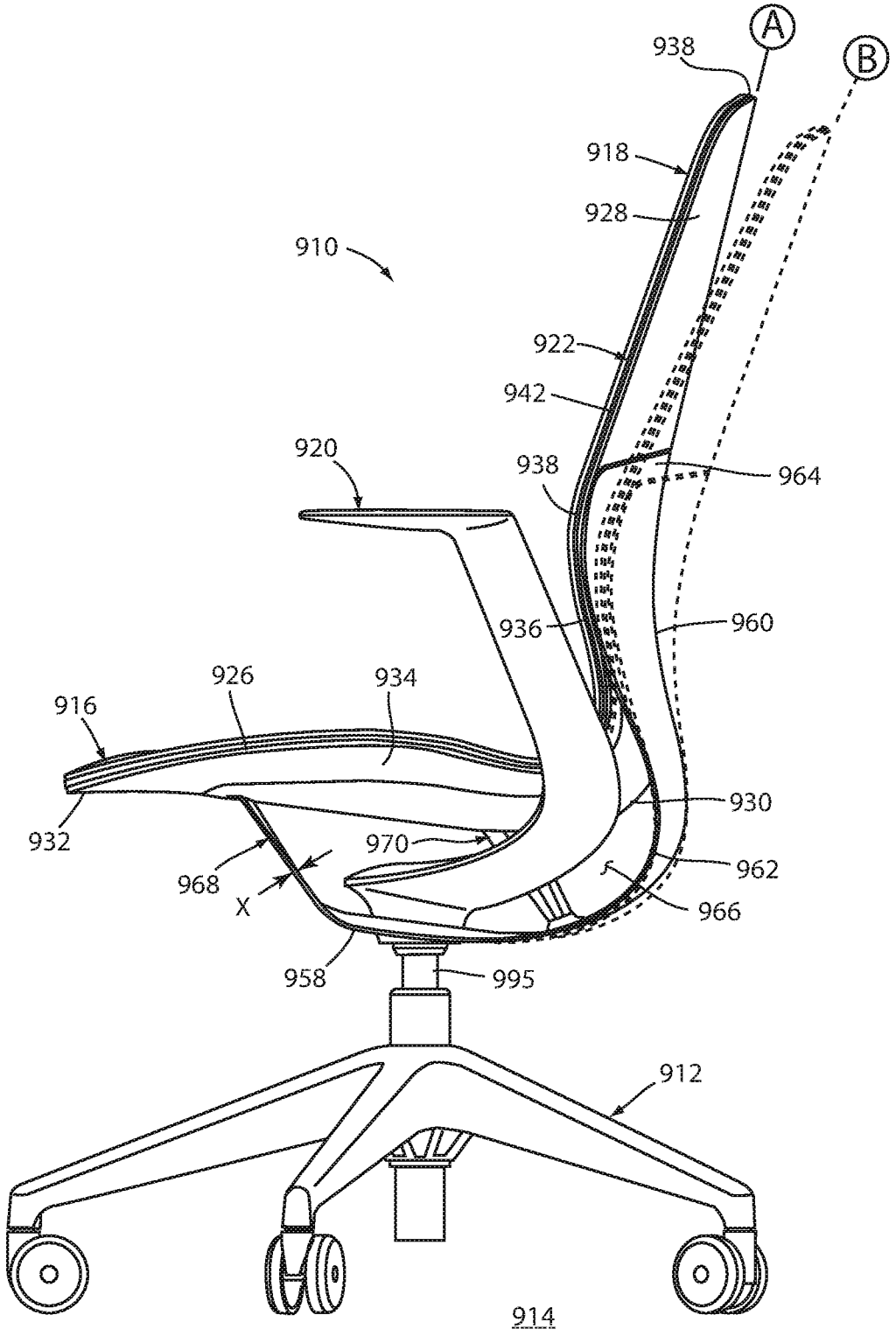
FIG. 42 is a side elevational view of the embodiment of the seating arrangement shown in FIG. 41 with a back assembly shown in an upright position in solid line and a reclined position in dashed line.

The reference numeral 910 (FIG. 41) generally designates another embodiment of a seating arrangement. In the illustrated example, the seating arrangement 910 is provided in the form of an office chair assembly and includes a castered base assembly 912 abutting a floor surface 914, a seat assembly 916 and a back assembly 918 each supported above the base assembly 912, and a pair of arm assemblies 920. In the illustrated example, the chair assembly 910 (FIG. 42) includes a front or a first shell member 922 and a rear or second shell member 924. The shell members 922, 924 may each be formed as a single, integral piece or comprise multiple, individual components as described below. The shell members 922, 924 may each comprise a flexibly resilient polymer material such as any thermoplastic, including, for example, nylon, glass-filled nylon, polypropylene, acetyl, or polycarbonate; any thermal set material, including, for example, epoxies; or any resin-based composites, including, for example, carbon fiber or fiberglass, thereby allowing each of the shell members 922, 924 to conform and move in response to forces exerted by a user. Although a polymer material is preferred, other suitable materials may also be utilized, such as metals, including, for example, steel or titanium; plywood; or a composite material including plastics, resin-based composites, metals and/or plywood. A variety of other suitable energy-storing materials may also be utilized.

Figure 43:
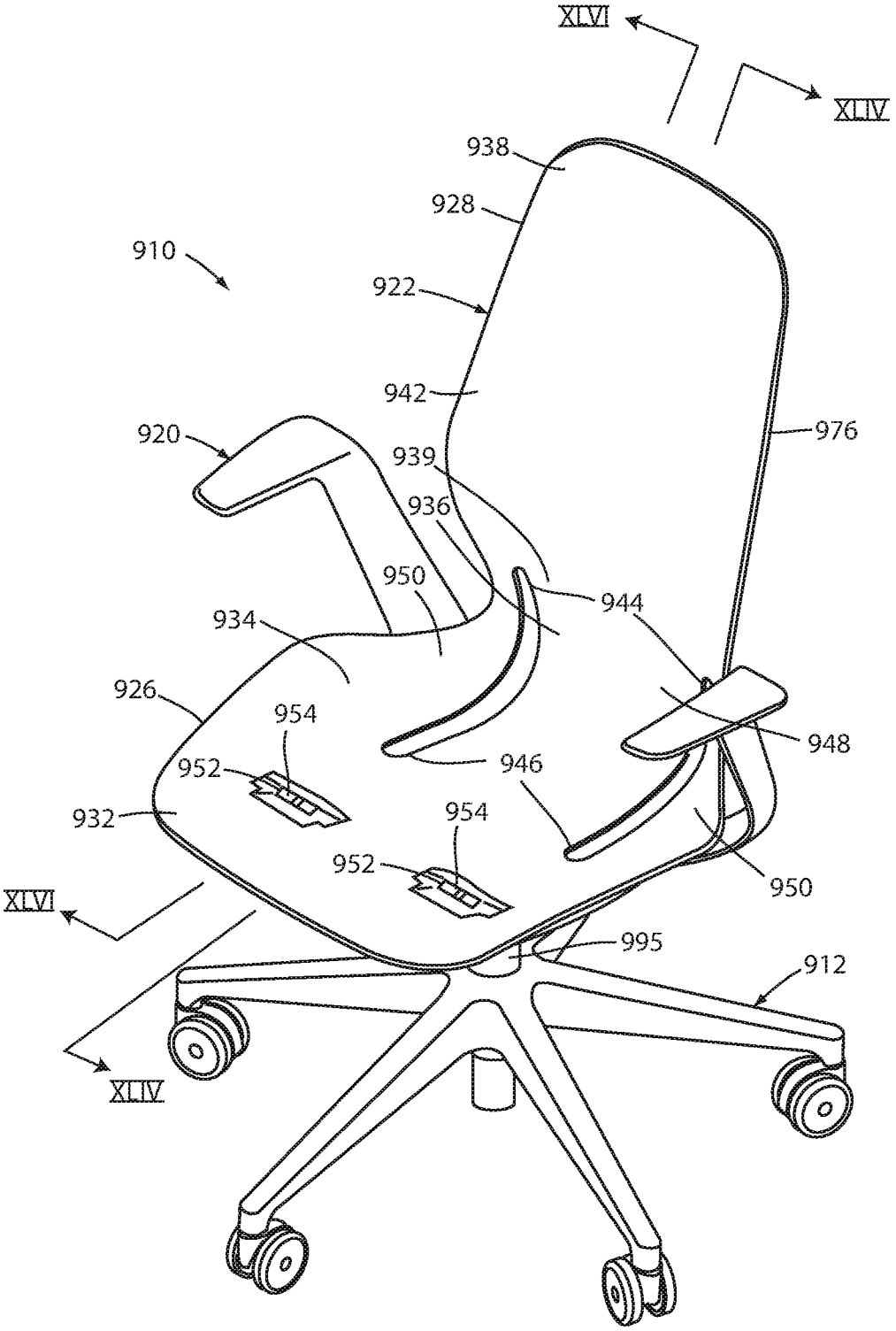
FIG. 43 is a perspective view of the embodiment of the chair shown in FIG. 41 with a fabric cover removed.

The front shell member 922 (FIGS. 42 and 43) includes a horizontally-extending bottom or first portion 926 which may be configured to support a seated user, a vertically-extending upper or second portion 928 extending upwardly from the first portion 926 and which may be configured to support the back of a seated user, and an arcuately-shaped transition portion 930 extending between the first portion 926 and the second portion 928. The first portion 926 includes a forward portion 932 and a rearward portion 934, while the second portion 928 includes a lower portion 936, an upper portion 938 where the arcuately-shaped, forwardly convex mid-portion 930 is located therebetween and configured to support the lumbar region of a user's back.

In the illustrated example, the front shell member 922 further includes a pair of laterally-spaced slots 944 extending in a fore-to-aft direction from a mid-portion 939 of the second portion 928 to the intermediate portion 942 of the second portion 928, thereby dividing the front shell member 922 into an inner portion 48 and a pair of outer portions 950. The division of the inner portion 948 from the outer portions 950 allows the inner portion 948 to flex separately from the outer portions 950 during recline of the back assembly 918 from an upright position A to a recline position B. As best illustrated in the FIGS. 44 and 45, the flexing of the front shell member 922 during recline is such that the inner portion 948 flexes less than the outer portions 950 such that the outer portions 950 descend relative to the inner portion 948, thereby allowing additional flexibility in the front shell member 922 while providing adequate support for the seated user via the inner portion 948. The differentiation of flexure of the inner portion 948 and the outer portions 950 causes the second portion 928 of the front shell member 922 to move from the reclined position toward the upright position and exert an increased pressure to the back of a seated user as the force exerted on the inner portion 948 is increased, such as a force exerted by the weight of a seated user.

Figure 46:
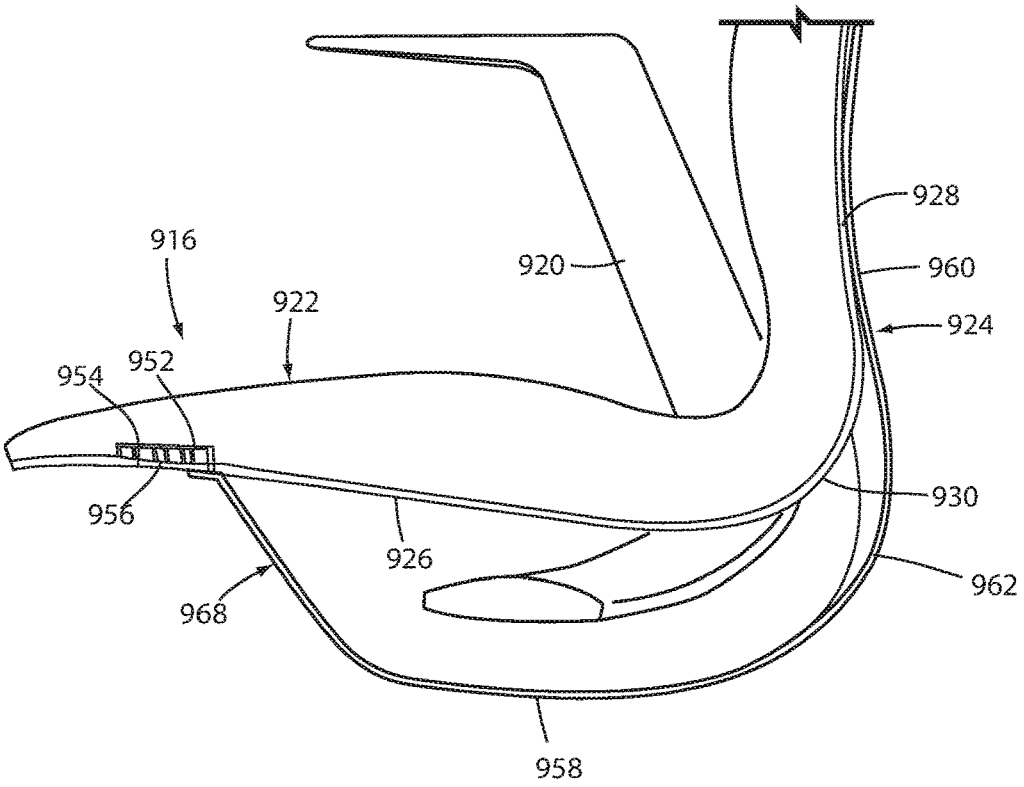
FIG. 46 is a cross-sectional side elevational view of the embodiment of the chair shown in FIG. 41, taken along the line XLVI-XLVI, FIG. 43.

The front shell member 922 (FIGS. 43 and 46) further includes a pair of C-shaped reliefs or apertures 952 each defining a tab 954. Each tab 954 has a laterally-extending flexing region 956 of relative reduce thickness thereby promoting flexure of each tab 954 in this region as described below.

The rear shell member 924 includes a horizontally-extending bottom or first portion 958, a vertically-extending upper or second portion 960 extending upwardly from the first portion 958, and an arcuately-shaped transition portion 962 extending between the first portion 958 and the second portion 960, and as described in greater detail below.

In assembly, an intermediate portion 942 of the second portion 928 of the front shell member 922 located between the upper portion 938 and the mid-portion 939 is connected to an upper portion 964 of the second portion 960 of the rear shell member 924, such as by sonic welding, an adhesive, integral molding, mechanical fasteners, and the like. The front shell member 922 and the rear shell member 924 may be configured so as to define a gap 966 therebetween.

The chair assembly 910 (FIGS. 41 and 42) may include laterally-extending support members or linkage members, including a pair of forward support or linkage members 968 and a rearward support or linkage member 970, each extending between the second portion 928 of the front shell member 922 and the second portion 958 of the rear shell member 924. In the illustrated example, the forward support members 968 are flexibly resilient along the length thereof, while the rearward support member 970 is relatively rigid. The forward support members 968 are integrally formed with the rear shell member 924 and rigidly attached to the tabs 954 of the front shell member 922, while the rearward support member 970 is integrated with the rear shell member 924 and rigidly attached to the front shell member 922. It is noted that in the other embodiments the front support member 968 and the rearward support member 970 may be formed as separate pieces, or as integral portions of the front shell member 922 and/or the rear shell member 924. Further, in the illustrated example, the inner portion 948 cooperates with the forward support member 968 and the rearward support member 970 to form a control mechanism that synchronizes the rearward movement of the first portion 926 of the front shell member 922 with reclining movement of the second portion 928 of the front shell member 922 as further described below.

Figure 44:
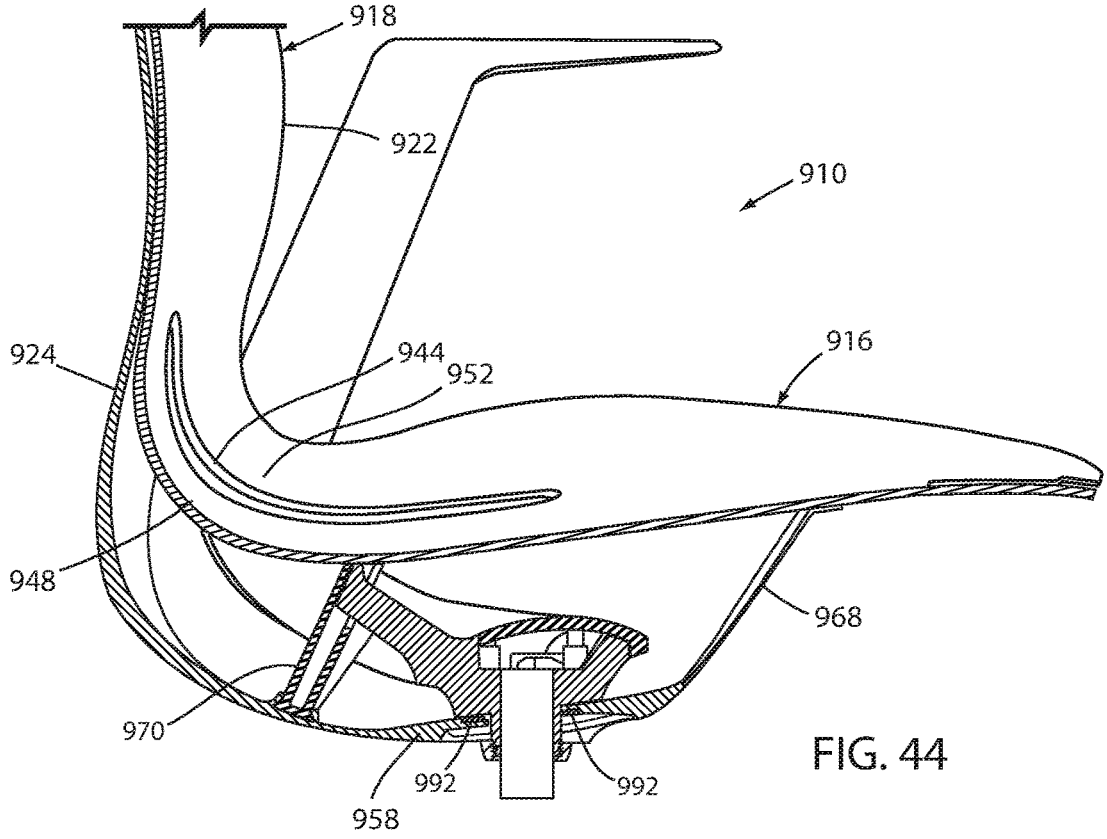
FIG. 44 is a cross-sectional side elevational view of the embodiment of the chair shown in FIG. 41, taken along the line XLIV-XLIV, FIG. 43, with the back assembly shown in the upright position.
Figure 45:
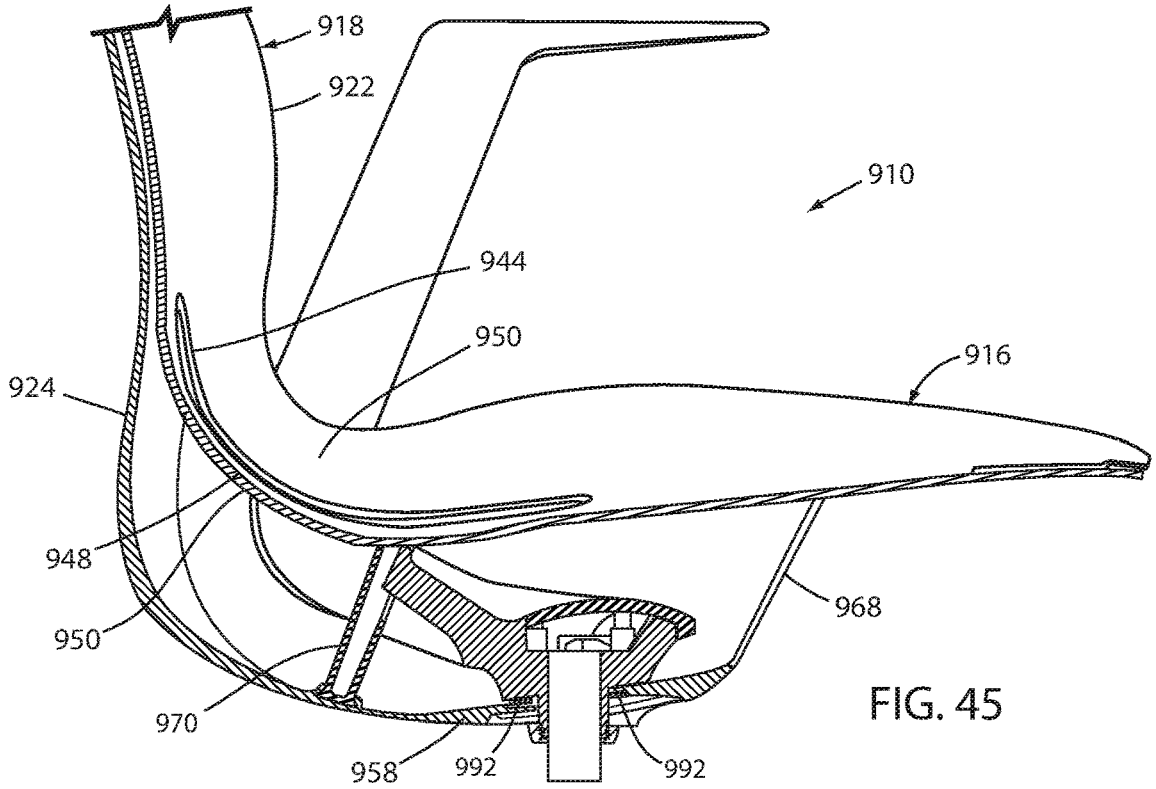
FIG. 45 is a cross-sectional side elevational view of the embodiment of the chair shown in FIG. 41, taken along the line XLIV-XLIV, FIG. 43, with the back assembly shown in the recline position.
Figure 47:
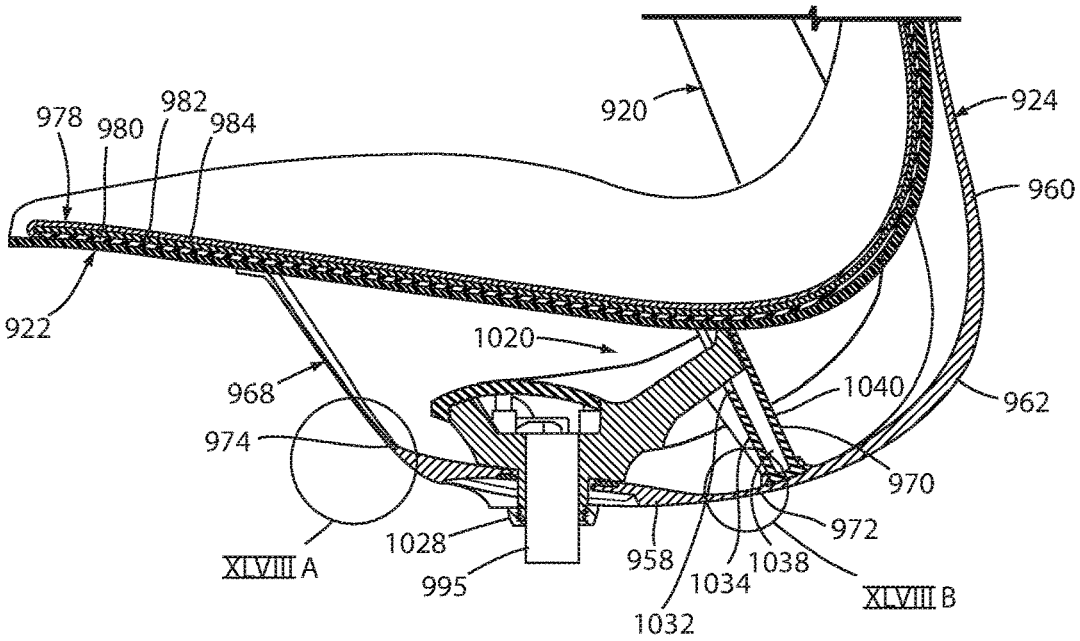
FIG. 47 is a cross-sectional side elevational view of the embodiment of the chair shown in FIG. 41, taken along the line XLVII-XLVII, FIG. 41.

In the present example, the first portion 958 (FIGS. 46 and 47) of the rear shell member 924 includes a laterally-extending flexing region 972 of relative reduced thickness located fore of the attachment location of the rearward support member 970 with the rear shell member 924. The forward support member 968 includes a laterally-extending flexing region 974 of relative reduced thickness located at a lower end of the forward support member 968 such that flexure of the forward support member 968 is concentrated in the flexing region 974 while the remainder of the forward support member 968 may be relatively rigid and may remain relatively straight. The forward support member 968 connects to each of the tabs 954 aft of the flexing region 956. Referring to FIGS. 44 and 45, it is noted that the rearward support member 970 remains rigid during recline, while the second portion 928, the second portion 958 and the forward support member 968 flex, with the flexing regions or flexing zones 956, 972, 974 flexing a greater amount than the remainder of each of the associated components. It is noted that while the present examples are described as including flexible zones that comprise reduced thickness, other configurations may also be used, such as flexible zones created via the use of apertures, cut-outs, reduced widths and general configuration where the bending stiffness of the structure is reduced relative to the remainder of the structure. As previously noted the various thicknesses of the linkages or members comprising the overall supporting flexible four-bar linkage may be varied so as to provide specific support and bending characteristics previously described. The configuration as described above provides adequate flexure to the front shell member 922 while allowing an outer perimeter edge 976 of the front shell member to remain continuous and without breaks or reliefs, thereby providing a continuous outer aesthetic edge, while simultaneously reducing or eliminating wear of a supported cover assembly 798 (FIGS. 41 and 47) typically caused by repeated flexing of a supporting chair surface. In the illustrated example, the cover assembly 978 includes a flexible resilient substrate layer 980 supported by the front shell member 922, a thermal plastic foam layer 982 molded to the substrate layer 980, and a fabric cover 984 thermally set to the foam layer 982. Alternatively, the fabric cover may be wrapped about the foam layer 982 and secured to an underside of the substrate layer 980 by separate mechanical fasteners such as staples (not shown) or to integral fasteners (not shown) integrally molded with the substrate layer 980, and/or secured about the foam layer 982 and the substrate layer 980 by a drawstring arrangement (not shown). In the illustrated example, the foam layer 982 and the fabric cover 984 are both continuous and free from irregularities along the edges thereof, such as apertures, reliefs, cut-outs, stitching, pleats, and the like. In an alternative embodiment, the continuous outer perimeter edge 976 of the front shell member 922 may provide an uninterrupted edge about which to wrap the fabric cover 984. In another alternative arrangement, a separate outermost shell (not shown) comprising a molded thermal plastic may replace the cover assembly 978 and provide an outer, user supporting surface eliminating the need for a fabric-type cover.

Figure 48:
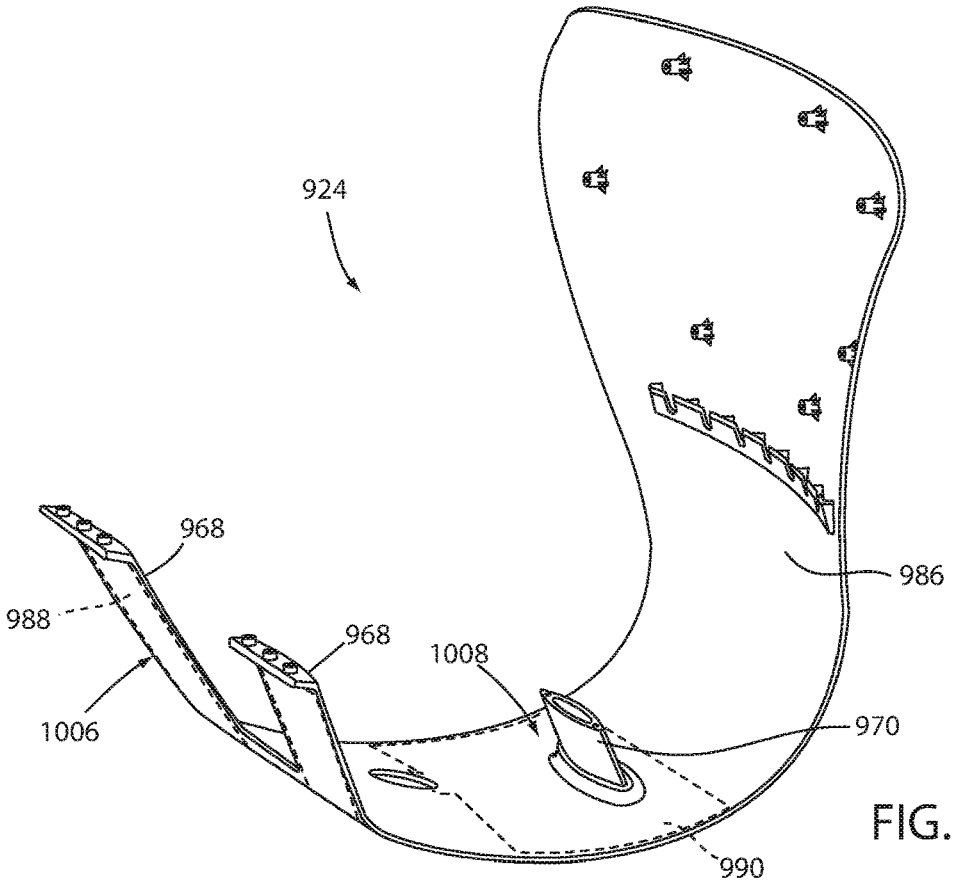
FIG. 48 is a perspective view of a rear shell member with internal components shown in dashed lines.
Figure 49:
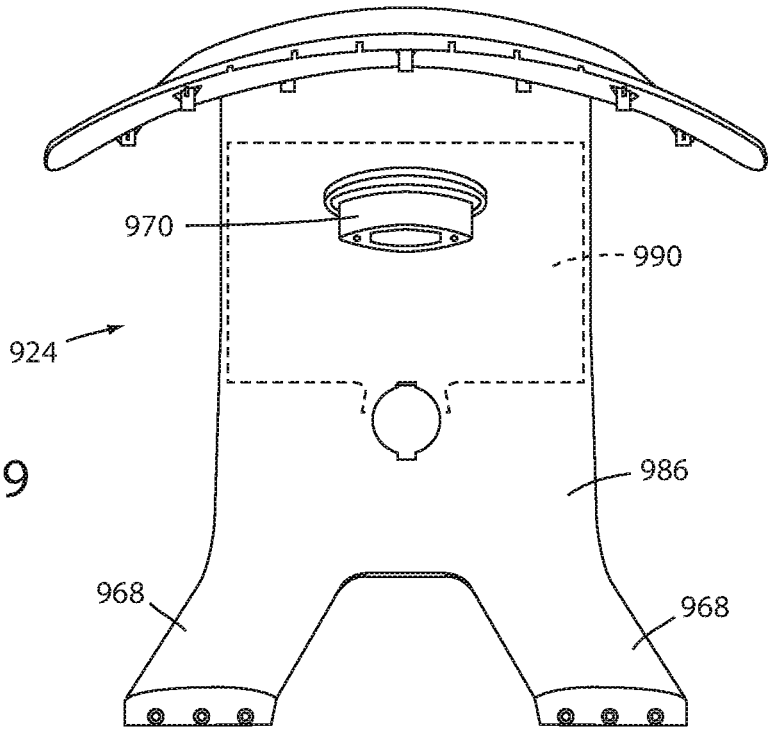
FIG. 49 is a top plan view of the rear shell member with internal components shown in dashed lines.
Figure 50:
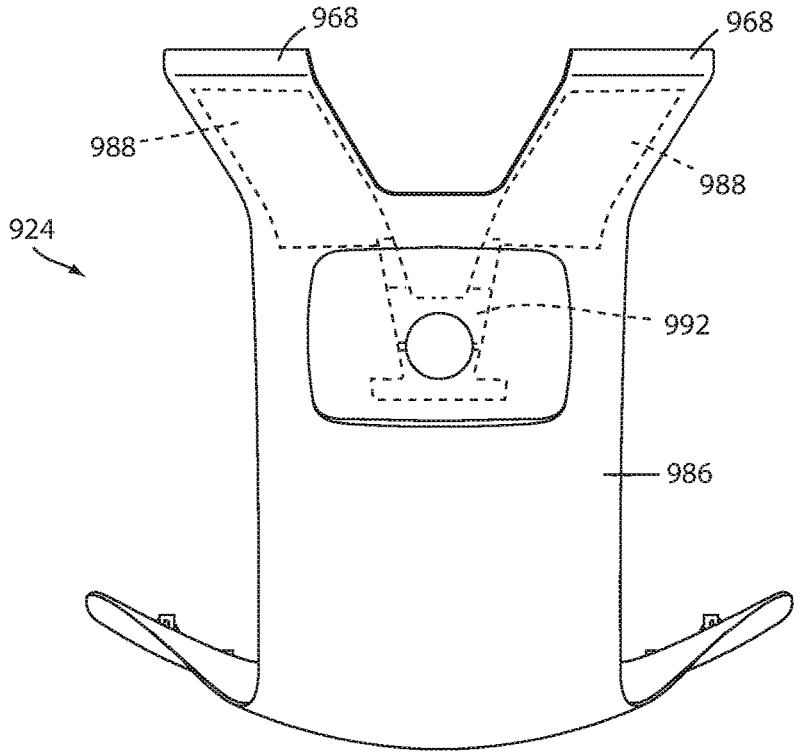
FIG. 50 is a bottom plan view of the rear shell member with internal components shown in dashed lines.
Figure 51:
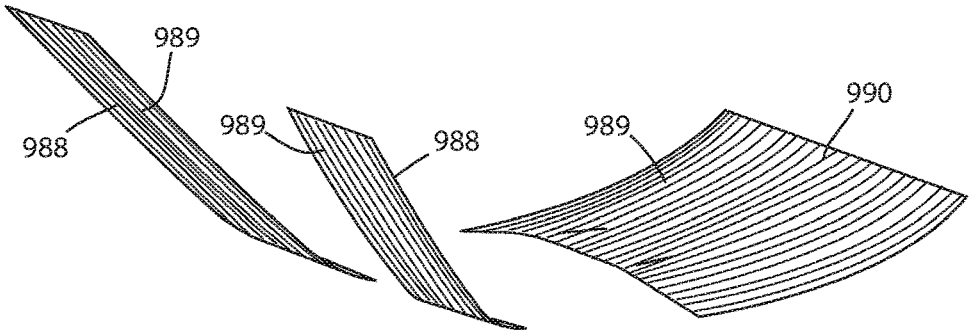
FIG. 51 is a perspective view of forward and rearward reinforcement members.
Figure 52:
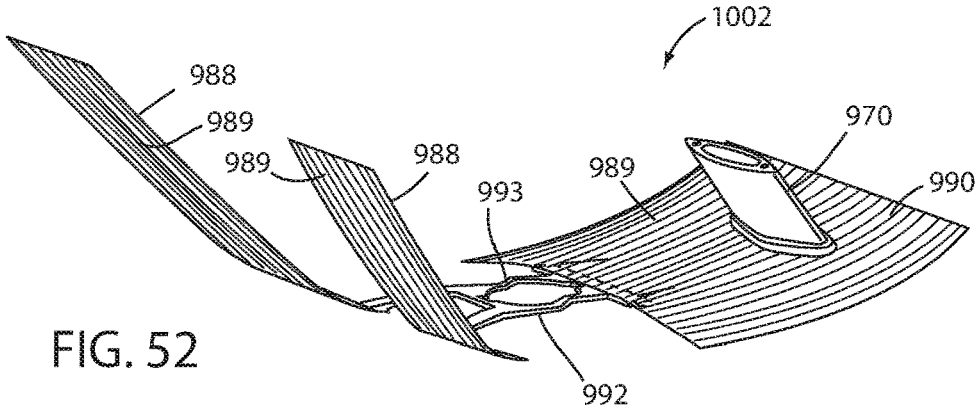
FIG. 52 is a perspective view of an insert.

In one embodiment, and as noted above, the forward support members 968 and the rearward support member 970 are integrally formed with the rear shell member 924. In the present embodiment, the rear shell member 924 (FIGS. 48-50) includes an outer body 986 molded about a pair of resiliently flexible forward reinforcement or biasing members 988 (FIGS. 48-51), a relatively flexible rearward reinforcement or biasing member 990, a central connector body 992 (FIGS. 50 and 52) and the rearward support member 970. The resiliently flexible forward reinforcement members 988 and the resiliently flexible rearward reinforcement member 990 each include a fiber tape that includes a substrate material such as nylon molded about a stranded material such as fiberglass or carbon fibers, however other suitable materials may also be used. In the present embodiment, the stranded material includes a plurality of strands or fibers 989 and preferably comprises fiberglass due to the bonding properties between fiberglass and thermoplastic. Further, the plurality of strands 989 are preferably similarly oriented lengthwise with respect to one another and along the fore-to-aft length of each of the resiliently flexible forward reinforcement members 988 and the flexible rearward reinforcement member 990. In the instant example, the resiliently flexible forward and rearward reinforcement members 988, 990 each comprise a continuous glass, extruded "tape," as commercially available from Plasticomp of Winona, Minnesota, which allows the reinforcement member 988, 990 to shape to or assume the same basic shape of the article or component the reinforcement member 988, 990 is molded, adhered or attached to. The central connector body 992 also includes a central aperture 993 for receiving a column 995 of the base assembly 912 therethrough.

Figure 48A:
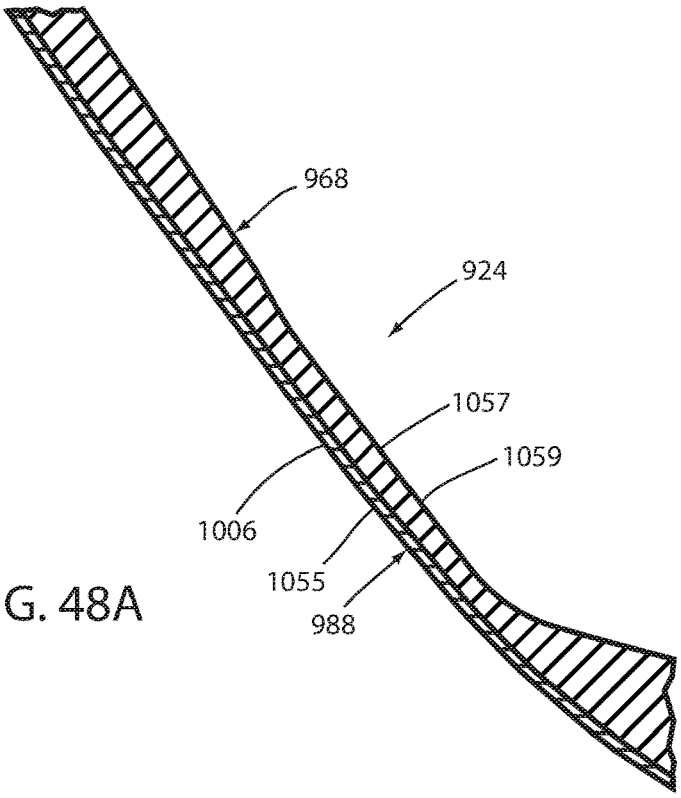
FIG. 48A is an enlarged, partial side view of the area XLVIIIA, FIG. 47.
Figure 48B:
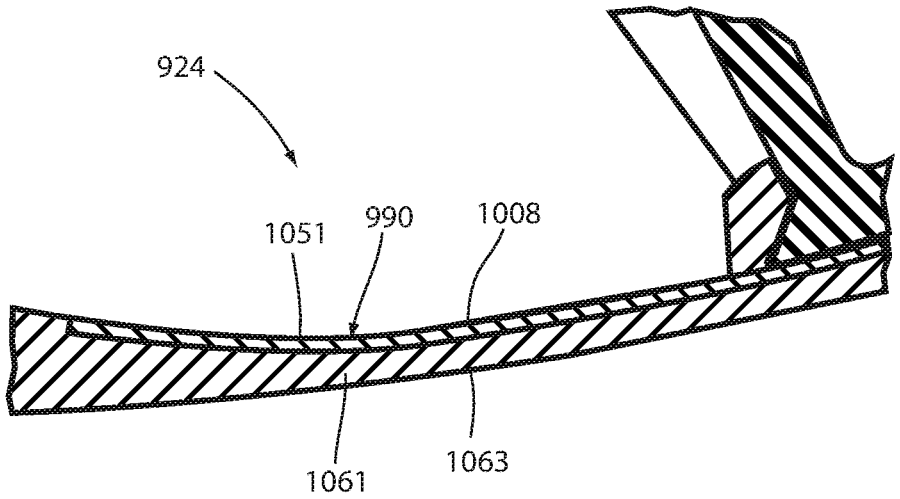
FIG. 48B is an enlarged, partial side view of the area XLVIIIB.
Figure 53:
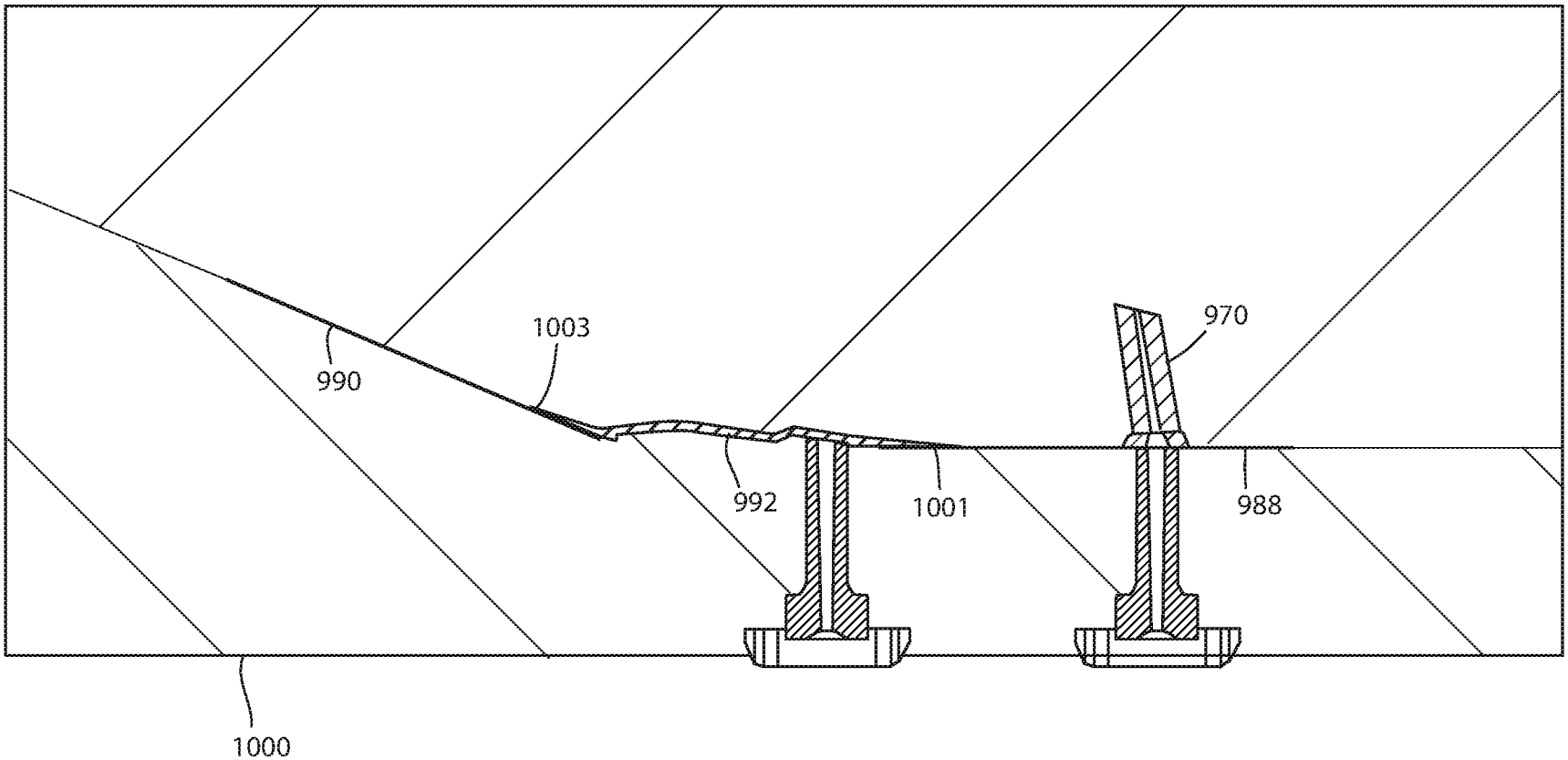
FIG. 53 is a cross-sectional side elevational view of a first mold assembly and the insert.
Figures 53A, 53B:
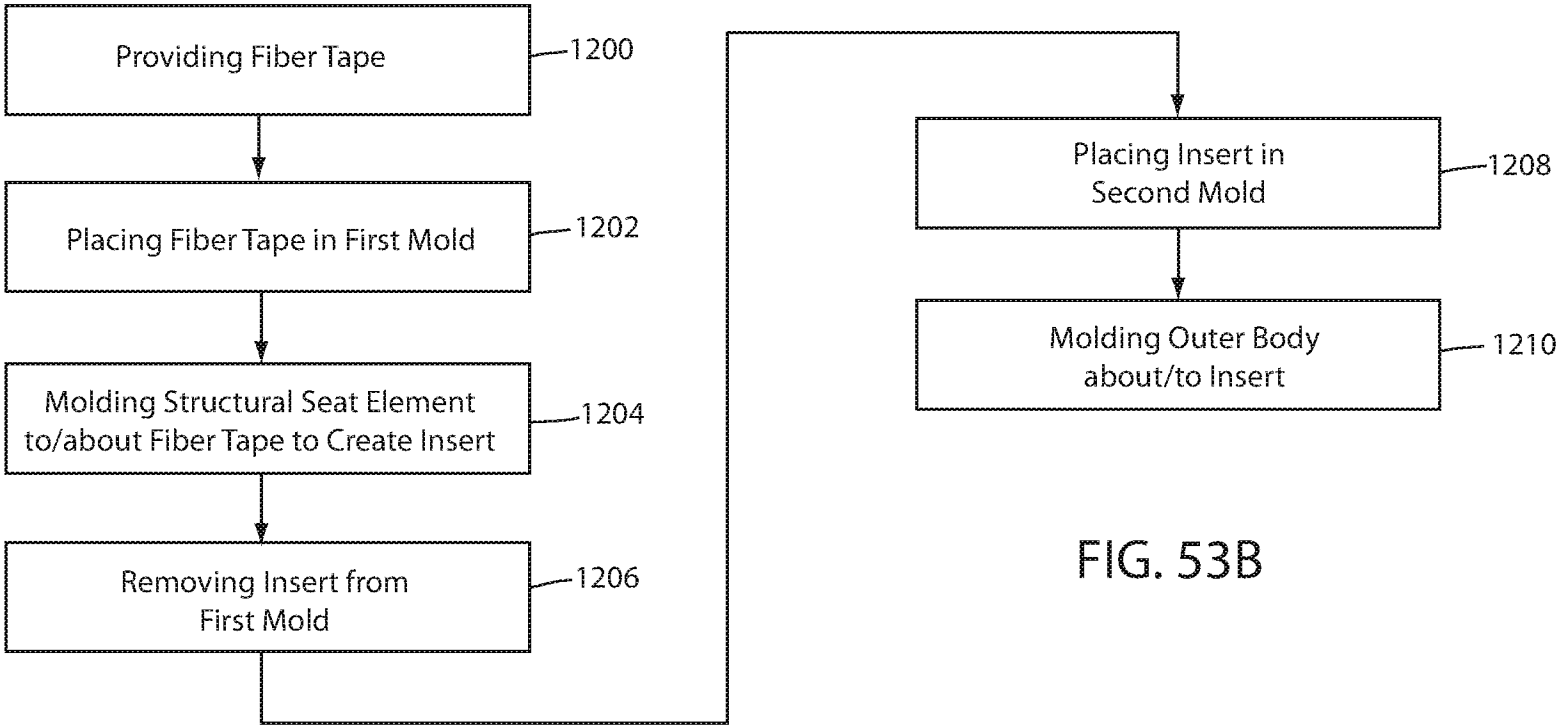
FIG. 53A is a flow chart illustrating a first method for constructing a seat arrangement.
FIG. 53B is a flow chart illustrating a second method for constructing a seat arrangement.
Figure 54A:
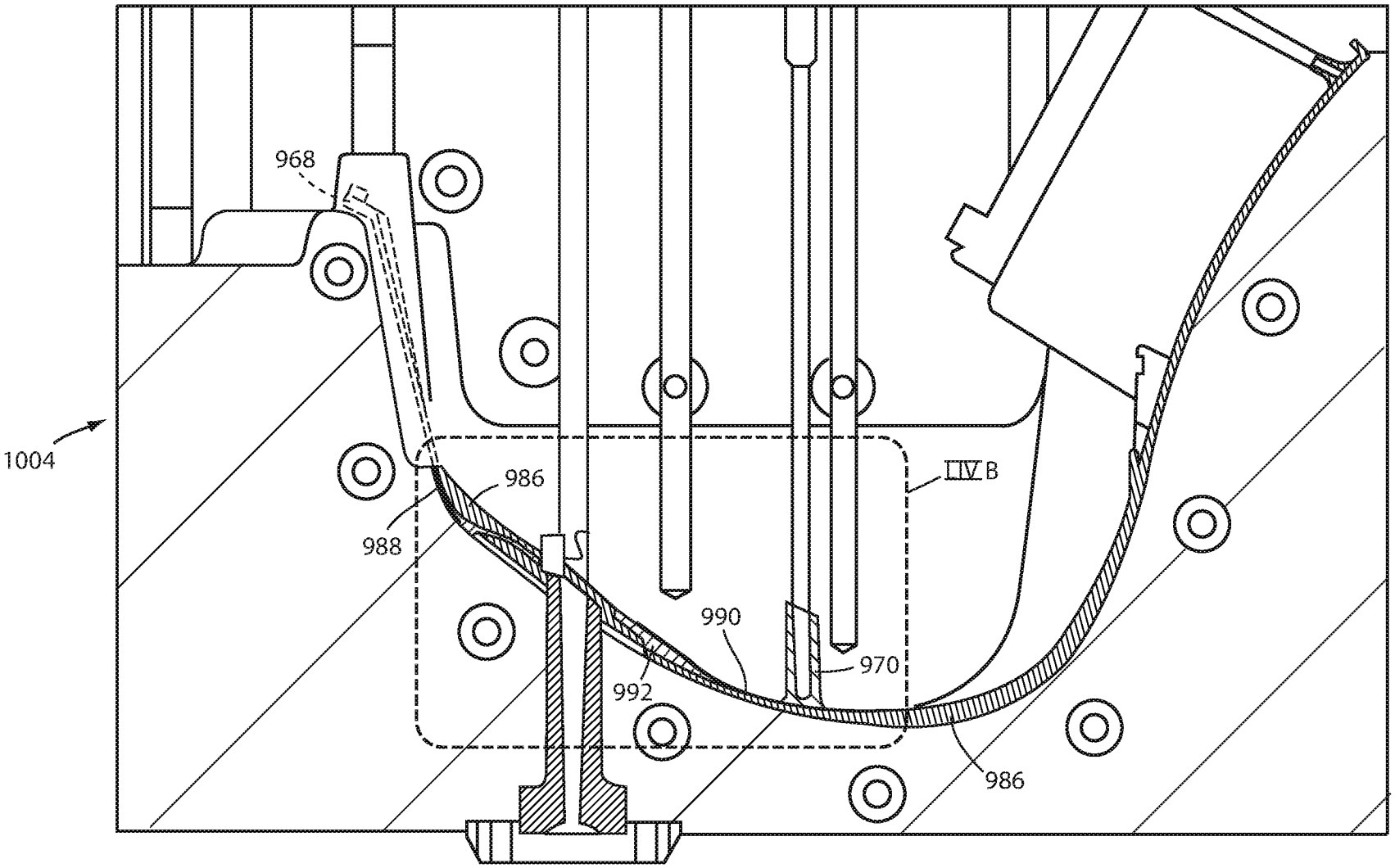
FIG. 54A is a cross-sectional side elevational view of a second mold assembly and the rear shell member.
Figure 54B:
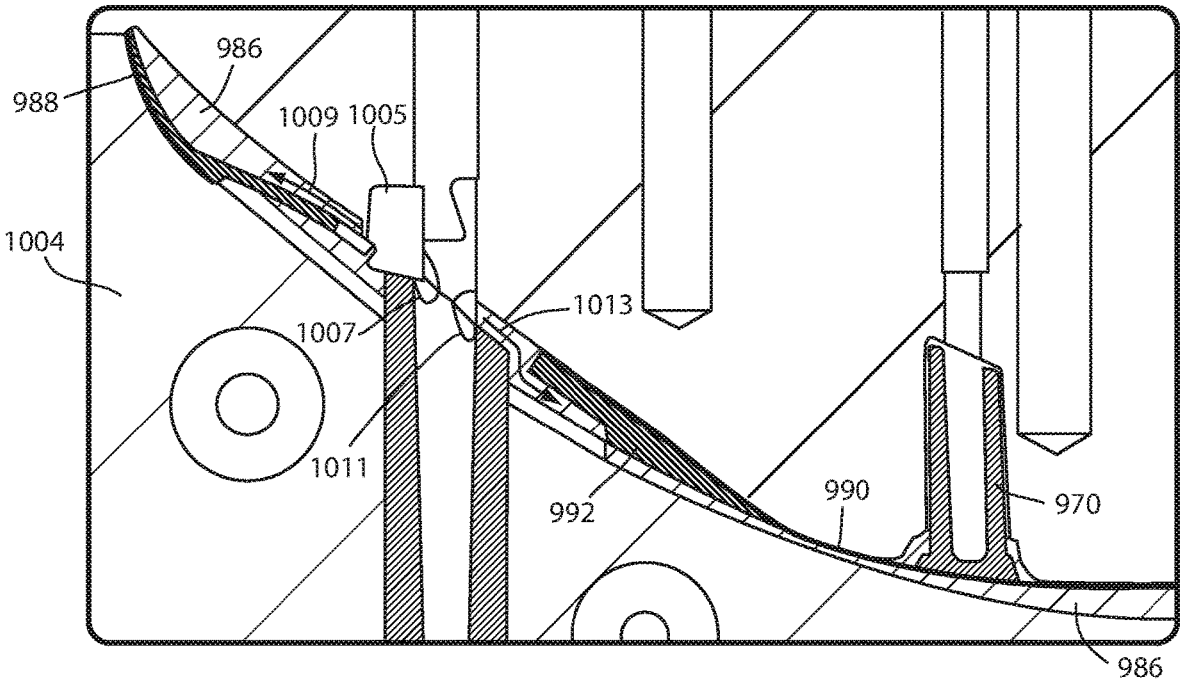
FIG. 54B is an enlarged cross-sectional side view of the area LIVB, FIG. 54A.

In a first molding process (FIG. 53A), the resiliently flexible reinforcement members 988, 990 (FIG. 53) are provided (step 1200 (FIG. 53A)) and are placed into a mold assembly 1000 (step 1202) and may be held in place by mechanical abutment structures, such as suction cups, and/or by an electrostatic force between the reinforcement members 988, 990 and the face of the mold. In the present example, the fiber tape is relatively flexible and are entirely spaced from one another. In another example, the multiple pieces of the fiber tape may be positioned with respect to one another external to the mold assembly 1000, and may at least partially overlap with one another, and may then be placed within the mold assembly 1000 as a pre-oriented or positioned grouping. The central connector body 992 is then molded about a forward edge 1001 of the rearward reinforcement member 990 and a rearward edge 1003 of the forward reinforcement members 988, thereby connecting the same with one another, while the rearward support member 970 is molded onto the rearward reinforcement member 990, thereby resulting in a single-piece insert 1002 (FIG. 52) that includes the forward and rearward reinforcement members 988, 990, the central connector body 992 and the rearward support member 970 (step 1204). The central connector body 992 and the rearward support member 970 each preferably comprise a thermoplastic material. The insert 1002 is then removed from the mold assembly 1000 (step 1206). In a second molding process (FIGS. 54A and 54B) the insert 1002 may then be placed in a second mold assembly 1004 (FIG. 44A) (step 1208), where the outer body 986 is molded about the insert 1002 (step 1210). As previously noted, the outer body 986 may comprise a flexibly resilient polymer material such as thermoplastic, including for example, nylon, glass-filled nylon, polypropylene, acetyl, or polycarbonate; any thermal set material, including, for example, epoxies; or resin-based composites, including, for example, carbon fiber or fiberglass. In the instant example, the outer body 986 is molded about the insert 1002 such that the resiliently flexible forward reinforcement members 988 (FIG. 48A) are located in a tensile side 1055 proximate a forward or tensile surface 1006 (FIG. 48) where the tensile side 1055 is put in tension and the compression side 1057 is under compression when the flexing zone 972 deforms as the back assembly 918 is moved from the upright position A to the reclined position B. The resiliently flexible rearward reinforcement member 990 (FIG. 48B) is located in a tensile side 1051 proximate an upper or tensile surface 1008 opposite a rearward or compression side 1061 proximate a rearward or compression surface 1063, where the tensile side 1051 is put in tension and the compression side 1061 is under compression when the flexing zone 974 deforms as the back assembly 918 is moved from the upright position A toward the reclined position B. The selected placement of the reinforcement member 988, 990 flexibly reinforce the areas of the overall structure most subject to bending during recline of the back assembly 918, such as, for example, the flexing regions 972, 974. It is noted that locating the reinforcement members 988, 990 just beneath the outer surfaces 1006, 1008 provides the outer body 986 with an overall outer surface that may be easily treated, such as by painting, powder coating, and the like. It is further noted that this molding process or method also generally allows the construction of various parts, components, subassemblies and structures that incorporate multi-layers providing various and varied mechanical properties, as well as pre-constructed features into a single-piece element. With reference to FIGS. 54A and 54B, the insert 1002 is placed within an interior of the second mold 1004. A locking member 1005 extends into the apertures 993 of the central connector body 992 and engages the central connector body 992 to hold the insert member 1002 in place within the second mold 1004. The second mold 1004 includes a first gate 1007 that provides a flow path 1009 and a second gate 1011 that provides a flow path 1013. It is noted that the first and second flow paths 1009, 1013 direct the molded material onto the resiliently flexible reinforcement member 988, 990, respectively, in such a manner so as to force the resiliently flexible reinforcement members 988, 990 onto the lower and upper faces of the second mold 1004 thereby holding the reinforcement members 988, 990 in position during the molding process. Preferably, the outer body 986 comprises a polypropylene, nylon 66 GF, or nylon 6 GF while the fiberglass strands comprises long glass resins. Further, the outer body 86 preferably comprises equal to or greater than 20% glass by volume, more preferably equal to or greater than 55% glass by volume, and most preferably equal to or greater than 70% glass by volume.

The embodiment of the chair assembly 910 as described above provides a cost effective, reclinable seating arrangement with highly repeatable bending properties and support characteristics. Preferably, the forward sup ort members 968 provide a bend stiffness of between about $$100\frac{\text{in}-\text{lb}}{deg}$$

and about $$2\frac{\text{in}-\text{lb}}{deg},$$

more preferably of between about $$50\frac{\text{in}-\text{lb}}{deg}$$

and about $$5\frac{\text{in}-\text{lb}}{deg},$$

and most preferably of between about $$15\frac{\text{in}-\text{lb}}{deg},$$

and about $$\frac{\text{in}-\text{lb}}{deg}.$$

The forward, flexible support members 68 further have a maximum thickness along a majority of the length of the forward support members 968 of less than equal to about 0.5 inches, more preferably of less than or equal to about 0.25 inches, and most preferably of between about 0.150 inches and about 0.040 inches. The resiliently flexible reinforcement members 956, 972 and 974 each have a modulus of elasticity or elastic modulus of preferably between about 700,000 psi and about 5,000,000 psi, more preferably of between about 700,000 psi and about 3,000,000 psi, even more preferably of between about 1,000,000 psi and about 2,000,000 psi, and most preferably of about 1,600,000 psi. The composite material of the resiliently flexible reinforcement members 956, 972, 974 is configured to store a significant amount of energy during deformation while simultaneously resisting fatigue failures. In addition, the composite material and configuration of the members 956, 972, 974 resists deformation in unwanted modes thereby preserving intended movement when subjected to disruptive forces.

The chair assembly 910 further includes a recline stop arrangement 1020 (FIG. 47) that is similar in configuration as the recline stop arrangement 790 (FIG. 34).

Figure 55:
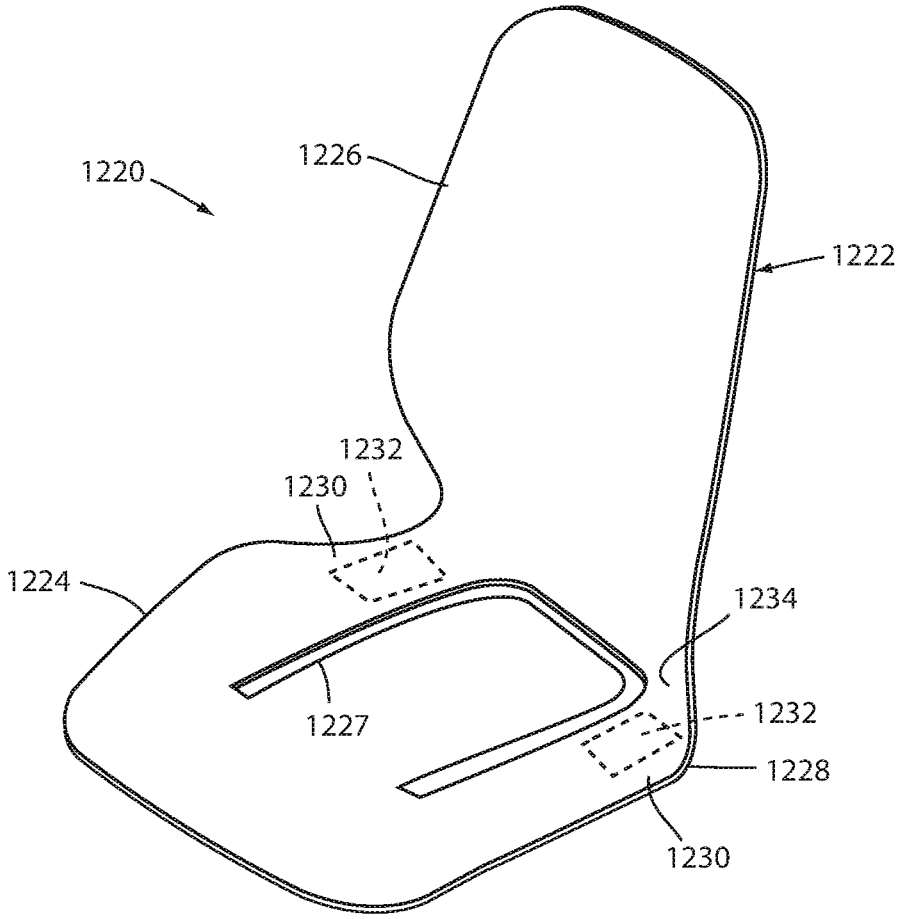
FIG. 55 is a perspective view of a non-weight activated seat structure.

The present inventive flexible reinforcement arrangement and methods for employing the same may be utilized within various seating configurations and for various applications, seating assemblies, seating structures and seating elements. For example, the reinforcement arrangement may be utilized within weight activated seating arrangements, such as that shown in FIGS. 41-47, or within a non-weight activated seat structure 1220, as shown in FIG. 55. The seating structure 1220 includes a seat shell member 1222 having a horizontally-extending seat portion 1224 and a vertically-extending back portion 1226 moveable between an upright position and a reclined position similar to as previously discussed above with respect to the seating arrangement 910. In the illustrated example, the shell member includes a U-shaped aperture 1227 positioned within the seat portion 1224 and extending partially into a transition area 1228 located between the seat portion 1224 and the back portion 1226. The aperture 1227 is configured so as to create a bend portion 1230 located toward each side of the shell 1222 and that are adapted to flex as the back portion 1226 moves between the upright and reclined positions. The seat structure 1220 further includes a pair of resiliently flexible reinforcement members 1232 similar in construction as the resiliently flexible reinforcement members 988, 990 as discussed above, and located within an upper or tensile side proximate a tensile surface 1234 of the shell 1222, where the tensile side is in tension as the back portion moves from an upright to a reclined position.

Figure 56:
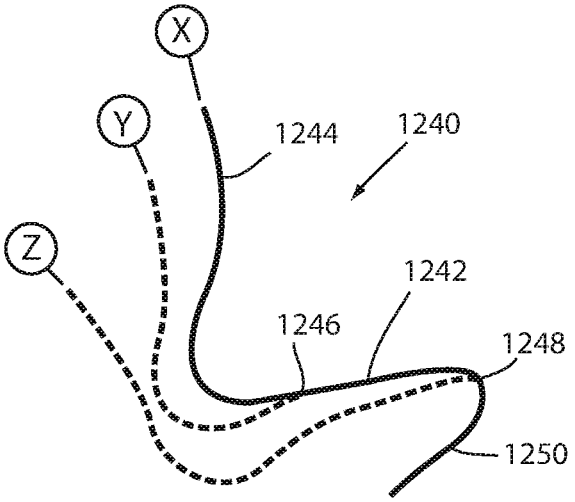
FIG. 56 is a side-elevational schematic view of a seat shell member.
Figure 57:
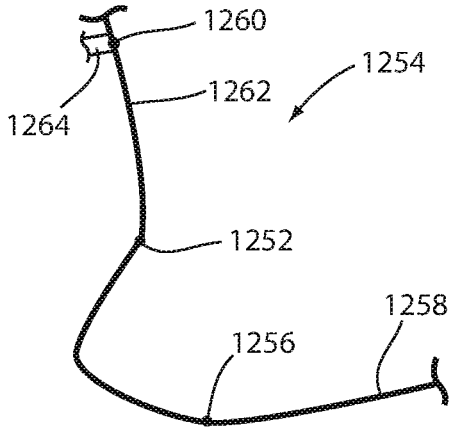
FIG. 57 is a side-elevational schematic view of another embodiment of a seat shell member.

FIG. 56 illustrates a schematic view of a seat shell member 1240 that includes a seat portion 1242 and a back portion 1244, where the shell member 1240 is moveable between an upright position and a reclined position. The shell member 1240 may include advantageously-located bend locations where the material of the shell member 1240 is configured to bend more easily than the remainder of the shell member 1240. In the illustrated example, the shell member 1240 may include a first bend location 1246 positioned between the seat portion 1242 and the back portion 1244 providing bend characteristics within the shell member 1240 as shown between the upright position X and a reclined position Y. Another potential application is a second bend location 1248 located between a forward support portion 1250 providing bend characteristics within the shell member 1240 as shown between the upright position X and a reclined position Z. Additional applications may include similar arrangements located proximate a lumbar support region 1252 (FIG. 57) of a shell member 1254, proximate rear seat supporting locations 1256 of a seat portion 1258, and/or connections 1260 between a back portion 1262 or other portions of the shell member 1254 and a support frame or structure 1264.

Figure 58:
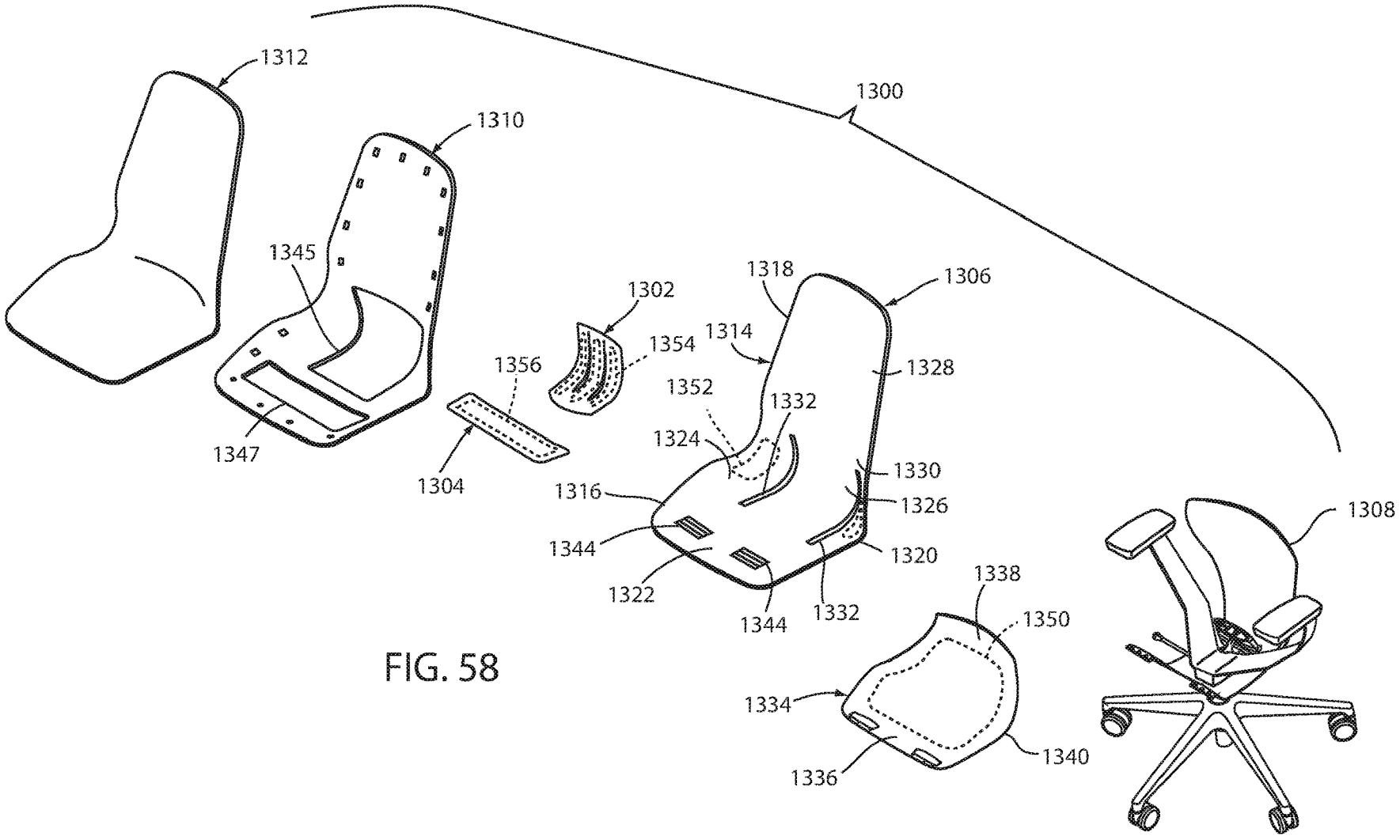
FIG. 58 is an exploded perspective view of another embodiment of a seating arrangement.

The reference numeral 1300 (FIG. 58) generally designates another embodiment of the seating arrangement (where the flexible reinforcement construction of the rear shell member 924 as described above is used within various and multiple elements and components of the seating arrangement 1300. In the illustrated example, the seating arrangement or chair assembly 1300 is similar to the chair assembly 910 previously described with the most notable exceptions being the inclusion of a first reinforcement member 1302, a second reinforcement member 1304, and the construction of the front shell member 1306 via a multi-layer over-molding process. In the illustrated example, the chair assembly 1300 includes the front or first shell member 1306 and the rear or second shell member 1308 that is similar to the previously described rear shell member 924, where the front shell 1306 is covered by a substrate layer or comfort surface 1310 and a fabric cover assembly 1312.

The front shell member 1306 includes an outer shell member 1314 having a horizontally-extending bottom or first portion 1316, a vertically-extending upper or second portion 1318 extending upwardly from the first portion 1316, and an arcuately-shaped transition portion 1320 extending between the first portion 1316 and the second portion 1318. The first portion 1316 includes a forward portion 1322 and a rearward portion 1324, while the second portion 1318 includes a lower portion 1326, an upper portion 1328 and an arcuately-shaped, forwardly convex mid-portion 1330 located therebetween and configured to support the lumbar region of a user's back. The front shell member 1306 further includes a pair of laterally-spaced slots 1332 extending in a fore-to-aft direction similar to the slots 944 of the chair assembly 910 as previously described with respect to seating arrangement 910.

The front shell member 1306 further includes an inner shell portion 1334 having a horizontally-extending bottom or first portion 1336, a vertically-extending upper or second portion 1338, and an arcuately-shaped transition portion 1340 extending between the first portion 1336 and the second portion 1338. In assembly, the inner shell portion 1334 is over-molded over the outer shell member 1314 such that the inner shell portion 1334 covers or overlaps with at least a portion of the bottom portion 1316, the upper portion 1318 and transition portion 1320 at least in the area of the outer shell member 1314 surrounding the slots 1332. Preferably, the inner shell portion 1334 comprises a material that is more flexible than the material from which the outer shell member 1314 is constructed, more preferably the inner shell portion 1334 and outer shell member 1314 each comprise a thermoplastic polymer, and most preferably, the outer shell member 1314 comprises polyethylene terephthalate or polybutylene terephthalate, and the inner shell portion 1334 comprises a thermoplastic polyolefin.

The chair assembly 1300 further includes the reinforcement member 1302 located in the transition portion 1320 of the front shell member 1306, where the reinforcement member 1302 may be substantially rigid or flexible resilient as describe below. The reinforcement member 1302 is arcuately-shaped to match the arcuate shape of the transition portion 1320. In the illustrated example, the reinforcement member 1302 may comprise a relatively stiff material, such as metal, and extend along the transition portion 1320, such that the reinforcement member 1302 prevents the angle between the bottom portion 1316 and the upper portion 1318 from increasing as the upper portion 1318 is moved from the upright position to the reclined position, thereby concentrating compliance or bending in the control arrangement forward of the transition portion 1320.

The chair assembly 1300 further includes the structural reinforcement member 1304 extending between the tabs 1344 that are similar to the tabs 954 of the chair assembly 910 as described above. The reinforcement member 1304 overlaps with an area of the bottom portion 1316 of the shell member 1306 so as to disperse forces transmitted between the rear shell 1308 and the front shell 1306 in the vicinity of the tabs 1344. In assembly, the reinforcement members 1302, 1304 are positioned within corresponding reliefs 1345, 1347 of the substrate layer 1310, respectively.

In the illustrated example, various components and elements may be constructed similar to the rear shell member 924 as previously described, and specifically may comprise a resiliently flexible reinforcement members 1350, 1352, 1354, 1356 overmolded on an outer body. Preferably, one or more structural reinforcement members comprise a substrate material such as nylon molded about a stranded material such as fiberglass or carbon fibers, however other suitable materials may be used, while the associated outer body may comprise a flexibly resilient polymer material such as any thermoplastic, including, for example, nylon, glass-filled nylon, polypropylene, acetyl, or polycarbonate; any thermo set material, including for example, epoxies, or any resin-based composites, including, for example, carbon fiber or fiberglass.

The reference numeral **1300*k* (FIG. 59) generally designated another embodiment of the seating arrangement. Since the seating arrangement or chair assembly 1300*k* is similar to the previously described chair assembly 1300, similar parts appearing in FIG. 58 and FIG. 59 respectively are represented by the same, corresponding reference numeral, except for the suffix "k" in the numerals of the latter. In the illustrated example, an integral, single-piece resiliently flexible reinforcement member 1360 includes a forward portion 1362, a rearward portion 1364 and an arcuately-shaped transition portion 1366 extending between the first portion 1362 and the rearward portion 1364. The forward portion 1362 is substantially rigid and extends between the tabs 1344***k* that are similar to the tabs 954 of the chair 910 as described above, and overlaps with an area of the bottom portion 1316*k* of the shell member 1306*k* so as to disperse forces transmitted between the rear shell 1308*k* and the front shell 1306*k* in the vicinity of the tabs 1344*k*. The rearward portion 1364 is substantially rigid and extends upwardly from the forward portion 1362 such that the rearward portion 1364 is aligned with and structurally supports the mid-portion 1330*k* of the upper portion 1318*k* of the front shell 1306*k*. The transition portion 1366 includes a substantially rigid zone 1370 that may be rigidified by a plurality of longitudinally-extending ribs 1372 so as to disperse forces exerted on the mid-portion 1330*k* by a seated user and structurally reinforce the same, and a resiliently flexible zone 1373 positioned forwardly of the rigid zone 1370. The substantially rigid forward portion 1362, the substantially rigid rearward portion 1364 and the substantially rigid zone 1370 of the transition portion 1366 cooperate to concentrate the deformation of the forward shell 1306*k* in a portion of the forward shell 1306*k* proximate the resiliently flexible zone 1373. In the present example, the resiliently flexible reinforcement member 1360 may be constructed similarly to the rear shell member 924 as previously described where the flexible zone 1373 of the resiliently flexible reinforcement member 1360 includes a tensile side or side in tension proximate a tensile surface and a compression side or side under compression proximate a compression surface, where the tensile side is put in tension and the compression side is under compression when the flexible zone 1373 deforms as the back assembly is moved from the upright position to the reclined position. Similar to the rear shell member 924, the resiliently flexible reinforcement member 1360 may include a tensile substrate in the form of a plurality of longitudinally-aligned glass fibers in-molded within an outer shell comprising a glass-filled nylon, preferably where a majority of the plurality of fibers are located within the tensile side, and more preferably where all of the plurality of fibers are located within the tensile side.

Figure 60:
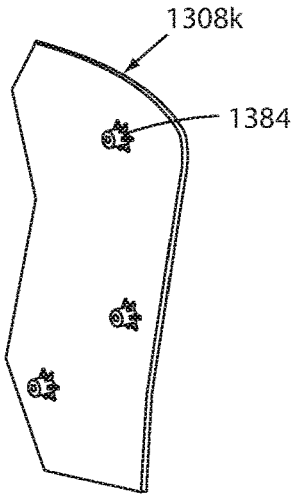
FIG. 60 is an enlarged view of area LX, FIG. 59.
Figure 61:
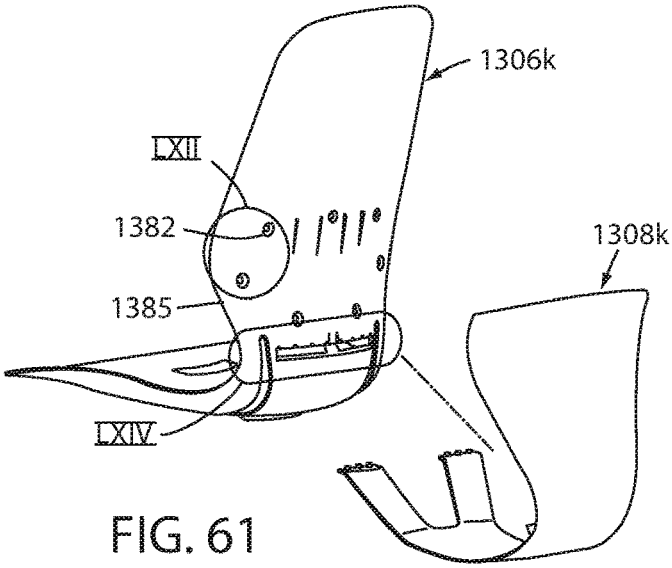
FIG. 61 is a rear perspective view of a front shell member and a rear shell member.
Figure 62:
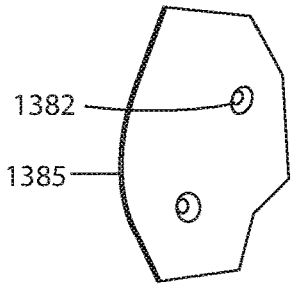
FIG. 62 is an enlarged view of area LXII, FIG. 61.
Figure 63:
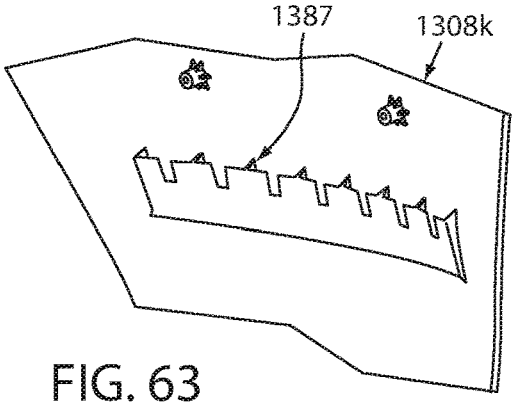
FIG. 63 is an enlarged view of area LXII, FIG. 59.
Figure 64:
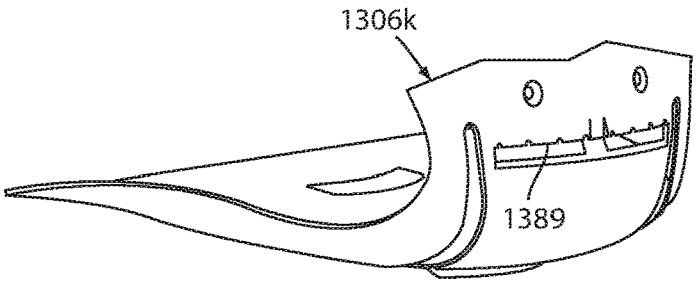
FIG. 64 is an enlarged view of area LXIV, FIG. 61.
Figure 65:
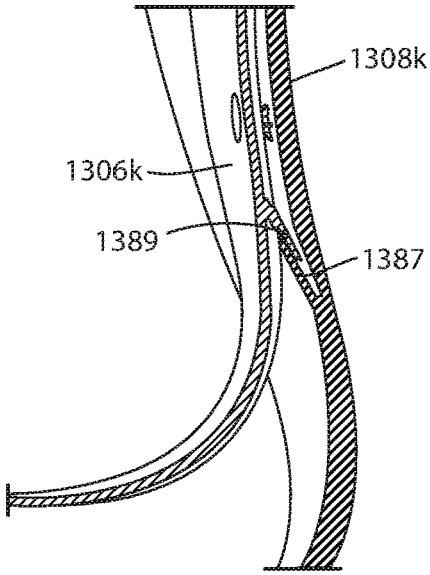
FIG. 65 is a cross-sectional view of the front and rear shell members engaged with one another.
Figure 66:
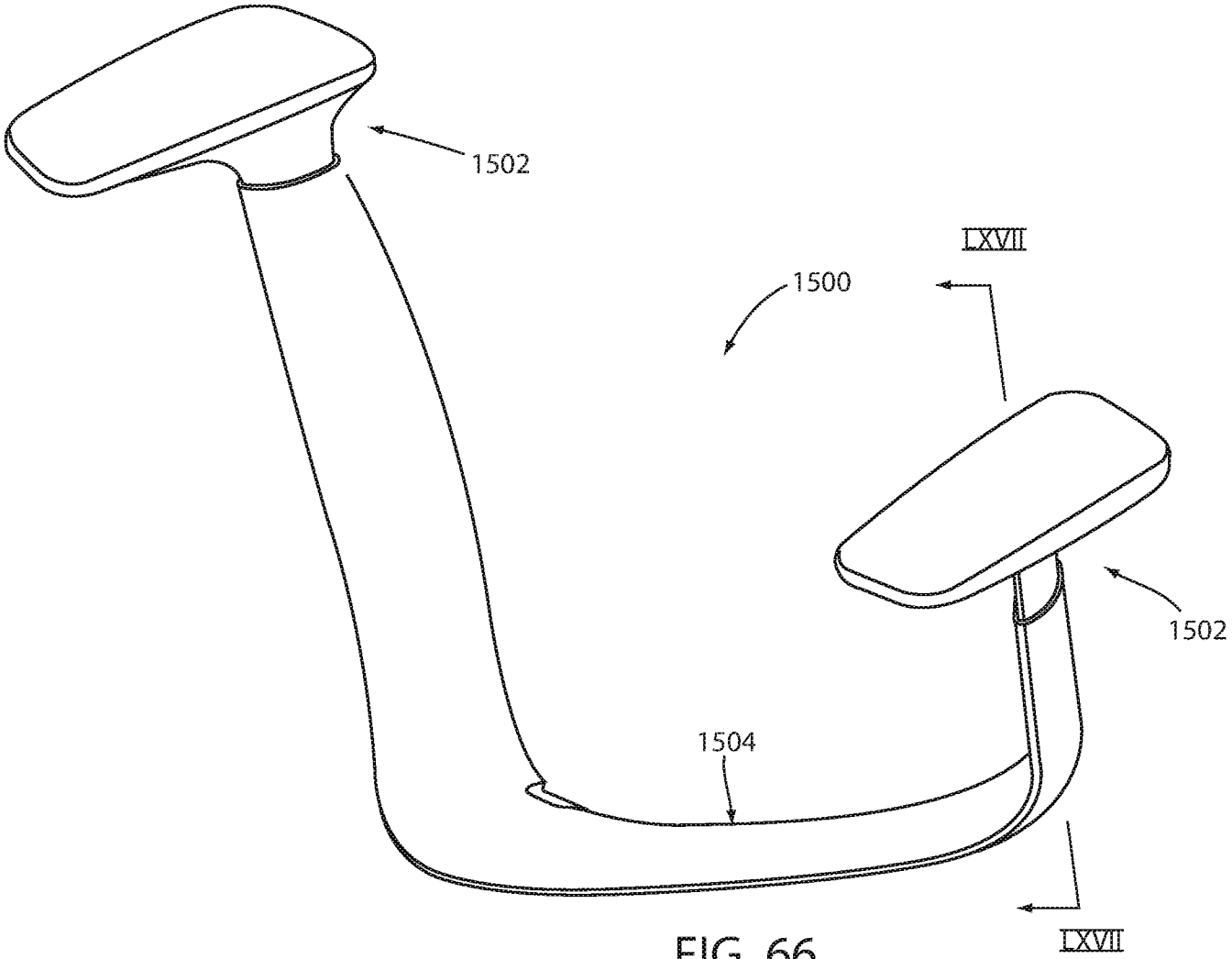
FIG. 66 is a perspective view of an embodiment of an arm arrangement.

In assembly, the rearward portion of the resiliently flexible reinforcement member 1360 is attached to the rear shell member 1308*k* by a plurality of mechanical fasteners (not shown) that are received through corresponding apertures 1380 of the resiliently flexible reinforcement member 1360, apertures 1382 of the front shell member 1306*k*, and into bosses 1384 (FIG. 60) of the rear shell member 1308*k*, where the bosses 1384 are received within corresponding reliefs 1385 (FIGS. 61 and 62) surrounded each of the apertures 1382 of the front shell 1306*k*. The rearward portion 1364 and the forward portion 1362 of the resiliently flexible reinforcement member 1360 are received within corresponding reliefs 1345*k*, 1347*k* of the substrate layer or comfort member 1310*k*, while a central portion 1386 of the substrate layer 1310*k* extends over the transition portion 1366 of the resiliently flexible reinforcement member 1360. A plurality of couplers 1388 attach the substrate layer 1310*k* to the front shell member 1306*k*. The rear shell 1308*k* (FIGS. 59 and 63) also includes a forwardly-extending, integral engagement shelf 1387 that engages a lip 1389 (FIG. 64) defined by a laterally-extending, elongated aperture 1391 of the front shell 1306*k* (FIG. 65) such that the front shell 1306*k* is coupled with the rear shell 1308*k* in the vicinity of the engagement shelf 1387 and lip 1389 and such that forces exerted on the front shell 1306*k* are supported by the rear shell 1308*k*.

Figure 67:
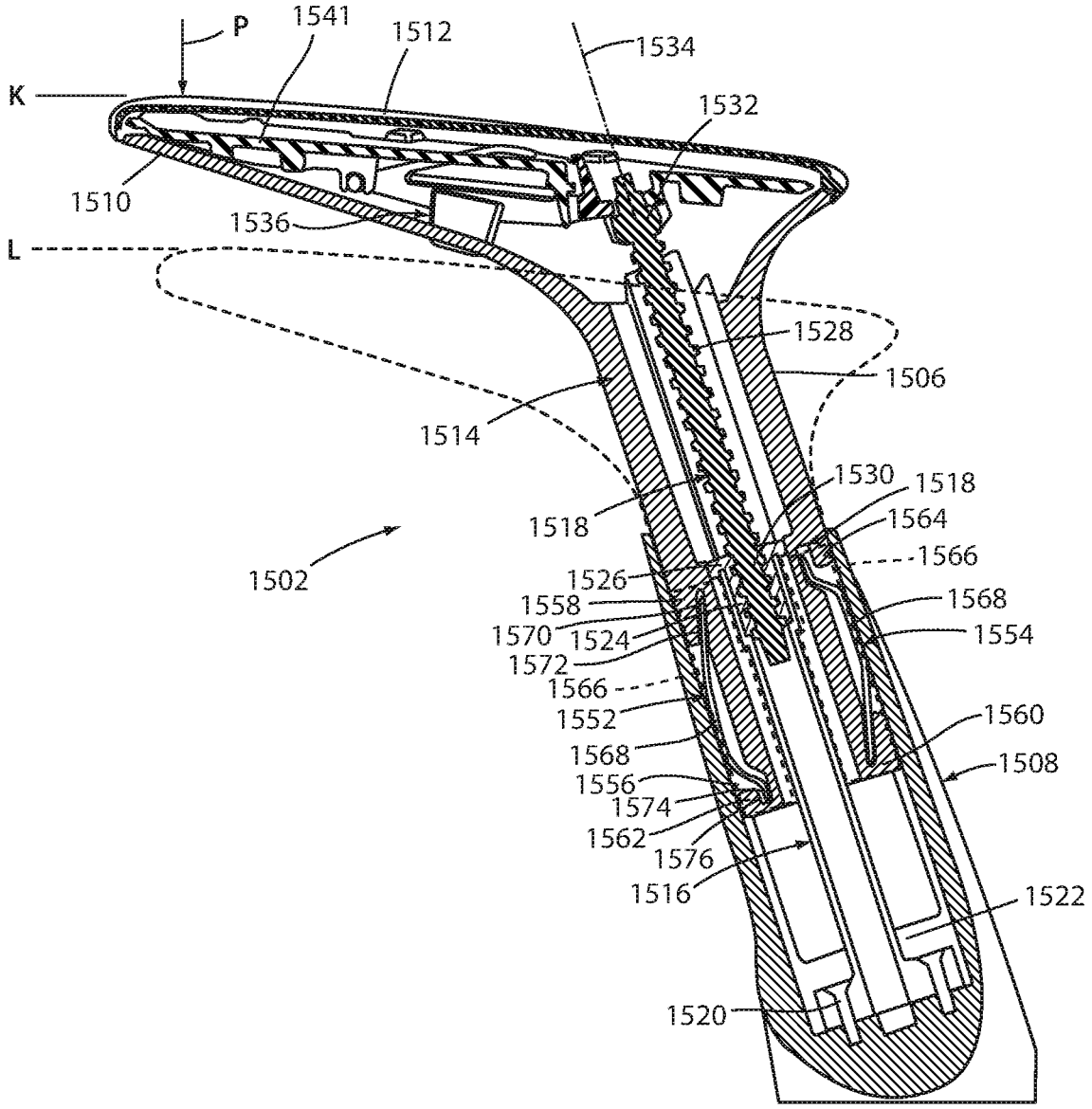
FIG. 67 is a cross-sectional side view of an arm assembly taken along the line LXVII-LXVII, FIG. 66.

In another embodiment, an arm arrangement 1500 (FIG. 66) includes a pair of arm assemblies 1502 telescopingly received within an arm housing 1504. As best illustrated in FIG. 67, each arm assembly 1502 includes an arm stalk 1506 telescopingly received within an associated arm base 1508 such that the arm assembly 1502 is selectively adjustable between a vertically raised position K and a vertically lowered position L. An arm support housing 1510 is integral with the arm stalk 1506 and is covered by an arm cap 1512 configured to support the arm of a seated user.

Figure 68A:
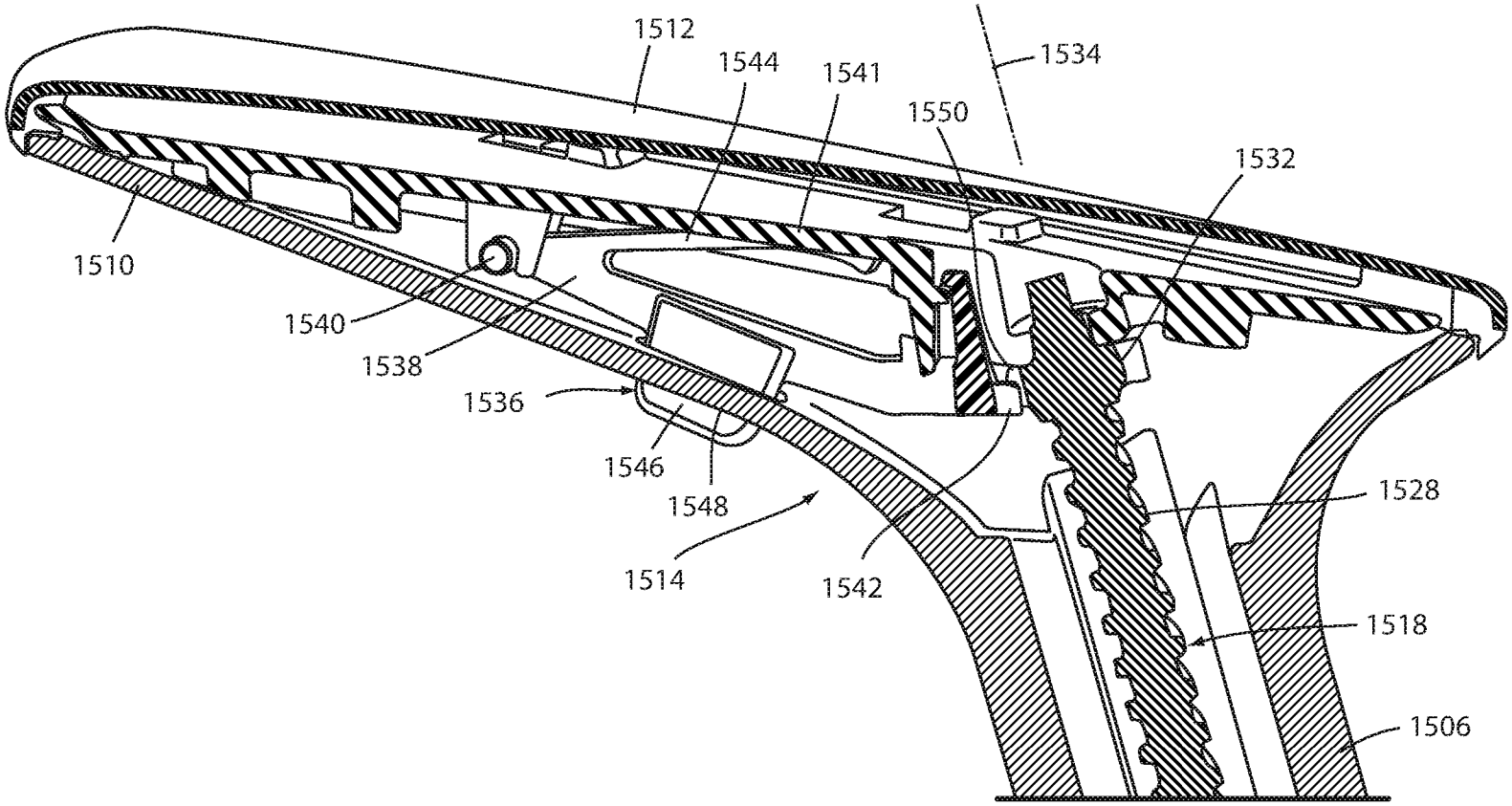
FIG. 68A is an enlarged cross-sectional view of the arm assembly of FIG. 67.

In the illustrated example, the vertical adjustment of each arm assembly 1502 between the raised and lowered positions K, L is controlled by a control arrangement 1514. The control arrangement 1514 includes a lead nut 1516 threadably receiving a lead screw 1518. The lead nut 1516 is fixed to the arm base 1508 by a plurality of mechanical fasteners such as screws 1520 at a first end 1522, and includes a threaded interior surface 1524 and a second end 1526. The lead screw 1518 includes a threaded shaft 1528 having a first end 1530 threadably received within and engaging the threaded interior surface 1524 of the lead nut 1516, and a second end 1532 rotatably coupled to the arm support housing 1510 such that the lead screw 1518 is rotatable about a longitudinal axis 1534 of the lead screw 1518. The control or locking arrangement 1514 also includes an actuator 1536 (FIG. 68A) selectively engageable with the second end 1532 of the lead screw 1518 to prevent or allow the lead screw 1518 to rotate. The actuator 1536 includes a body portion 1538 having a first end 1540 pivotably coupled to an arm cap mount 1541 supported within the arm support housing 1510, and a second end or engagement portion 1542 selectively engageable with the second end 1532 of the lead screw 1518. A flexibly resilient biasing arm 1544 integral with the body portion 1538 extends outwardly from the body portion 1538 and abuts the arm cap mount 1541 and biases the second end 1542 into a locked position as described below. A button portion 1546 is integral with the body portion 1538 and extends through an aperture 1548 of the arm support housing 1510 thereby allowing a user to move the second end 1542 of the body portion 1538 from the locked position. The second end 1532 of the lead screw 1518 includes a plurality of notches 1550 radially spaced thereabout and configured to receive the second end 1542 of the body portion 1538 of the actuator 1536 therein. Rotation of the lead screw 1518 is prevented while the second end 1542 of the body portion 1538 is engaged within one of the notches 1550 of the second end 1532 of the lead screw 1518, thereby preventing vertical adjustment of the arm stalk 1506 within the arm base 1508. Actuation of the button portion 1546 causes the second end 1542 of the body portion 1538 to raise vertically above and disengage the notches 1550 of the second end 1532 of the lead screw 1518, thereby allowing the lead screw 1518 to pivot about the axis 1534 and the arm stalk 1506 to telescope within the arm base 1508 and vertical adjustment of the arm assembly 1502.

Figure 68B:
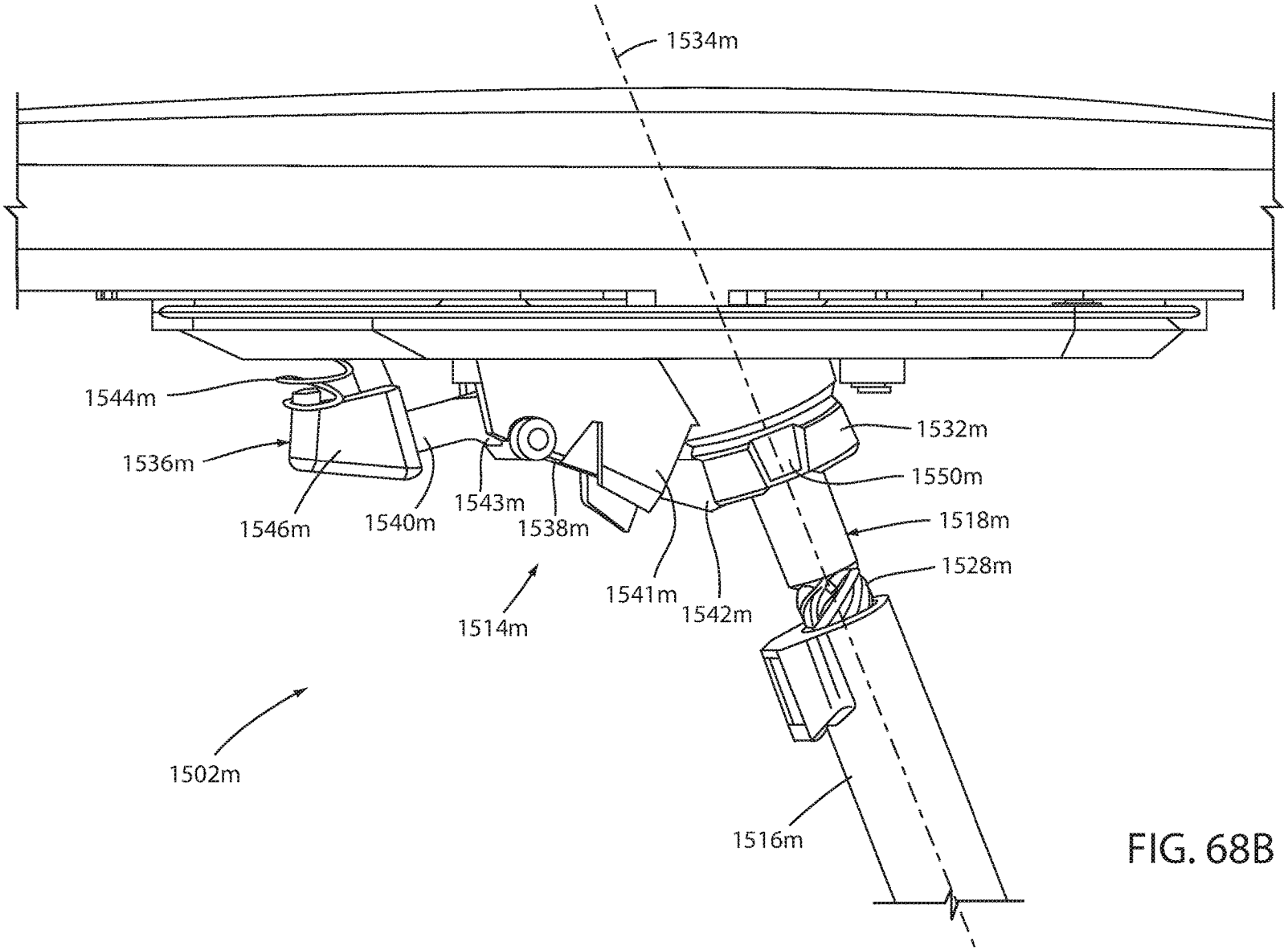
FIG. 68B is a side elevational view of an alternative embodiment of the arm assembly.

In an alternative embodiment, the vertical adjustment of each arm assembly 1502*m* (FIG. 68B) between the raised and lowered positions is controlled by a control arrangement 1514*m*. Since the arm assembly 1502*m* is similar to the previously described arm assembly 1502, similar parts appearing in FIGS. 67 and 68A and FIG. 68B respectively are represented by the same, corresponding reference numeral, except for the suffix "m" in the numerals of the latter. The control arrangement 1514*m* includes a lead nut 1516*m* threadably receiving a lead screw 1518*m*. The lead screw 1518*m* includes a threaded shaft 1528*m* having a first end threadably received within and engaging the threaded interior surface of the lead nut 1516*m*, and a second end 1532*m* rotatably coupled to the arm support housing such that the lead screw 1518*m* is rotatable about a longitudinal axis 1534*m* of the lead screw 1518*m*. The control or locking arrangement 1514*m* also includes an actuator 1536*m* selectively engageable with the second end 1532*m* of the lead screw 1518*m* to prevent or allow the lead screw 1518*m* to rotate. The actuator 1536*m* includes a body portion 1538*m* having a first end 1540*m*, a second end or engagement portion 1542*m* selectively engageable with the second end 1532*m* of the lead screw 1518*m*, and a midsection 1543*m* located between the first and second ends 1540*m*, 1542*m* and pivotably coupled to the arm cap mount 1541*m*. A button portion 1546*m* is integral with the body portion 1538*m* and extends through an aperture of the arm support housing thereby allowing a user to move the second end 1542*m* of the body portion 1538*m* from a locked position as described below. A biasing member that includes a coil spring 1544*m* is positioned between the button portion 1546*m* of the actuator 1536*m* and the arm cap mount 1541*m*, and biases the second end 1542*m* into the locked position. The second end 1532*m* of the lead screw 1518*m* includes a plurality of notches 1550*m* radially spaced thereabout and configured to receive the second end 1542*m* of the body portion 1538*m* of the actuator 1536*m* therein. Rotation of the lead screw 1518*m* is prevented while the second end 1542*m* of the body portion 1538*m* is engaged within one of the notches 1550*m* of the second end 1532*m* of the lead screw 1518*m*, thereby preventing vertical adjustment of the arm stalk within the arm base. Actuation of the button portion 1546*m* causes the second end 1542*m* of the body portion 1538*m* to drop vertically below and disengage the notches 1550*m* of the second end 1532*m* of the lead screw 1518*m*, thereby allowing the lead screw 1518*m* to pivot about the axis 1534*m* and the arm stalk to telescope within the arm base and vertical adjustment of the arm assembly 1502*m*.

A pair of biased bearing arrangements 1552, 1554 are configured to fill any gap 1556 that may exist or develop between the arm stalk 1506 and the arm base 1508. For example, a downward force P exerted by a user on a relatively forward portion of the arm cap 1512 may cause the arm stalk 1506 to rotate forwardly within the arm base 1508 such that the arm stalk 1506 contacts the arm base 1508 at a forward upper location 1558 and a rearward lower location 1560, while gaps 1556 may form at a forward lower portion 1562 and a rearward upper portion 1564. Each biased bearing arrangement 1552, 1554 includes a bearing member 1566 having a U-shaped cross-sectional configuration and preferably comprising a bearing material such as polyoxymethylene. In the illustrated example, each bearing arrangement 1552, 1554 includes a leaf spring 1568 having a first end 1570 received within a first channel 1572 of the arm stalk 1506 and a second end 1574 received within a second channel 1576 of the arm stalk 1506, such that the leaf spring 1568 biases the associated bearing member 1566 away from the arm stalk 1506 and into engagement with the arm base 1508 thereby providing a sliding bearing surface between the arm stalk 1506 and the arm base 1508 and simultaneously filling the gap(s) 1556 and reducing any excessive wiggle or looseness between the arm stalk 1506 and the arm base 1508 providing the arm assembly 1502 with a more firm feel to the user. It is noted that in the illustrated example, one bearing arrangement 1552 is positioned at a front edge of the arm stalk 1506 and is configured to fill the gap 1556 created between a lower edge of the arm stalk 1506 and the arm base 1508, while the other bearing arrangement 1554 is positioned at a rearward edge of the arm stalk 1506 and is configured to fill the gap 1556 created between the arm stalk 1506 and the arm base 1508 located at a different vertical location than the other gap 1556 near the forward edge, and in the instant example, at a location vertically higher than the other gap 1556 near the forward edge.

Figure 69:
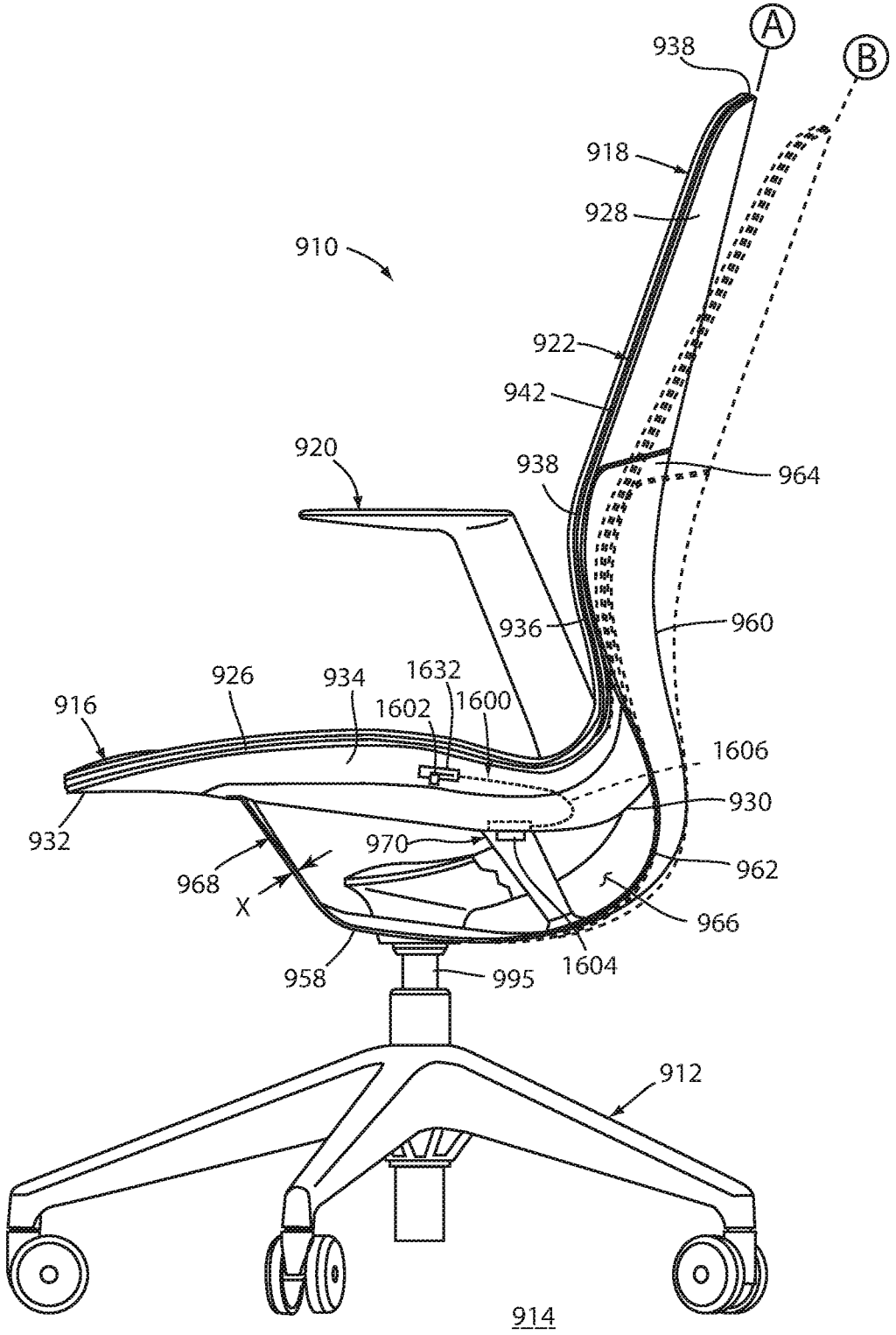
FIG. 69 is a side view of a seating arrangement that includes a back recline stop arrangement.
Figure 70A:
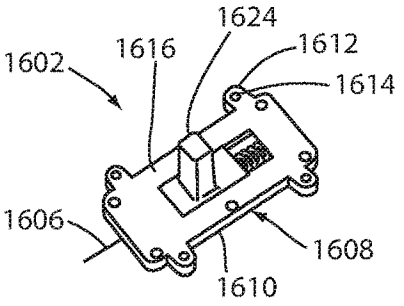
FIG. 70A is a bottom perspective view of a controller of the back recline stop arrangement.
Figure 70B:
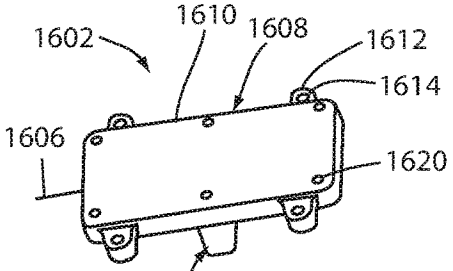
FIG. 70B is a top perspective view of the controller.
Figure 70C:
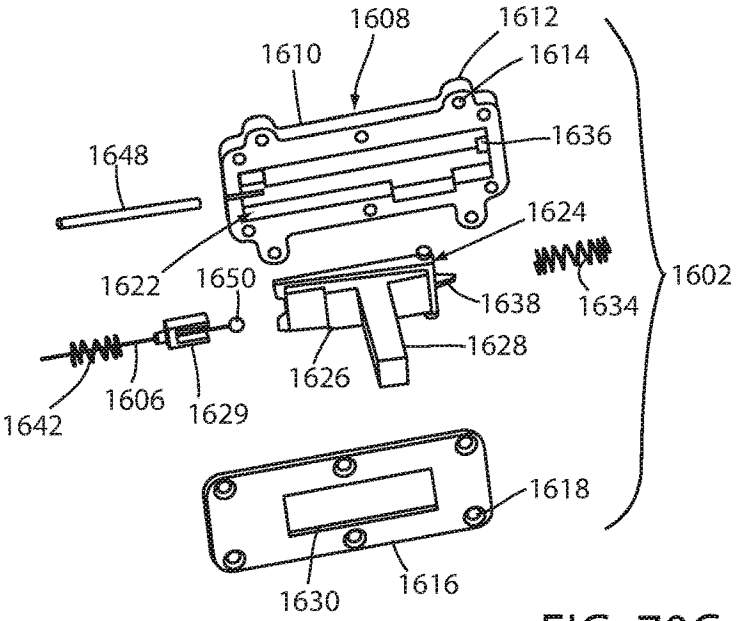
FIG. 70C is an exploded bottom perspective view of the controller.
Figure 70D:
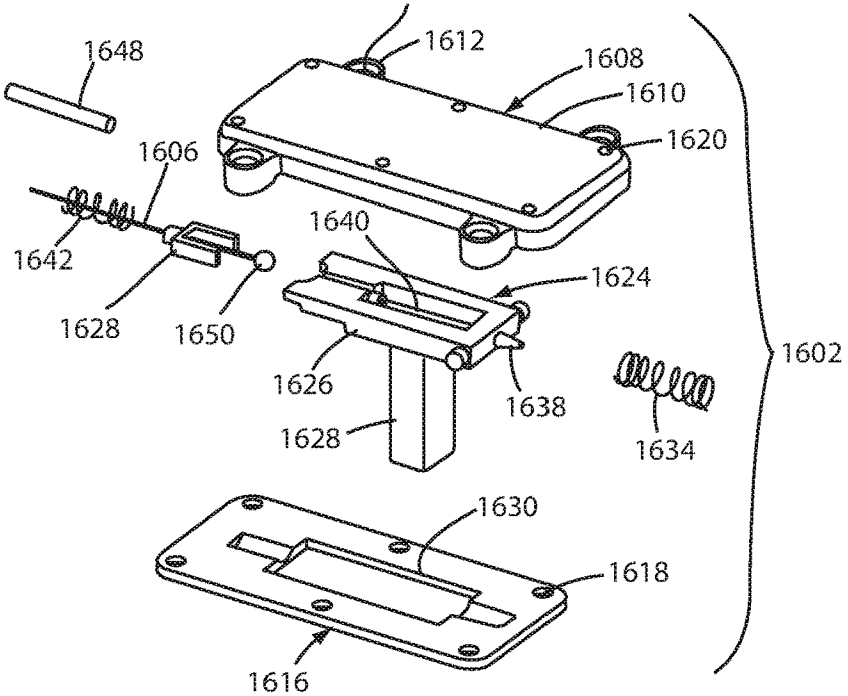
FIG. 70D is an exploded top perspective view of the controller.

In another alternative embodiment, the seating arrangement 910 (FIG. 69) may include a back recline stop arrangement 1600 that includes a controller 1602 coupled to a recline stop assembly 1604 via a cable 1606, where the back recline stop arrangement is operable to allow or prevent the back assembly 918 to move from the upright position A toward the reclined position B.

In the illustrated example, the controller 1602 (FIGS. 70A-70D) includes a housing 1608 that includes a housing body 1610 and a plurality of outwardly-extending tabs 1612 each including an aperture 1614 configured to receive a mechanical fastener such as a screw (not shown) therein for securing the controller 1602 to a lower surface of the first portion 926 of the front shell member 922. A housing cap 1616 is secured to the housing 1608 via a plurality of mechanical fasteners such as screws (not shown) that extend through apertures 1618 of the housing cap 1616 and are threadably received within corresponding apertures 1620 of the housing 1608, and cooperate therewith to define an interior 1622. The controller 1602 further includes an actuator 1624 having a body portion 1626 slidably housed within the interior 1622 and a handle portion 1628 that extends through a slot 1630 of the housing cap 1616 and through an aperture 1632 (FIG. 69) located within the first portion 926 of the first shell member 922 such that the handle portion 1628 is accessible to and may be grasped by a user to actuate the back recline stop arrangement 1600. The controller 1602 further includes a handle spring 1634 in the form of a coil spring and located within the interior 1622 between a boss 1636 of the housing 1608 and a boss 1638 extending from the body portion 1626 of the actuator 1624. A take-up fork 1629 is slidably coupled to an end of the cable 1606 and is received within a pocket 1640 of the body portion 1626 of the actuator 1620 along with a take-up spring 1642 in the form of a coil spring that extends about the cable 1606.

Figure 71C:
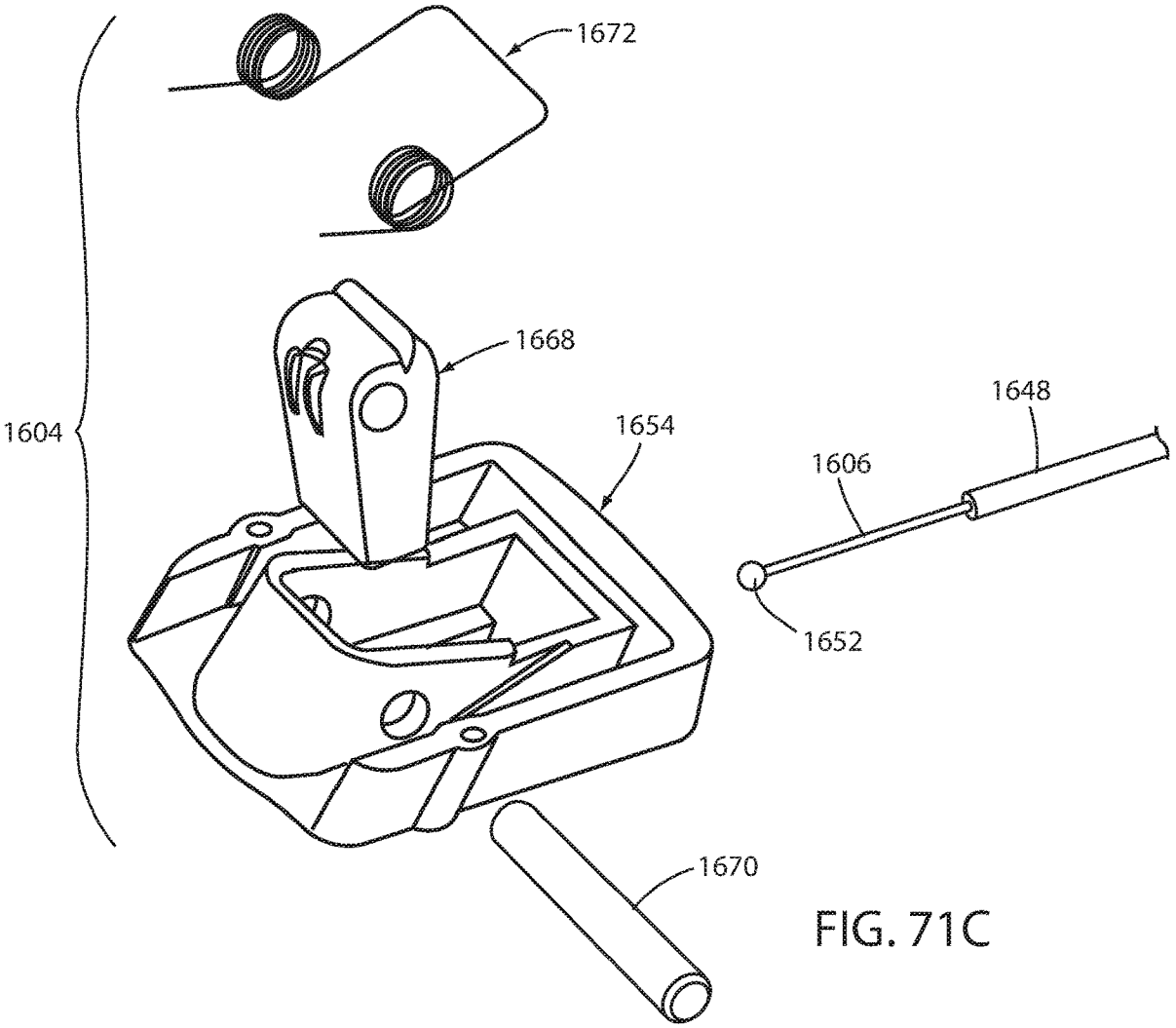
FIG. 71C is an exploded bottom perspective view of the recline stop assembly.

The cable 1606 is slidably housed within a sheath 1648 (FIG. 71C), and includes a first cable end 1650 and a second cable end 1652.

Figure 59:
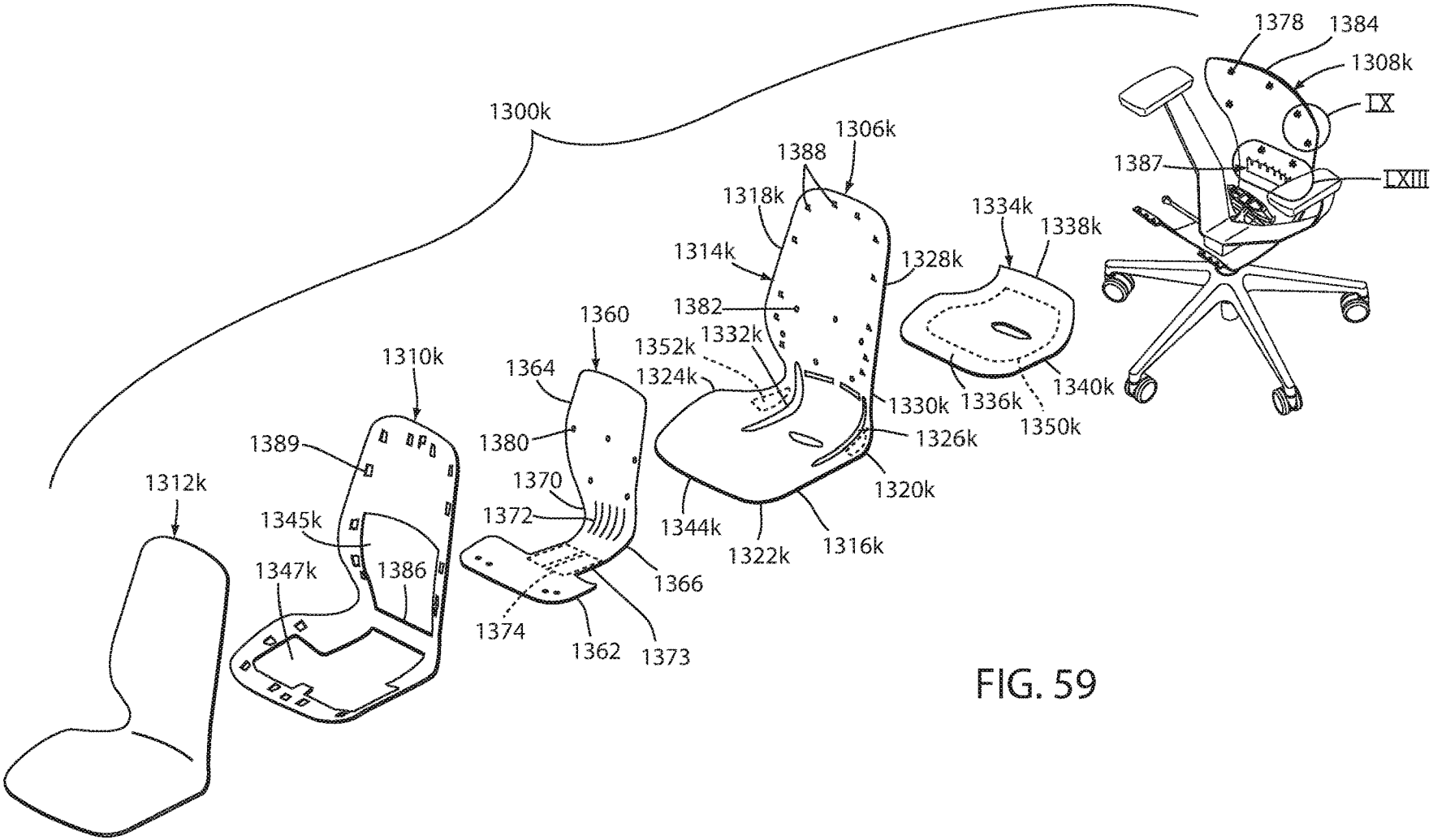
FIG. 59 is an exploded view of another embodiment of a seating arrangement.
Figure 71A:
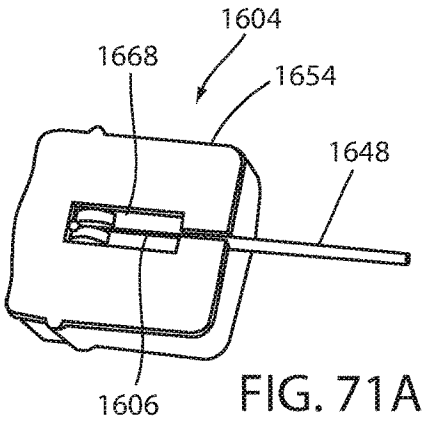
FIG. 71A is a top perspective view of a recline stop assembly.
Figure 71B:
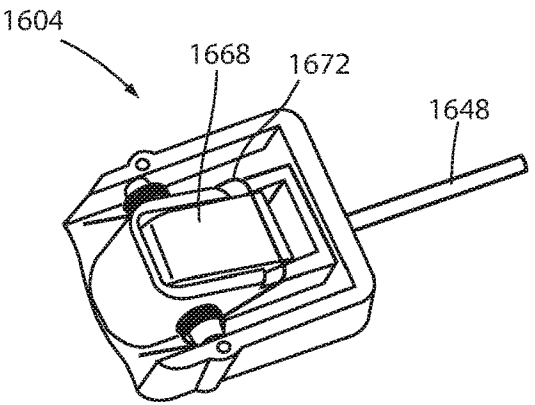
FIG. 71B is a bottom perspective view of the recline stop assembly.
Figure 72:
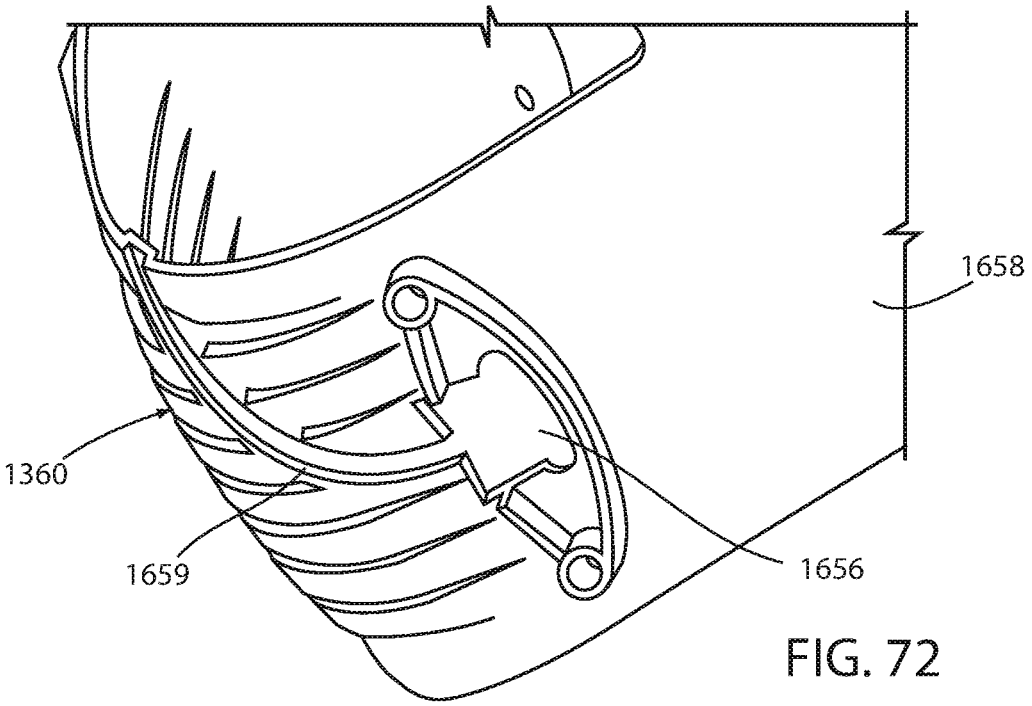
FIG. 72 is a bottom perspective view of a reinforcement member.
Figure 73:
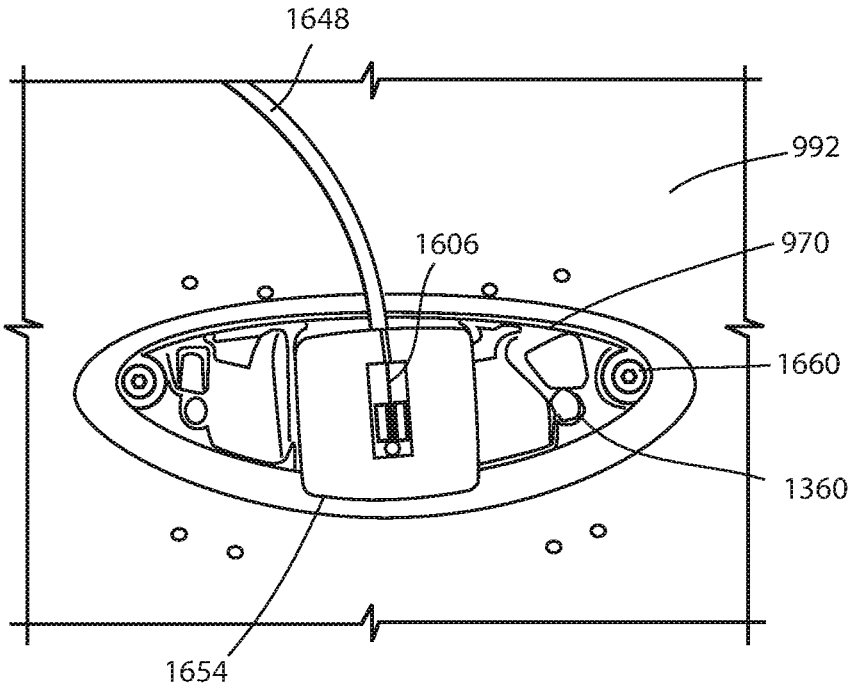
FIG. 73 is a top plan view of the recline stop assembly.

The recline stop assembly 1604 (FIGS. 71A-71C) includes a housing 1654 positioned within a relief 1656 (FIG. 72) integrally molded within a bottom surface 1658 of the reinforcement member 1360 (FIG. 59). The reinforcement member 1360 may also include an integrally molded channel 1659 configured to receive the cable 1606 and the sheath 1648. In assembly, the housing 1654 (FIG. 73) of the recline stop assembly 1604 is trapped between the reinforcement member 1360 and the top of the rearward support 970 by screws 1660.

The recline stop assembly 1604 also includes a back lock post 1668 pivotably coupled to the housing 1654 via a pivot pin 1670, and a torsion spring 1672 received on the pivot pin 1670 and configured to bias the back lock post 1668 from an engaged to a disengaged position as described below.

Figure 74A:
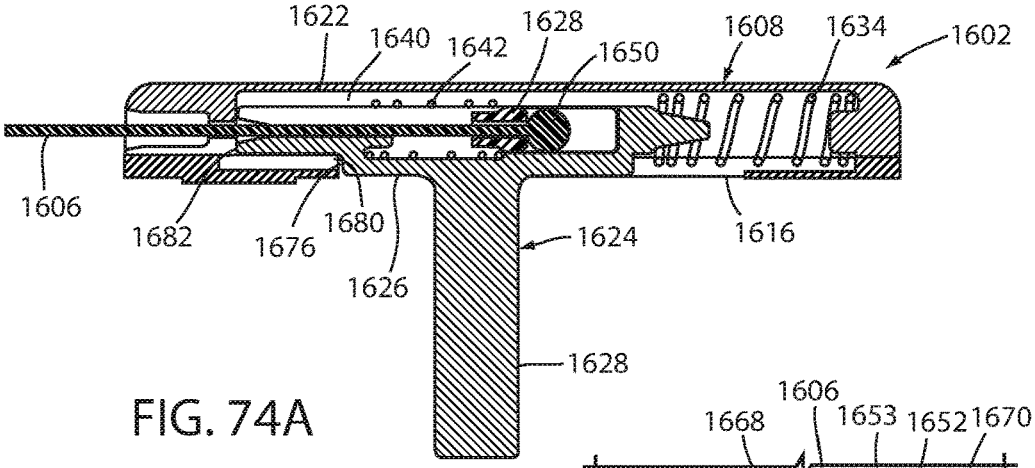
FIGS. 74A and 74B are cross-sectional side views of the recline stop arrangement in a handle disengaged, back stop disengaged mode or position.
Figure 74B:
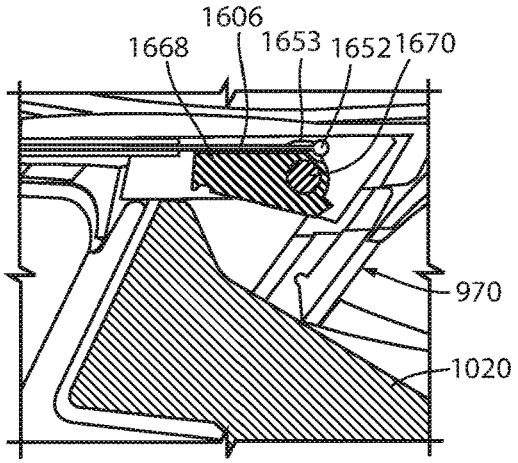
Figure 75A:
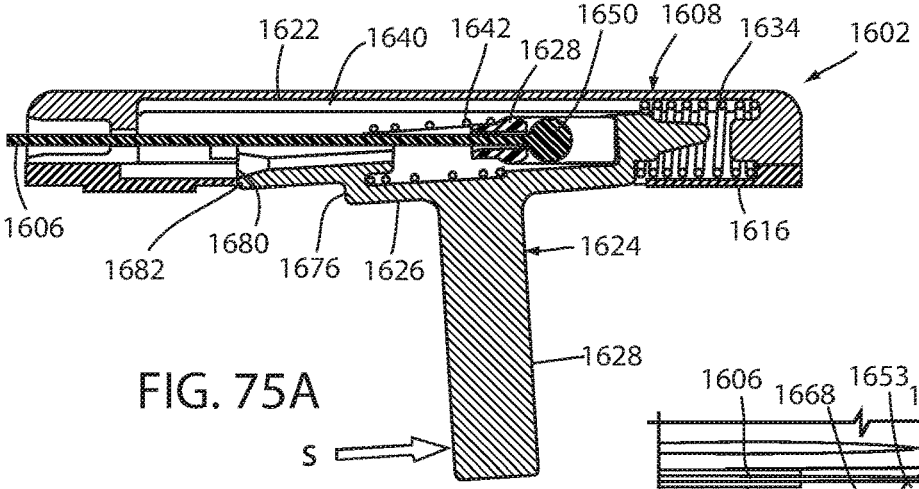
FIGS. 75A and 75B are cross-sectional side views of the recline stop arrangement in a handle engaged, back stop engaged mode or position.
Figure 75B:
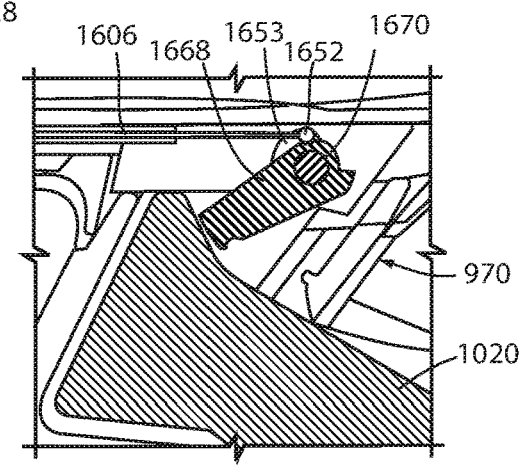
Figure 76A:
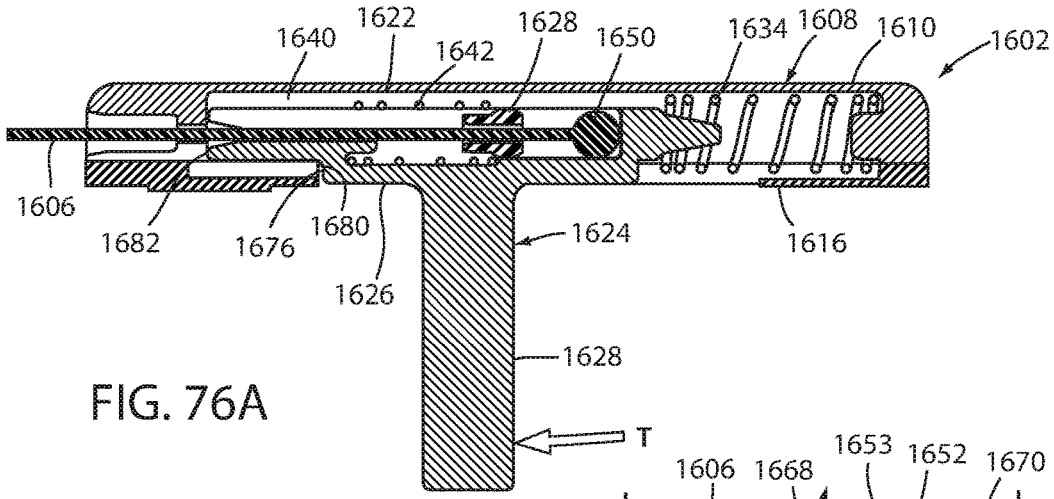
FIGS. 76A and 76B are cross-sectional side views of the recline stop arrangement in a handle disengaged, back stop engaged mode or position.
Figure 76B:
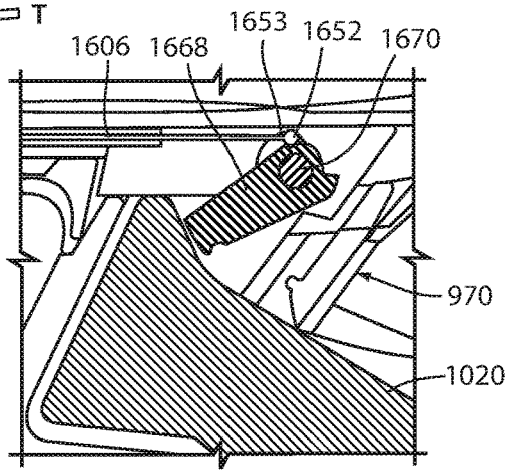
Figure 77A:
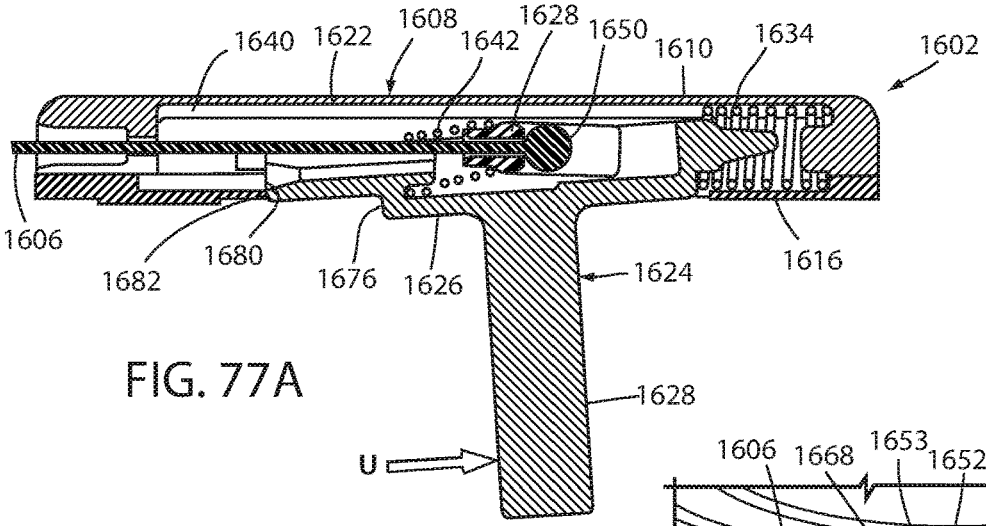
FIGS. 77A and 77B are cross-sectional side views of the recline stop arrangement in a handle engaged, back stop disengaged mode or position.
Figure 77B:
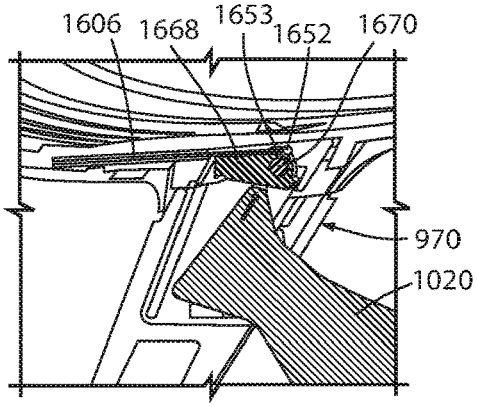

The back recline stop arrangement 1600 is configured to operate between four modes of operation, including: a handle disengaged, back stop disengaged mode as illustrated in FIGS. 74A and 74B; a handle engaged, back stop engaged mode as illustrated in FIGS. 75A and 75B; a handle disengaged, back stop engaged mode as illustrated in FIGS. 76A and 76B; and, a handle engaged, back stop disengaged mode as illustrated in FIGS. 77A and 77B.

In the handle disengaged, back stop disengaged position (FIGS. 74A and 74B) the actuator 1624 is positioned relatively rearward within the interior 1622 of the housing 1608 such that a step 1676 abuts an end 1680 of the slot 1630 of the housing cap 1616. The spring 1634 biases the step 1676 against the end 1680 of the slot 1630 to reduce or prevent any rattle or looseness of the actuator 1624 within the housing 1608. The take-up fork 1628 is positioned against the second end 1650 of the cable 1606 and biased into this by the take-up spring 1642. In the handle disengaged, back stop disengaged position, the back lock post 1668 position is a relatively raised disengaged position such that the rearward support member 970 is allowed to move relative to the stop member 1020 thereby allowing the back assembly 918 to move from the upright position A to the reclined position B. The back stop recline stop arrangement is moved from the handle disengaged, back stop disengaged position of FIGS. 74A and 74B to the handle engaged, back stop engaged position of FIGS. 75A and 75B by an application of a force S by the user causing the secondary end 1652 of the cable 1606 to engage an arm 1653 of the back lock post 1668. In the handle engaged, back stop engaged position (FIGS. 75A and 75B), the actuator 1624 is positioned relatively forward within the interior 1622 of the housing 1608 such that an end wall 1682 of the actuator 1624 abuts the end 1680 of the slot 1630 of the housing cap 1616. The spring 1634 biases the end wall 1682 of the actuator 1624 against the end 1680 of the slot 1630. In the handle engaged, back stop engaged position, the back lock post 1668 is pivoted about the pivot pin 1670 from the disengaged position down to a relatively lowered engagement position where the back lock post 1668 abuts the stop member 1020, thereby preventing the rearward support member 970 from moving relative to the stop member 1020 and preventing the back assembly 918 from moving from the upright position A to the reclined position B. The handle disengaged, back stop engaged mode or position is reached when the controller 1602 is moved from the handle engaged position as shown in FIG. 75A to the handle disengaged position as shown in FIG. 76A while the back assembly 918 is in the reclined position B. In this configuration, the user exerts a force T on the handle portion 1628 of the actuator 1624, thereby moving the actuator 1624 from the relatively forward position within the housing 1608 as shown in FIG. 75A to the relatively rearward position with the housing 1608 as shown in FIG. 76A. However, a binding force between the back lock post 1668 and the stop member 1020 prevents the back lock post 1668 from moving from the engaged or locked position as shown in FIG. 76B to the disengaged or unlocked position as shown in FIG. 74B. The back lock post 1668 remains in the engaged position until the user rotates the back assembly 918 slightly forward, thereby releasing the binding force between the back lock post 1668 and the stop member 1020 and allowing the spring 1672 to bias the back lock post 1668 from the engaged position to the disengaged position, and the back assembly 918 to move from the reclined position B to the upright position A. The handle engaged, back stop disengaged mode or position is reached when the controller 1602 is moved from the handle disengaged position as shown in FIG. 74A to the handle engaged position as shown in FIG. 77A while the back assembly 918 is in the reclined position B. In this configuration, the user exerts a force U on the handle portion of the actuator 1624, thereby moving the actuator 1624 from the relatively rearward position within the housing 1608 as shown in FIG. 74A to the relatively forward position within the housing 1608 as shown in FIG. 77A. However, the position of the stop member 1020 prevents the back lock post 1668 from moving from the disengaged position as shown in FIG. 77A to the engaged position as shown in FIG. 75B. The back lock post 1668 remains in the disengaged position until the user rotates the back assembly 918 from the reclined position B toward the upright position A until the back lock post 1668 clears the stop member 1020 and the spring 1642 biases the take-up fork 1628 which pushes the end 1650 of the cable 1606, thereby forcing the back lock post 1668 from the disengaged position of FIG. 77B to the engaged position of FIG. 74B. The seating arrangement(s) as described herein may also include control arrangements to either augment or replace the back recline stop arrangement 1600.

Figure 78:
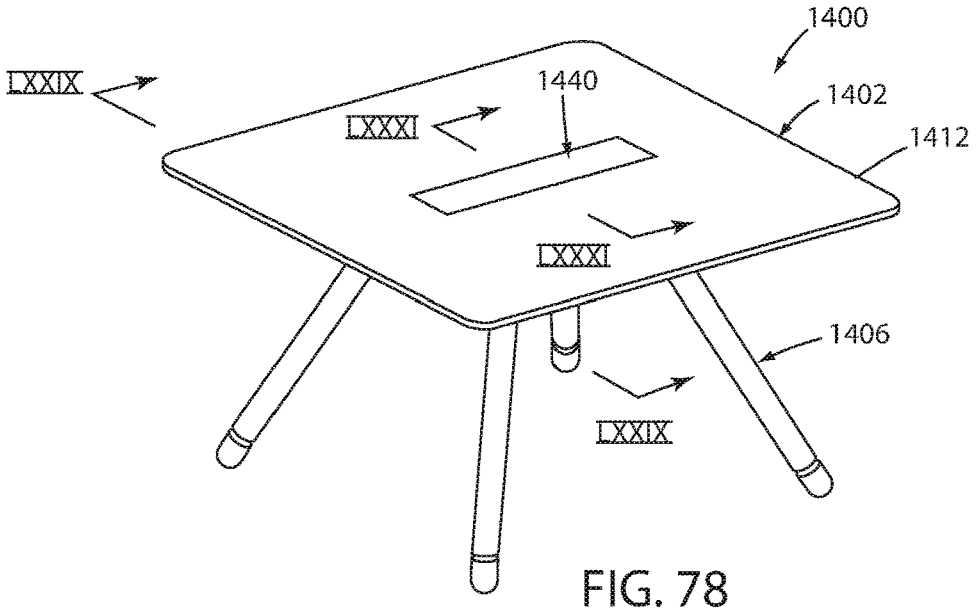
FIG. 78 is a perspective view of a table arrangement.
Figure 79:
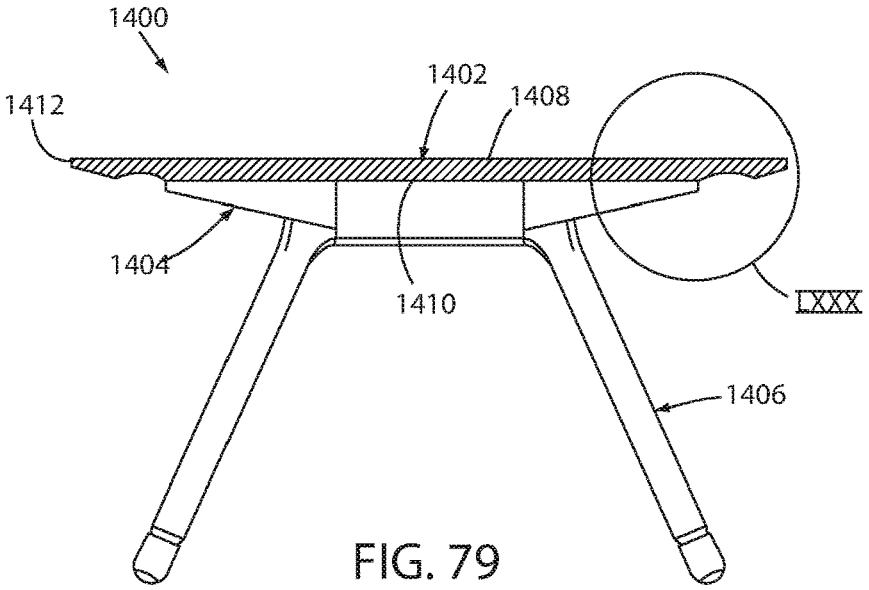
FIG. 79 is a cross-sectional view of the table arrangement taken along the line LXXIX-LXXIX, FIG. 78.
Figure 80:
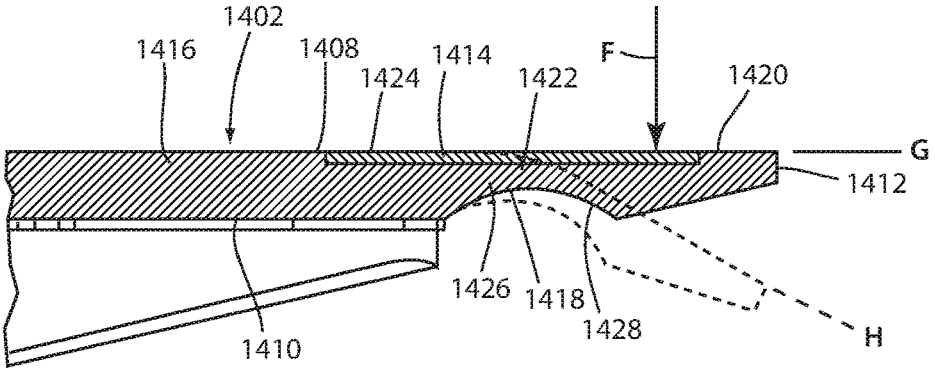
FIG. 80 is an enlarged, cross-sectional view of the area LXXX, FIG. 79.

The resiliently flexible reinforcement arrangements as described herein may also be utilized in other components or assemblies, such as, for example, other furniture components. For example, a resiliently flexible arrangement may be utilized within a table assembly 1400 (FIG. 78) that includes a work surface 1402 supported by a frame assembly 1404 (FIG. 79) which is in turn supported by a plurality of legs 1406. In the instant example, the work surface 1402 (FIG. 80) includes a top surface 1408, a bottom surface 1410 and an outer peripheral edge 1412, and comprises a tensile substrate 1414 covered by a body portion 1416 overmolded onto the tensile substrate 1414 in a manner similar to the process described above with respect to the rear shell member 924 of the seating arrangement 910. Preferably, the tensile substrate 1414 includes a substrate material such as nylon molded about a stranded material such as fiberglass or carbon fibers, however other suitable materials may be used, while the associated outer body may comprise a flexibly resilient polymer material such as any thermoplastic, including, for example, nylon, glass-filled nylon, polypropylene, acetyl, or polycarbonate; any thermo set material, including for example, epoxies; or any resin-based composites, including, for example, carbon fiber or fiberglass. The tensile substrate 1414 may be positioned in an area of the work surface 1402 having a reduced thickness 1418, and preferably includes a plurality of longitudinally aligned strands such as glass fibers that extend in a radial direction across the area of reduced thickness 1418 in mold within a poly material. In the illustrated example, the work surface 1402 includes a peripheral lip 1420 configured to deflect downwardly from an upright position G to a deflected position H upon exertion of sufficient force F. The outer body 1416 is molded about the tensile substrate 1414 such that the tensile substrate 1414 is located in a tensile side 1422 proximate an upper or tensile surface 1424 opposite a bottom or compression side 1426 proximate a bottom or compression surface 1428, where the tensile side 1422 is put in tension and the compression side 1426 is under compression when the area of reduced thickness or flexing zone 1418 is deformed as the lip 1420 is moved from the upright position G to the deflected position H, and such that the tensile substrate 1414 biases the lip 1420 from the deflected position H toward the upright position G.

Figure 81:
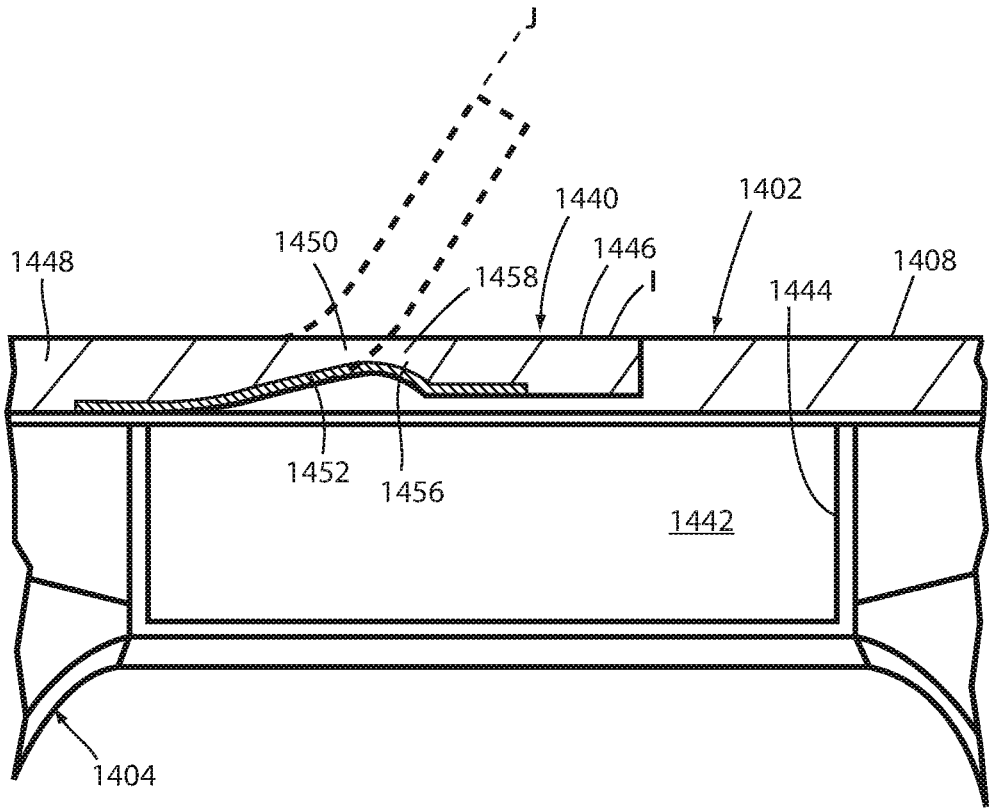
FIG. 81 is an enlarged, cross-sectional view taken along the line LXXXI-LXXXI, FIG. 78.

In yet another embodiment, the resiliently flexible arrangement is utilized within a door arrangement 1440 positioned within the work surface 1402 and configured to allow access through the work surface 1402 and into an interior 1442 (FIG. 81) of a wireway or wire trough 1444 positioned below the work surface 1402. The door arrangement 1440 includes a door 1446 integrally connected to a body portion 1448 of the work surface 1402 via a flexing zone 1450 having a relatively reduced thickness. The flexing zone 1450 includes a tensile substrate 1452 constructed similar the tensile substrate 1414 described above and positioned within a tensile side 1454 of flexing zone 1450 opposite a compression side 1456 thereof. The door arrangement 1440 is configured such that a user may move the door 1446 from the position I to the open position J thereby allowing access to the interior 1442, and such that the tensile substrate 1452 biases the door 1446 from the open position J toward the closed position I.

It is noted that in each of the aforedescribed embodiments, the seating arrangement is configured such that some, many, or all of the components may be visible from an exterior of the seating arrangements subsequent to the seating arrangements being completely manufactured and assembled, such that the visible components form an outer aesthetic appearance of the seating arrangement, or alternatively may be enclosed within an interior of the chair assembly such that the components are not visible to the casual observer. Specifically, components such as the forward support member, the rearward support member, the support member, as well as the stop arrangements as described are at least partially visible from an exterior of the chair, and cooperate to form an overall outer aesthetic thereof. Certain embodiments may include some, many, or all of the components described herein. For example, an embodiment may include one or more apertures, one or more of the stop systems, and/or components or materials selected for performance purposes, e.g., to bias the seat arrangement to an upright position or for material strength requirements. In some embodiments, a selection of a particular component may influence the selection of various other components. For example, using a particular aperture or apertures may dictate what type of components or materials should be used for performance purposes and vice versa.

Various embodiments of the seating arrangements described herein may provide a platform with the proper fit and function for comfortably supporting a seated user that may also reduce or shift costs, for example by reducing associated part counts, manufacturing costs, and labor costs. Certain aspects of the seating arrangements may include an uncomplicated, durable, and visually appealing design capable of a long operating life, and particularly well adapted for the proposed use.

In the foregoing description, it will be readily appreciated by those skilled in the art that modifications may be made to the described embodiments without departing from the concepts disclosed herein. Such modifications are to be considered as included in the following claims, unless these claims by their language expressly state otherwise.

The invention claimed is:

1. A seating arrangement, comprising:

a seat member configured to support a seated user;

a base configured to support the seat member; and an arm assembly, comprising:

an arm base having a central portion and a receiver portion extending upwardly from the central portion, where the arm base is exclusively supported from the base via the central portion at one or more positions located between lateral outermost edges of the seat member;

an arm stalk telescopingly received within the receiver portion of the arm base such that the arm stalk is movable between a retracted position and an extended position;

an arm support supported on an upper end of the arm stalk and configured to support an arm of a seated user, where the arm support moves in a forward direction with respect to the seat member as the arm stalk is moved from the retracted position to the extended position; and a bearing arrangement positioned between the arm stalk and the receiver, the bearing arrangement including a bearing member located between the receiver portion of the arm base and the arm stalk and a biasing member configured to bias the bearing member between the receiver portion of the arm base and the arm stalk.

2. The seating arrangement of claim 1, wherein the biasing member biases the bearing member in a fore-to-aft direction with respect to the seat member.

3. The seating arrangement of claim 1, wherein the biasing member biases the bearing member from the arm stalk and into abutment with the receiver portion of the arm base.

4. The seating arrangement of claim 1, where the receiver portion is one of a pair of receiver portions located at opposite ends of the central portion, and wherein the pair of receiver portions cooperate with the central portion to form a U-shape.

5. The seating arrangement of claim 1, wherein the arm assembly further comprises a lock member movable between a first position that prevents the arm stalk from moving from between the retracted and extended positions and a second position where the arm stalk may be moved between the retracted and extended positions, and an actuator arrangement configured to allow a user to move the lock member from the first position to the second position.

6. The seating arrangement of claim 5, wherein the actuator arrangement includes an actuator configured to receive an input from the user to move the lock member from the first position to the second position, and wherein the actuator is positioned forward of the arm stalk.

7. The seating arrangement of claim 1, wherein the bearing member comprises an oil-filled plastic.

8. The seating arrangement of claim 1, wherein the biasing member includes a spring.

9. The seating arrangement of claim 8, wherein the spring includes a leaf spring.

10. The seating arrangement of claim 1, wherein the bearing arrangement is one of a pair of bearing arrangements.

11. The seating arrangement of claim 10, wherein one of the bearing arrangements of the pair of bearing arrangements is positioned on a forward edge of the arm stalk and the other bearing arrangement of the pair of bearing arrangements is positioned on a rearward edge of the arm stalk.

12. The seating arrangement of claim 1, further comprising:

a back member extending upwardly from the seat member and movable between an upright position and a reclined position, wherein the arm support remains fixed with respect to the base as the back member is moved between the upright and reclined positions.

13. The seating arrangement of claim 1, wherein the seating arrangement comprises an office chair.

14. A seating arrangement, comprising:

a seat member configured to support a seated user;

a base configured to support the seat member; and an arm assembly, comprising:

an arm base having a central portion and a pair of receiver portions extending upwardly from opposite ends of the central portion and cooperating with the central portion to form a U-shape, wherein the arm base is exclusively supported from the base via the central portion at one or more positions located between lateral outermost edges of the seat member;

a pair of arm stalks telescopingly received within the receiver portions of the arm base such that the arm stalks are each movable between a retracted position and an extended position;

a pair of arm supports supported on an upper end of the arm stalks and each configured to support an arm of a seated user, where each arm support moves in a forward direction with respect to the seat member as the respective arm stalk is moved from the retracted position to the extended position;

a pair of lock members each movable between a first position that prevents the respective arm stalk from moving from between the retracted and extended positions and a second position where the respective arm stalk may be moved between the retracted and extended positions; and a pair of actuator arrangements each configured to allow the user to move the respective lock member from the first position to the second position.

15. The seating arrangement of claim 14, wherein each actuator arrangement includes an actuator configured to receive an input from the user to move the respective lock member from the first position to the second position, and wherein each actuator is positioned forward of the respective arm stalk.

16. The seating arrangement of claim 14, wherein each arm assembly further comprises a lead screw rotatable with respect to one of the arm stalk and arm base and a lead nut fixed with respect to the other of the arm stalk and the arm base, and wherein the respective lock member engages the lead screw when in the first position and is disengaged from the lead screw when in the second position.

17. The seating arrangement of claim 14, further comprising:

a back member extending upwardly from the seat member and movable between an upright position and a reclined position, wherein the arm base remains fixed with respect to the base as the back member is moved between the upright and reclined positions.

18. The seating arrangement of claim 14, wherein the arm assembly further comprises a bearing arrangement positioned between one of the arm stalks and the respective receiver portion, the bearing arrangement including a bearing member located between the respective receiver portion of the arm base and the respective arm stalk and a biasing member configured to bias the bearing member between the respective receiver portion of the arm base and the respective arm stalk.

19. The seating arrangement of claim 18, wherein the biasing member biases the bearing member in a fore-to-aft direction with respect to the seat member.

20. The seating arrangement of claim 14, wherein the seating arrangement comprises an office chair.

* * * * *